US007878130B2

(12) United States Patent
Yamamoto et al.

(10) Patent No.: US 7,878,130 B2
(45) Date of Patent: Feb. 1, 2011

(54) OVERFIRING AIR PORT, METHOD FOR MANUFACTURING AIR PORT, BOILER, BOILER FACILITY, METHOD FOR OPERATING BOILER FACILITY AND METHOD FOR IMPROVING BOILER FACILITY

(75) Inventors: Kenji Yamamoto, Hitachinaka (JP); Hirofumi Okazaki, Hitachinaka (JP); Masayuki Taniguchi, Hitachinaka (JP); Kazumi Yasuda, Hitachi (JP); Kenji Kiyama, Kure (JP); Takanori Yano, Aki (JP); Akira Baba, Kure (JP); Kenichi Ochi, Kure (JP); Hisayuki Orita, Hitachinaka (JP); Akihito Orii, Hitachi (JP); Yuki Kamikawa, Hitachinaka (JP); Kouji Kuramashi, Kure (JP)

(73) Assignee: Babcock-Hitachi K.K., Tokyo (JP)

( * ) Notice: Subject to any disclaimer, the term of this patent is extended or adjusted under 35 U.S.C. 154(b) by 509 days.

(21) Appl. No.: 11/265,198

(22) Filed: Nov. 3, 2005

(65) Prior Publication Data

US 2006/0115779 A1 Jun. 1, 2006

(30) Foreign Application Priority Data

| | | |
|---|---|---|
| Nov. 4, 2004 | (JP) | 2004-320140 |
| Feb. 9, 2005 | (JP) | 2005-033309 |
| Oct. 17, 2005 | (JP) | 2005-301437 |
| Oct. 17, 2005 | (JP) | 2005-301441 |

(51) Int. Cl.
*F23B 5/00* (2006.01)

(52) U.S. Cl. ..... 110/214; 110/309; 110/310; 110/348

(58) Field of Classification Search ..... 110/263–266, 110/205, 210, 211, 212, 213, 214, 297, 303, 110/304, 309, 310, 348, 266.165 R, 347; 431/182, 185; 122/6 A
See application file for complete search history.

(56) References Cited

U.S. PATENT DOCUMENTS 4,245,980 A 1/1981 Reed et al.
4,627,366 A * 12/1986 LaRue et al. ..... 110/263

(Continued)

FOREIGN PATENT DOCUMENTS

CN 1170845 A 1/1998

(Continued)

OTHER PUBLICATIONS

European Search Report dated Mar. 21, 2006 (Eight (8) pages).

(Continued)

*Primary Examiner*—Kenneth B Rinehart
(74) *Attorney, Agent, or Firm*—Crowell & Moring LLP

(57) ABSTRACT

A overfiring air port of the present invention is to supply an incomplete combustion region with air making up for combustion-shortage, in a furnace in which the incomplete combustion region less than stoichiometric ratio is formed by a burner. Furthermore, the airport is characterized by comprising: a nozzle mechanism for injecting air including an axial velocity component of an air flow and a radial velocity component directed to a center line of the airport; and a control mechanism for controlling a ratio of these velocity components.

5 Claims, 38 Drawing Sheets

U.S. PATENT DOCUMENTS

| | | | | | |
|---|---|---|---|---|---|
| 4,702,180 | A | * | 10/1987 | Kiga | 110/263 |
| 5,562,437 | A | | 10/1996 | Gauthier et al. | |
| 5,651,320 | A | * | 7/1997 | Leisse et al. | 110/262 |
| 5,727,480 | A | * | 3/1998 | Garcia-Mallol | 110/203 |
| 5,738,021 | A | * | 4/1998 | Vatsky et al. | 110/163 |
| 5,915,310 | A | | 6/1999 | Hura et al. | |

FOREIGN PATENT DOCUMENTS

| | | | |
|---|---|---|---|
| EP | 1 580 485 | A1 | 9/2005 |
| JP | 55-3596 | | 1/1980 |
| JP | 62-123207 | | 6/1987 |
| JP | 62-127199 | | 6/1987 |
| JP | 64-38418 | | 3/1989 |
| JP | 04-052414 | | 2/1992 |
| JP | 05-018510 | | 1/1993 |
| JP | 06-201105 | | 7/1994 |
| JP | 07-71715 | | 3/1995 |
| JP | 09-112816 | | 2/1997 |
| JP | HEI 09-303742 | | 11/1997 |
| JP | 2759306 | | 3/1998 |
| JP | 10-89622 | A | 4/1998 |
| JP | 10-122546 | | 5/1998 |
| JP | 10-238714 | | 9/1998 |
| JP | 2001-349533 | A | 12/2001 |
| JP | 2001-355832 | | 12/2001 |
| JP | 2004-320140 | | 11/2004 |
| WO | WO 2004/053392 | A1 | 6/2004 |

OTHER PUBLICATIONS

Korean Office Action mailed May 10, 2007.
Chinese Office Action dated Nov. 7, 2008.
Japanese Office Action mailed Oct. 21, 2009 and English Translation thereof.
Japanese Office Action mailed Feb. 2, 2010 and Partial English Translation.
Second Chinese Office Action mailed Feb. 12, 2010 and Partial English Translation.
Japanese Office Action with partial English translation dated Jul. 6, 2010 (six (6) pages).

* cited by examiner

REFERENCE EXPERIMENTAL DATA
B.J.Mi et al, J. Fluid Mech, 432 (2001) 91-125

OVERFIRING AIR PORT, METHOD FOR MANUFACTURING AIR PORT, BOILER, BOILER FACILITY, METHOD FOR OPERATING BOILER FACILITY AND METHOD FOR IMPROVING BOILER FACILITY

CLAIM OF PRIORITTY

The present application claims priority from Japanese application serial no. 2004-320140, filed on Nov. 4, 2004, no. 2005-33309, filed on Feb. 9, 2005, no. 2005-301437, filed on Oct. 17, 2004, and no. 2005-301441, filed on Oct. 17, 2004, the content of which is hereby incorporated by reference into this application.

BACKGROUND OF THE INVETION

1. Field of the Invention

The present invention relates to an air port(overfiring air port) for combustion, a method for manufacturing the air port, a boiler, a boiler facility, a method for operating boiler facility and a method for improving the boiler facility.

2. Description of the Prior Art

In a combustion furnace such as a boiler and the like, it has been required to decrease a concentration of nitrogen oxides (NOX) and to reduce unburned matter or the like. A two-stage combustion process has been applied to meet these requirements.

The two-stage combustion process is a combustion process where an incomplete combustion region (fuel-rich region) less than a stoichiometric ratio (a stoichiometric air requirement) is formed in a combustion furnace by a burner; and air making up for combustion-shortage is supplied to an inflammable gas in the incomplete combustion region by overfiring air ports (combustion air port used in a two-stage combustion). The air ports a rearranged downstream from the burner. This combustion process can curb a generation of a high temperature combustion region caused by an excess of oxygen (rich oxygen) and can reduce NOx formation. The stoichiometric ratio means that a ratio between an amount of air supplied by the burner and a stoichiometric air requirement for the complete combustion is 1:1.

In the two-stage combustion, in order to reduce the unburned matter, the promotion of mixing of the inflammable gas in the incomplete combustion region formed by the burner and air supplied from the air port is desired.

In order to satisfy such a requirement, Patent Document 1 (Japanese Patent Laid-Open No. 2001-355832) discloses that an air port is provided with a guide sleeve having a baffle. The baffle sets an injecting direction of air from the air port so as to form a straight flow of air (a primary air) in parallel with a center line of the air port and a divergent spreading flow of air (a secondary air) around the primary air are formed. According to this process, since an injection flow is spread entirely, a mixing of the inflammable gas and air in the furnace is promoted.

Patent Document 2 (Japanese Patent Laid-Open No. H10 (1998)-122546) discloses an air port for injecting air with contraction flow so as to make a deeper penetration of the injected air into the furnace. Additionally, this process prevents from generating of a clinker and ashes.

In these processes, the direction of the air jet stream from the air port is fixed.

[Patent Document 1] Japanese Patent Laid-Open No. 2001-355832 (Claims and FIG. 2)

[Patent Document 2] Japanese Patent Laid-Open No. H10 (1998)-122546 (Claims and FIG. 1)

A positional relationship between the incomplete combustion region formed in the furnace and the air port used as the overfiring air port in the two-stage combustion process is variously set in response to a form of the furnace. Accordingly, it is desired that an air injecting direction of the air port can be optionally adjusted in correspondence with the position of the incomplete combustion region.

In accordance with the boiler facility described in the aforesaid Patent Document No. 1, it is possible to reduce a concentration of fuel NOx and a concentration thermal NOX. However, in some kind of fuel, a concentration of carbon monoxide (hereinafter called as CO) in the combustion gas may increase. The Patent Document 1 has not described means and method for reducing the concentration of CO and for reducing concentrations of NOx and CO with better balance.

SUMMARY OF THE INVENTION

In order to respond to the aforesaid requirement, a first object of the present invention is to provide a mechanism which can increase a mixing efficiency of inflammable gas in the incomplete combustion region and air injected from the overfiring air port (after-air nozzle) by changing either a direction or state of air injected from the overfiring air port in response to the position of the incomplete combustion region of two-stage combustion process.

In addition, the present invention also provides a mechanism capable of reducing an adhesion of clinker (ash) at the air port and reducing an increased temperature of the air port.

A second object of the present invention is to provide a boiler facility capable of attaining a well-balanced reduction of a concentration of NOx and a concentration of CO.

SUMMARY OF THE INVENTION

A basic configuration for accomplishing the first object of the present invention is as follows. A overfiring air port of the present invention is to supply an incomplete combustion region with air making up for combustion-shortage, in a furnace in which the incomplete combustion region less than stoichiometric ratio is formed by a burner. Furthermore, the airport is characterized by comprising: a nozzle mechanism for injecting air including an axial velocity component of an air flow and a radial velocity component directed to a center line of the air port; and a control mechanism for controlling a ratio of these velocity components.

The nozzle mechanism, for example, comprises a first nozzle for injecting air straightly in an axial direction of the airport, a second nozzle for injecting air with a swirling flow in an axial direction of the air port, and a third nozzle for injecting air directed from outside the first nozzle toward a center line of the air port. In this specification, the aforementioned straight air is also called as a primary air, the swirling flow is also called as a secondary air, and air directed from outside the first nozzle toward a center line of the air port is also called as a tertiary air.

In addition, the velocity component-ratio control mechanism is configured by a mechanism for controlling a flow rate ratio of airs injected by the first, second and third nozzles.

In this specification, the aforementioned first nozzle is also called as a primary nozzle, the second nozzle is also called as a secondary nozzle, and the third nozzle is also called a tertiary nozzle.

The air port in the present invention is also applied as an air port not only for supplying air but also for supplying air mixed with either flue gases or water.

A basic configuration of a boiler facility for accomplishing the second object of the present invention is as follows. The boiler facility is comprised of: a burner for supplying fuel and air in a combustion furnace to burn them; and an after-air nozzle arranged downstream from the burner, and including a straight-forward air nozzle for injecting straight-forward air into the furnace, a swirling air nozzle for injecting air with a swirling flow into the furnace and a contraction air nozzle for injecting air with contraction flow into the furnace. Furthermore, the boiler facility is characterized by comprising: concentration measuring means for measuring a concentration of NOx and a concentration of CO in the furnace; and a flow rate controlling means for controlling air flow rates supplied from the swirling air nozzle and the contraction air nozzle in response to measurements of the concentration measuring means.

As described above, it is possible to reduce of a concentration of NOx or CO by controlling a supply amount of air with the swirling flow and air with the contraction flow in reference to a result of the measurement of the concentration of NOx or the concentration of CO in the furnace.

The air port for accomplishing the first object is suitable as an overfiring air port of two-stage combustion system and is suitable for reducing unburned fuel. In particular, the unburned fuel can be efficiently reduced, irrespective of a state of the combustion space, by injecting the combustion promoting air from the overfiring air port toward the incomplete combustion region (a place where much amount of inflammable gas is collected) along with the air flow corresponding to position of the incomplete combustion region.

In addition, in accordance with the boiler facility for accomplishing the second object, a well-balanced reduction of a concentration of NOx and a concentration of CO can be realized.

DETAILED DESCRIPTION OF THE INVENTION

Referring now to the figures, the air port of the present invention and the method for using it will be described.

Figure 1:
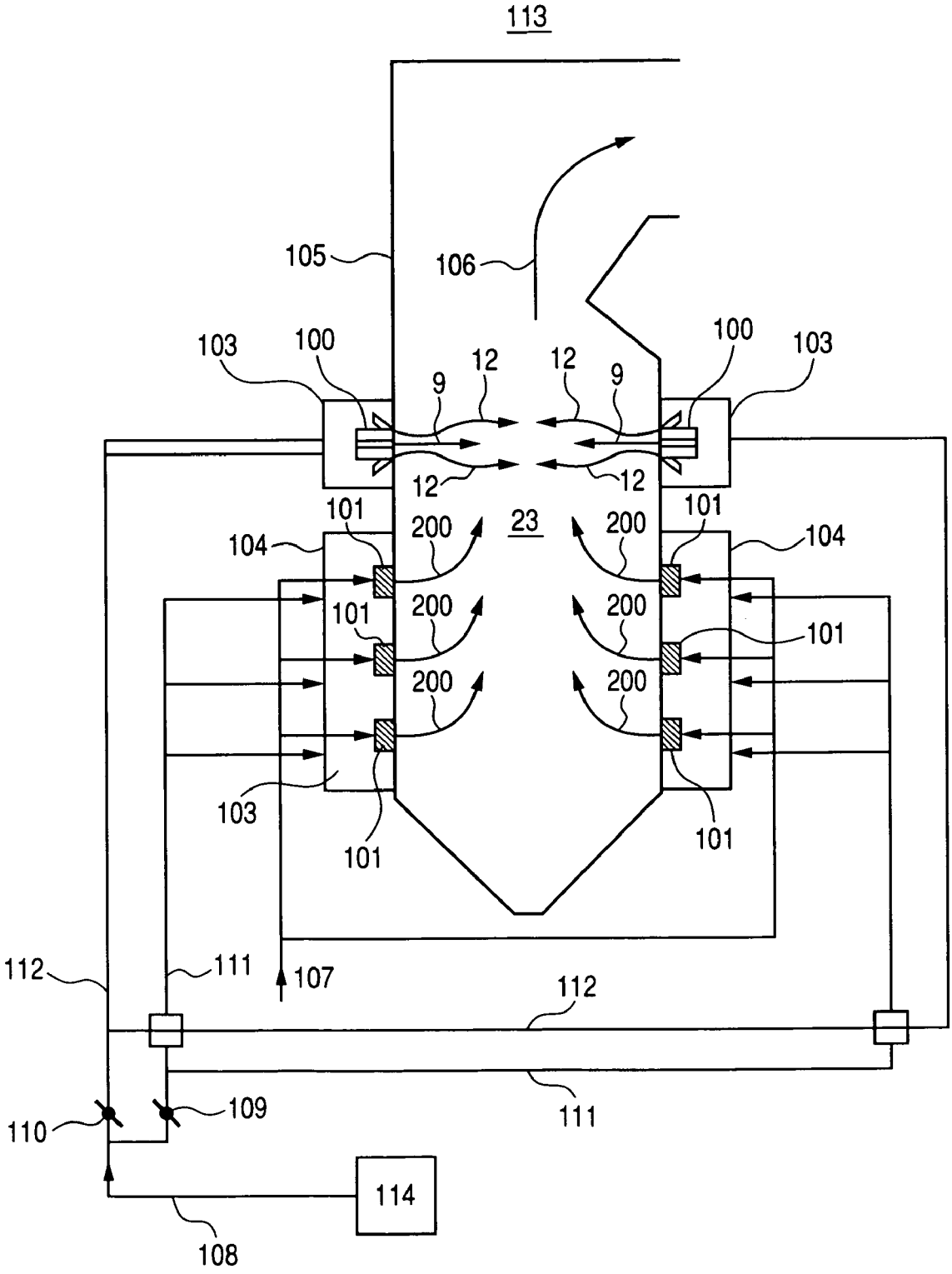
FIG. 1 is a view for showing an entire structure of a two-stage combustion type boiler to be applied by the present invention.

Referring to FIG. 1, the boiler of two stage-combustion process using the air port will be described as follows.

FIG. 1 shows an entire structure of the boiler.

In a boiler furnace 113, a plurality of burners 101 are arranged on opposite sides of a combustion space at the lower portion of a furnace wall. A plurality of air ports 100 are arranged on opposite sides of a combustion space at the furnace wall above the burner installing locations. The burners 101 inject air-fuel mixture less than a stoichiometric ratio (for example, 0.8) into a flame region in the furnace to form an incomplete combustion region. The air ports 100 supply air for making up for combustion-shortage to the inflammable gas of the incomplete region to promote combustion.

Fuel for the burners 101 is coal, oil and gas or the like. An entire amount of air for combustion is managed by an air supplying system, and the amount of air is shared to the burners 101 and the air ports 100. More practically, the air supplied from a blower 114 passes through an air supply line 108, and is branched into an air supplying line 112 for the air ports and an air supplying line 111 for the burners. And then the air is guided to window boxes 103 for the air ports 100 and window boxes 104 for the burners 101. A sharing of air flow rates is controlled by a damper 110 for the air ports and a damper 109 for the burners. Outputs of the blowers 104 are controlled so that the entire air flow rate satisfies a specified a concentration of oxygen in the flue gases.

Burners 110 are supplied with air less than a stoichiometoric ratio through the air supply line 111 and supplied with fuel through a fuel supply line 107. When coal is supplied as fuel, coal is transferred with air flow. Since, in the air-fuel mixture injected from the burners 101 into the furnace (combustion space) 23, the air is less than an amount of air required for complete combustion, the air-fuel mixture burns on incomplete combustion, and then the mixture gas can be reduced at this time. When such an incomplete combustion is produced, flows of inflammable gas 200 are formed at the downstream side of the burners.

Air which is sent into the window boxes 103 of the air ports 100 through the air supply lines 112, is shared into a primary nozzle (a first nozzle), a secondary nozzle (a second nozzle) and a tertiary nozzle (a third nozzle) for each air port 100 to be described later and then supplied to the flow 200 of inflammable gas (the incomplete combustion region) in the furnace 23. The air is mixed with the inflammable gas flow 200 and completely burned and becomes combustion gas 106 and flows to the outlet.

Reference numeral 105 denotes a boiler water pipe (furnace water-wall) arranged at the wall surface of the boiler.

A preferred embodiment of the air ports applied to the aforesaid boiler will be described in reference to the following preferred embodiment.

Preferred Embodiment 1-1

Figure 2:
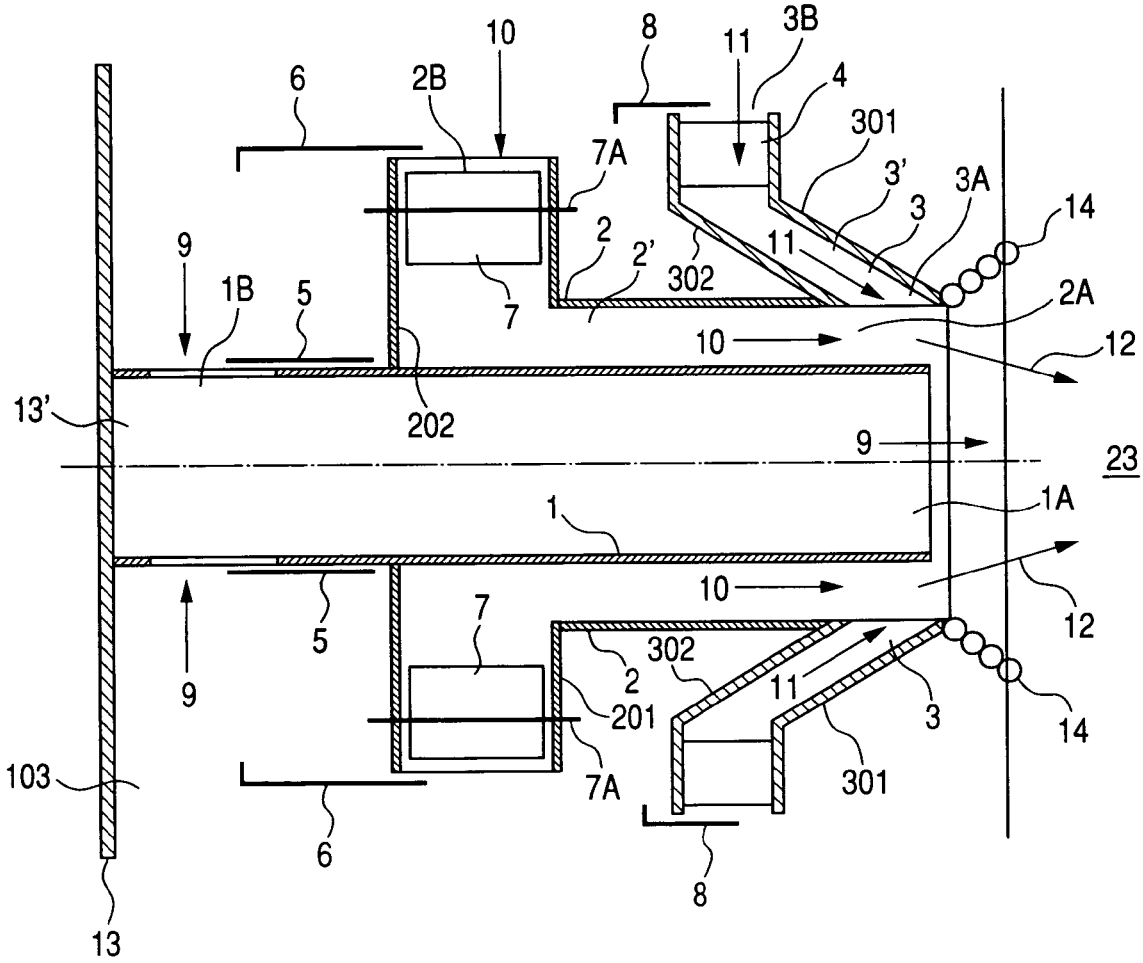
FIG. 2 is a sectional view (taken along line A-A of FIG. 4) for showing a preferred embodiment 1-1 of the air port of the present invention.
Figure 3:
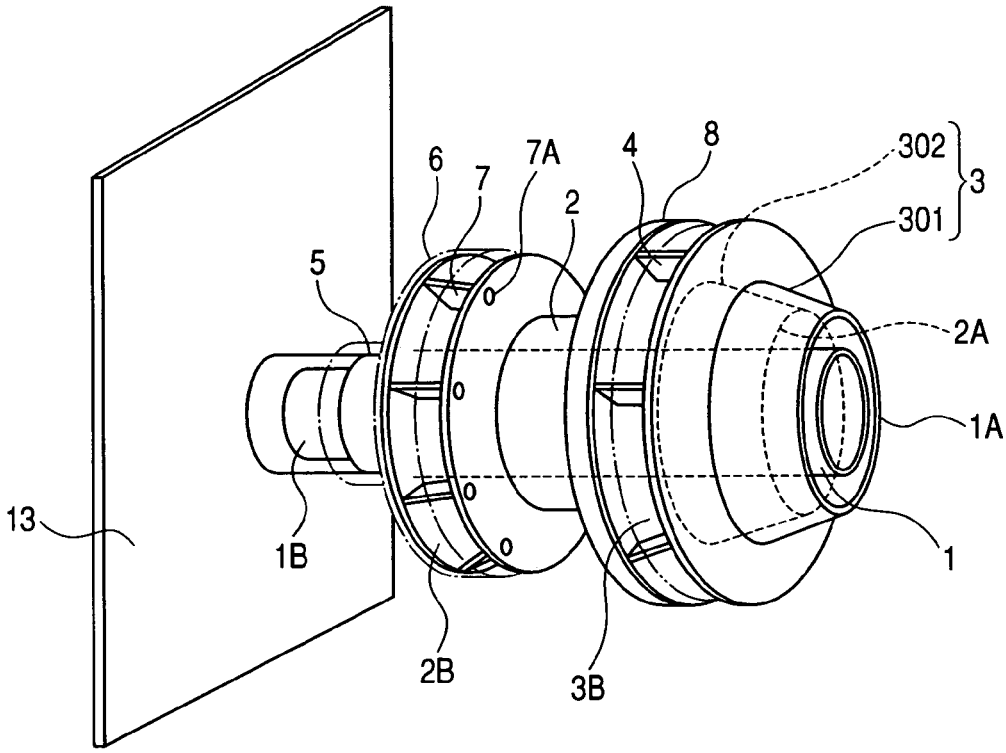
FIG. 3 is a perspective view for showing the air port with a part being eliminated.
Figure 4:
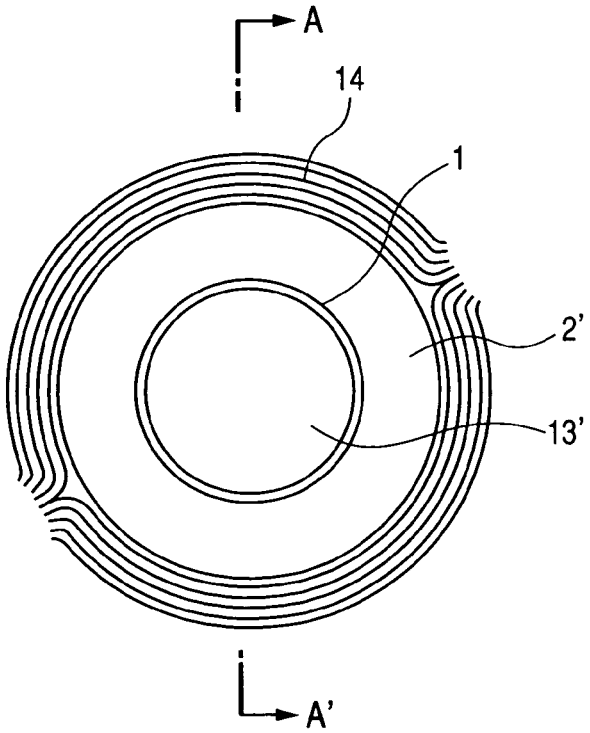
FIG. 4 is a view for showing an air port being viewed from inside the furnace.
Figure 5:
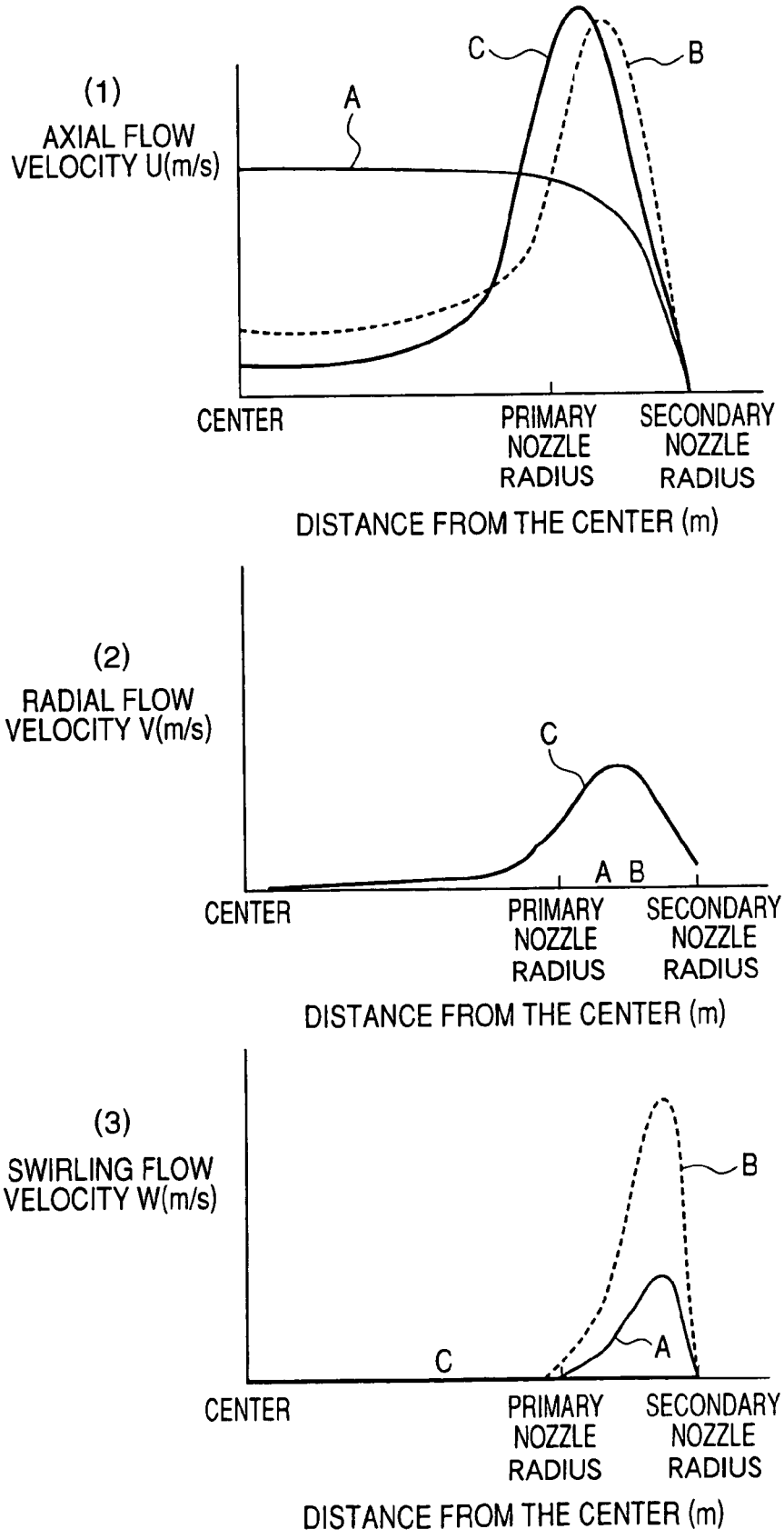
FIG. 5 is a view for showing a flow velocity distribution at the outlet of the air port.
Figure 6:
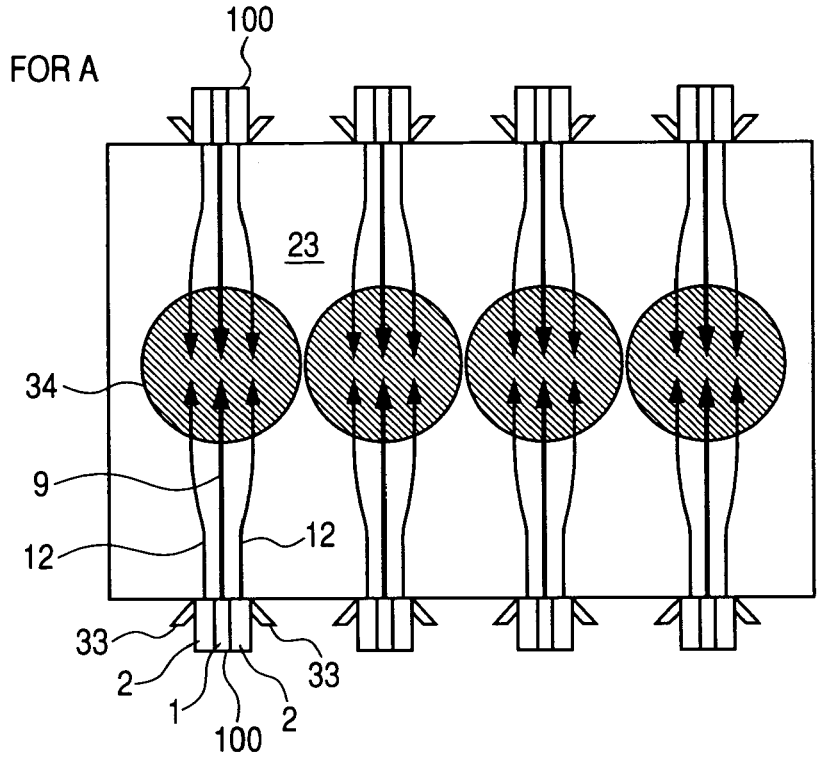
FIG. 6 is a schematic view for showing a relation between an air flowing state and the incomplete combustion region in the furnace.
Figure 7:
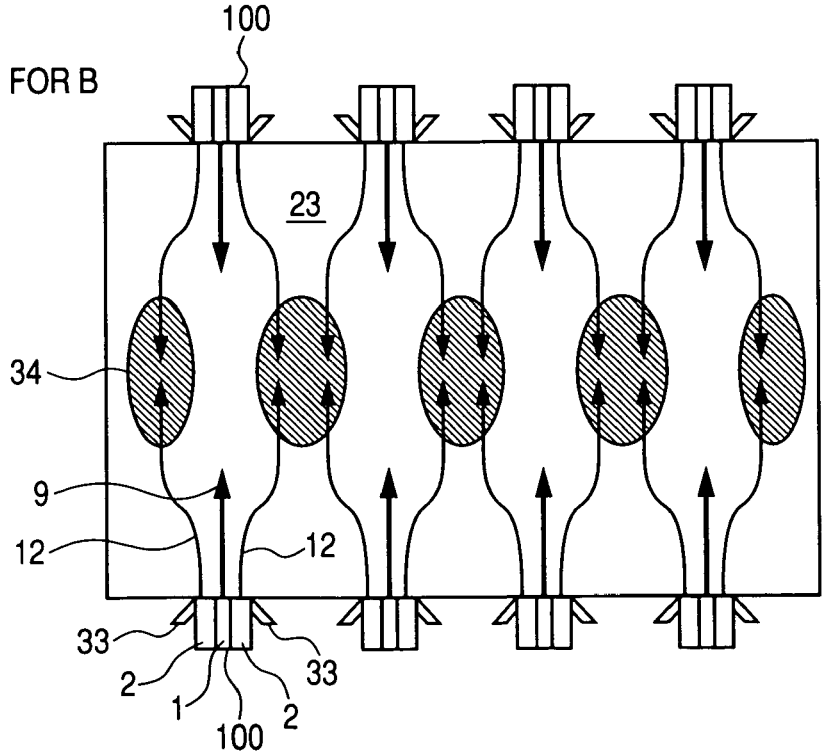
FIG. 7 is a schematic view for showing a relation between an air flowing state and the incomplete combustion region in the furnace.
Figure 8:
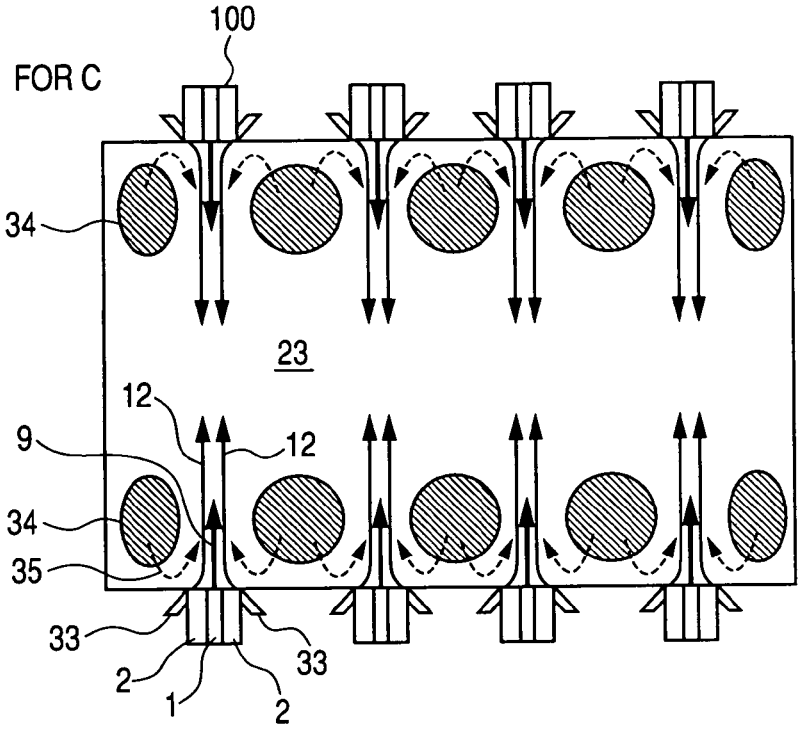
FIG. 8 is a schematic view for showing a relation between an air flowing state and the incomplete combustion region in the furnace.

FIG. 2 is a sectional view (taken along a line A-A' in FIG. 4) showing the preferred embodiment 1 of the air port in accordance with this invention. FIG. 3 is a perspective view with a part being illuminated. FIG. 4 is a view for showing the air port viewed from inside the furnace. FIG. 5 is a view for showing an air flow velocity at the outlet of the air port. FIGS. 6, 7 and 8 are schematic views for showing a relationship between the air flowing state in the furnace 23 and the incomplete combustion region (i.e. a location where much amount of inflammable gas is found).

The air ports 100 are arranged in the window boxes 103. Air nozzle mechanisms for the air ports have a primary nozzle 1, a secondary nozzle 2 for injecting a swirling flow air along an outer wall surface of the primary nozzle as secondary air, and a tertiary nozzle 3 for injecting the flow of air directed from outside the primary nozzle 1 toward the center line of the air port as the tertiary air.

The primary nozzle 1, secondary nozzle 2 and third nozzle 3 are of a coaxial nozzle structure, the primary nozzle 1 is positioned at the center, the secondary nozzle 2 is positioned outside the primary nozzle, and the third nozzle 3 is positioned further outside the secondary nozzle.

The primary nozzle 1 has a straight tubular form, its front end has an air injection port 1A, and its rear end has an air intake port 1B. A primary (a first) damper 5 controls a flow rate of the primary air by controlling an opening area of the air intake port 1B. The primary nozzle 1 injects a straight forward flow air in parallel with the center line of the air port as the primary air. The opening area of the air intake port 1B is controlled by sliding the primary damper 5 on the outer wall surface of the primary nozzle 1.

The secondary nozzle 2 has an annular air intake port 2B at its rear end, and a secondary air passage 2' having an annular section is formed between the inner wall surface of the secondary nozzle and the outer wall surface of the primary nozzle. The secondary air 10 flowing in at the air intake port 2B is applied with a swirling force by a secondary air resister (a deflector plate) 7. The secondary air is injected from a secondary nozzle outlet (a front end) 2A with the swirling flow along the outer wall of the primary nozzle 1. An opening area of the air intake port 2B of the secondary nozzle 2 can be controlled by axially sliding the annular secondary damper 6, thereby a flow rate of the secondary air is controlled. The secondary air resister 7 is provided at the secondary air intake port 2B in such a way that its deflection angle can be changed through its pivot shaft 7A. A plurality of secondary air resisters 7 are arranged in a circumferential direction of the secondary air intake port 2B. It is possible to control a swirling force of the secondary air by controlling the deflection angle of the secondary air resister 7.

The third nozzle 3 has a conical(tapered) front wall 301 and a conical rear wall 302 oppositely arranged against the front wall. A conical air flow passage 3' for the tertiary nozzle is formed between the front wall and the rear wall. The air inlet port 3B of the tertiary nozzle 3 has an annular shape, its opening area can be changed by sliding the annular third damper 8 in an axial direction of the air port, thereby the flow rate of the tertiary air is controlled. The front wall 301 and the rear wall 302 are connected through a plurality of connector plates 4 arranged at the air intake port 3B. The outlet 3A of the tertiary nozzle 3 is connected to the extremity end of the secondary nozzle 2, the tertiary air 11 and the secondary air 10 are merged as indicated by an arrow 12 and flows (is injected) into the furnace.

The secondary air 10 is injected in a direction parallel with a center line of the air port and further applied with a swirling force with the secondary air resister 7. Since the third nozzle 3 is inclined toward the center line of the air port (inward), this structure is preferable for forming a contraction flow where the tertiary air 11 is concentrated toward the center line of the air port. A direction of flow after merging of the secondary air and the third air can be controlled by changing the flow rate ratio of the secondary air 10 and the tertiary air 11.

For example, if a flow rate of the tertiary air 11 is set to 0 (a supply of the secondary air 10 is kept), an inward-directed velocity component (a radial velocity component of the air flow 12 directed toward the center of the air flow from outside) after being merged of the secondary air 10 and the tertiary air 11 may become 0. In this case, the swirling flow of the secondary air 10 is promoted. In contrast to this, if the flow rate of the secondary air 10 is set to 0 (a supply of the tertiary air 11 is kept), the inward-directed velocity component of the air 12 is increased by injecting of only the tertiary air 11, the air 12 is injected in a direction of the tertiary nozzle (inward direction). According to such a control of those velocity components of the air flow, the direction of air jet from the airport can be controlled in response to a position of the unburned gas region (incomplete combustion region). Accordingly, the unburned gases of air-shortage being localized in the furnace and the air can be preferably mixed to each other, and the amount of unburned fuel is reduced. In addition, their mixed state can also be controlled by controlling an intensity of the swirled secondary air.

A primary damper 5, a secondary damper 6 and a third damper 8 are used for controlling a ratio of the primary, secondary and third air flow rates at the air ports.

FIG. 5 shows a distribution of flow velocity of air at the outlets of the air ports in the preferred embodiment.

FIG. 5(1) shows an axial flow velocity (a velocity component) of the air flow 12 injected from the air port. FIG. 5(2) shows a flow velocity (a velocity component) directed toward the center of the air flow 12, wherein this is defined as a center-directed flow velocity. FIG. 5(3) shows a flow velocity (a velocity component) in a swirling direction of the air flow 12, wherein this is defined as a swirling flow velocity. Each of the flow velocities is indicated at a vertical axis of each of FIGS. 5(1) to (3), and a distance from the center of the air port to its outer radius is indicated at a horizontal axis. The horizontal axis shows positions of the primary nozzle radius and the secondary nozzle radius.

In FIGS. 5(1) to (3), a solid line A indicates a case in which the primary air and the secondary air are used, and the tertiary air is not used. In addition, a swirling intensity set by the secondary air resister is also set small. In this case, the air flow 12 has entirely a strong straight forward component (an axial flow velocity), and the air flow of the straight forward component is substantially uniformly distributed from the center of the air port 12 toward its outer radius direction.

Such air as above injects straightly from the air port as shown in FIG. 6 and reaches up to the center of the furnace 23 (combustion space) 23. Accordingly, when there are present much amount of flow of inflammable gas (incomplete combustion region) 34 between the opposing air ports at the center of the furnace 23, as shown in FIG. 6, air from the air port 12 can be efficiently supplied to the region.

In FIGS. 5(1) to (3), a broken line B indicates a case in which the tertiary air is not used, a flow rate of the primary air is decreased and a flow rate of the secondary air is increased. In addition, since the air swirling force attained by the secondary air resister 7 is set to be strong, a straight forward component of the air flow 12 is small and the swirling force (a swirling flow velocity) of the air flow 12 is large. In this case, as shown in FIG. 5(3), the swirling flow velocity is concentrated near the outlet radius of the secondary nozzle. In addition, in this case, an area having a fast flow velocity in the axial flow velocity is concentrated between the primary nozzle outlet and the secondary nozzle outlet, as shown in FIG. 5(1). In such a case as above, as shown in FIG. 7, a spread-air jet flow is formed. Accordingly, as shown in FIG. 7, air can be efficiently supplied to a location near the central part in the furnace 23. Since this air-supplied location laterally deviates from the line connecting the opposing air ports 100, if rich-inflammable gas area (incomplete combustion region) 34 presents in this air-supplied location, air making up for air-shortage is efficiency supplied to rich-inflammable gas area.

In FIGS. 5(1) to (3), a solid line C indicates a case in which flow rates of the primary air and the secondary air are decreased and a flow rate of tertiary air is increased. In place of no swirling speed in this case, the center-directed flow velocity (an inward velocity component) is increased. Accordingly, it is possible to catch the surrounding gases into the downstream side of the air port 100 with gas entrainment by air jet stream. In such a case as above, when the incomplete combustion region 34 is present between the adjoining air ports 100 and near the furnace wall as shown in FIG. 8, it is possible to catch the inflammable gas into the air flow from the air ports with the gas entrainment. With this arrangement as above, mixing of the inflammable gas and the air is promoted. It is necessary for the tertiary air 11 to be injected with an inward directed angle suitable for entraining the inflammable gas. Such an inward directed angle is satisfactory for a range from 20° to 45°. If inward directed angle is too small, the gas entrainment force is decreased, and no gas entrainment-effect can be obtain. If inward directed angle is too large, turbulence is increased and then the flow 12 of both the secondary air and the tertiary air after being merged can not be formed in a stable manner.

The location where much amount of inflammable gas is present is made different in reference to a fuel ratio for coal, coal particle radius, air ratio of a burner, a burner type and a furnace shape. In addition, a distribution of the rich inflammable gas area is different depending on a central area and its outside area in the furnace. As indicated by A, B and C in FIGS. 5(1) to (3), if a ratio of the air flowing direction (a velocity component) can be controlled, a low unburned fuel state can always be kept in the furnace, even if the location showing much amount of inflammable gas is varied.

If the ratio of flow rates of the primary air, secondary air and tertiary air are changed, there occurs sometimes that a location where no air locally flows in the furnace is formed. Such a location as above can be assumed that its temperature is increased due to a radiation thermal transfer from the combustion space. Due to this fact, it is satisfactory that the member for the air port at such a location is made of a material capable of resisting high temperature. For example, when the primary air and secondary air are less in their amounts, a temperature at the extremity of the primary nozzle 1 becomes high. In view of this fact, material capable of resisting high temperature is used for the extremity part. In addition, if the primary nozzle 1 is near the combustion space 23, a view angle seeing the flame becomes wide, and a radiate intensity becomes strong. In this case, the length of the extremity of the primary nozzle may be made shorter than that of other nozzles.

Some fuel such as coal and heavy oil contain ash therein. In this case, if the air flow 12 is in a so-called contraction flow by increasing the flow rate of the tertiary air concentrating toward the center, the ash melted in the combustion gas of high temperature is sometimes adhered in vicinity of water pipes 14 at the air port outlets. When adhesion of the ash is grown to form a clinker, the air flow may be interfered, and the water pipes may be damaged by dropping of the clinker. In such a case as above, if the flow rate of the tertiary air is reduced but the flow rate of the secondary air is increased before the clinker become large, a temperature of the clinker is reduced. There by a thermal stress is generated in the clinker, and it is peeled off. Whether or not the clinker is grown is checked with a sensor, and if the clinker is grown, the flow rate of the secondary air may be increased automatically. As such a sensor, an optical sensor may be used. For example, the optical senses change of a field of view which changes as the clinker is grown, thereby the growth of the clinker can be recognized.

Incidentally, conventional air ports are constituted only by the primary nozzle 1 and the secondary nozzle 2, wherein a ratio of flow rates of the primary nozzle 1 and the secondary nozzle 2 are fixed.

It is possible to realize methods for improving or modifying the existing air port product into the air port of the present invention. Three examples of method for manufacturing the air port accompanying with such a modification will be described as follows.

That is to say, (1) The extremity of the secondary nozzle 2 of the already-existing air port product is cut out. Then, a new tertiary nozzle which has already been made is welded to the cutting part of the secondary nozzle 2.

(2) The secondary nozzle of the already-existing product is removed. After removing the secondary nozzle, an intermediate product having a new secondary nozzle and a new tertiary third nozzle integrated to each other used in the present invention are welded to the primary nozzle of the already-existing air port product; or (3) All the nozzles in the already-existing air ports are removed and a new primary nozzle, secondary nozzle and tertiary nozzle are welded to each other, and they are welded to the wall surface of the window box.

Preferred Embodiment 1-2

Figure 9:
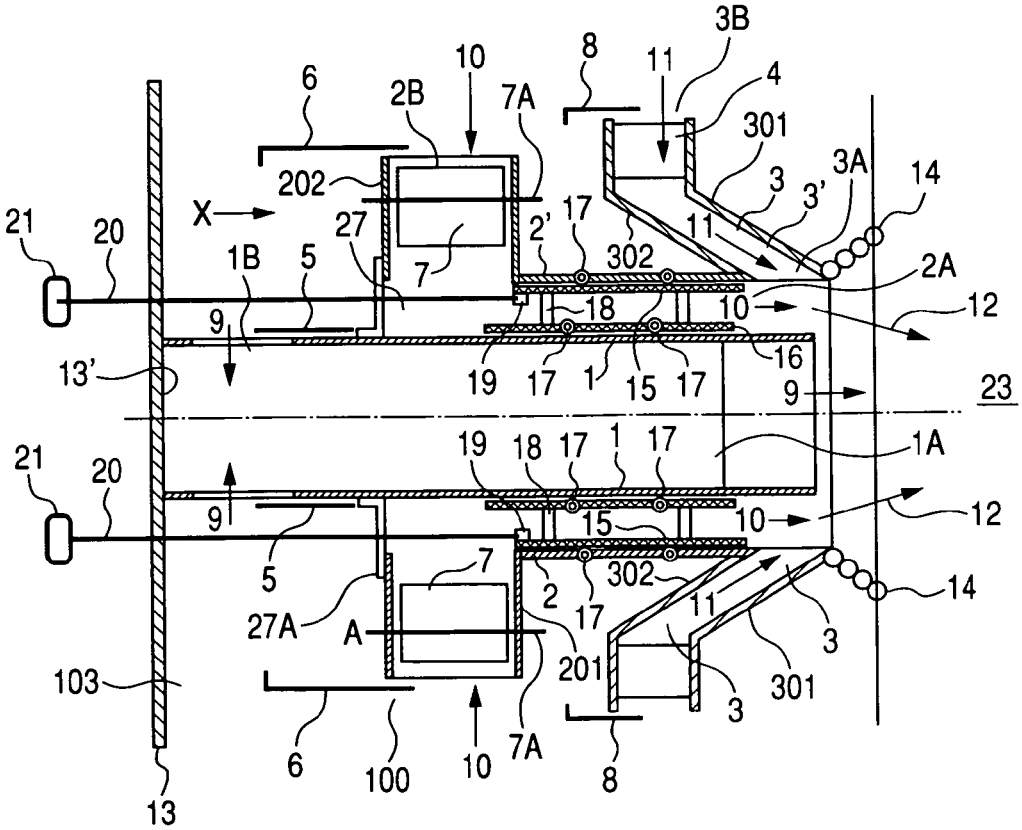
FIG. 9 is a sectional view for showing a preferred embodiment 1-2 of this invention.

FIG. 9 is a sectional view for showing the preferred embodiment 1-2 of the air port 100 of this invention.

The features of this embodiment differing from those of the preferred embodiment 1-1 are as follows. A sleeve 15 movable axially by an operation of an external handle 21 is arranged between the outer wall surface of the primary nozzle 1 and the inner wall surface of the secondary nozzle 2. In addition, another movable sleeve 16 is provided so that it can be moved in integral with the movable sleeve 15. That is, a double sleeve structure is constituted with the movable sleeves 15 and 16.

The movable sleeves 15, 16 are connected to each other through connecting members 18 and can be moved axially with guide rollers 17. The movable sleeve 15 is movable axially on the inner wall surface of the secondary nozzle 2. The inner wall surface of the secondary nozzle 2 acts as a guide for the sleeve 15. The movable sleeve 16 is movable axially on the outer wall surface of primary nozzle 1. The outer wall surface of the first nozzle 1 acts as a guide for the sleeve 16.

The movable sleeve 15 becomes a part of the wall surface of the secondary nozzle 2, and the movable sleeve 16 becomes a part of the wall surface of the primary nozzle 1, so that they have a function for adjusting a length of the nozzle and so they are sometimes referred as a nozzle adjuster. The guide rollers 17 are arranged at anyone of the movable sleeves (movable nozzles) 15, 16 or primary nozzle 1, secondary nozzle 2 to make the movable sleeves move smoothly.

When a flow rate of tertiary air 11 is increased through the third damper 8, for example, the movable nozzle 15 is moved to a position shown in FIG. 9 (a position where an outlet area of the tertiary nozzle 3 is increased).

If a flow rate of the tertiary air 11 is reduced by controlling the third damper 8, and a flow rate of the secondary air is increased (intake port 2B is opened) by controlling the secondary damper 6, and an amount of secondary air 10 is increased, and a swirling force set with the secondary resister 7 becomes large, there is a possibility for a part of air flow from the secondary nozzle to enter the duct of the tertiary nozzle 3. In addition, there is a possibility for swirling flow to not be maintained in a stable manner. In this case, in order to meet such disadvantages, the outlet 3A of the tertiary nozzle is set to be closed with the movable nozzle 15 by moving the movable nozzle 15 to the inner side of the furnace. That is, a flow passage sectional area of the tertiary nozzle is decreased. In this case, when the flow rate of tertiary air is zero, the outlet 3A of the tertiary nozzle is completely closed. When the flow rate of the tertiary air is less, almost of the third nozzle outlet 3A is closed, and a state in which the outlet 3A is slightly opened is kept.

When the air port is set in the state shown in FIG. 9, i.e. when much amount of the tertiary air is kept, and less amount of the primary air and the secondary air is kept, there is a possibility that a temperature at the extremity of the primary nozzle 1 is increased. Due to this fact, a length of the primary nozzle is set shorter as compared with that of the preferred embodiment 1-1. In this case, unless any special arrangement is applied, when the tertiary air 11 is not flow, there is a possibility that the primary air and the secondary air are mixed to each other within the air ports. However, according to the present invention, since the movable sleeve (the nozzle control member) 16 is moved to a location near the outlet of the air port, the sleeve 16 acts as an extended wall surface of the primary nozzle. Thus, it enables the primary air and the secondary air to be prevented from being mixed to each other within the air ports.

In order to operate the nozzle control members 15, 16 from outside the window box (outer wall 13), an operation handle 21 is connected to one of the nozzle control members through a rod 20. Any only one of the nozzle control members 15, 16 may be employed as required.

Since the movable sleeves (movable nozzles) 15, 16 are moved to a location near the combustion space, their temperature are easily increased. Therefore, there is a possibility for the movable sleeves to occur deformation or fire damage. In this embodiment, in order to meet such a problem, an outlet 27 for used in demounting-mounting (replacement) of the movable sleeves is provided at a rear wall 202 of the secondary nozzle 2. The movable sleeve 15, 16 can be pulled out through the outlet 27. The outlet 27 is usually closed with a blind plate 27A except the replacement of the movable sleeve. When the primary damper 5 becomes a hindrance during the replacement work, the damper 5 may be removed.

Figure 10:
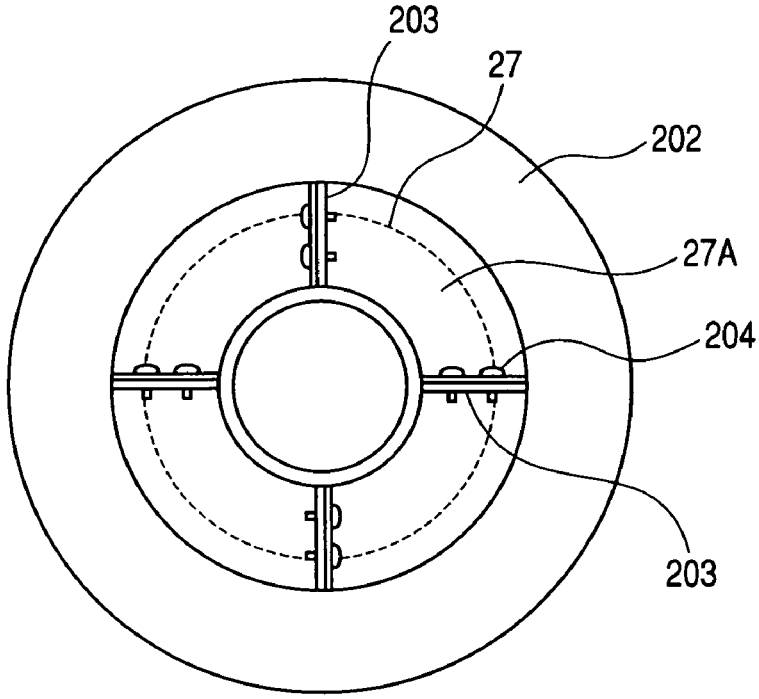
FIG. 10 is a view for showing a rear wall and a blind plate at the secondary nozzle as seen from a direction X in FIG. 9.

FIG. 10 is a view for showing the rear wall 202 of the secondary nozzle 2 and the blind plate 27 from a direction X in FIG. 9. As shown in this figure, the blind plate 27A is an annular shape, it is divided into a plurality of segments (four divided segments, for example) in its circumferential direction. In each of the divided segments of the blind plate 27A, its both circumferential ends 203 is turned-up vertically on the plane of the plate, one end 203 thereof is adjoined to the other end 203 of its adjoining divided segment with alignment, and the adjoining divided segments are joined to each other with screws 204.

Figure 11:
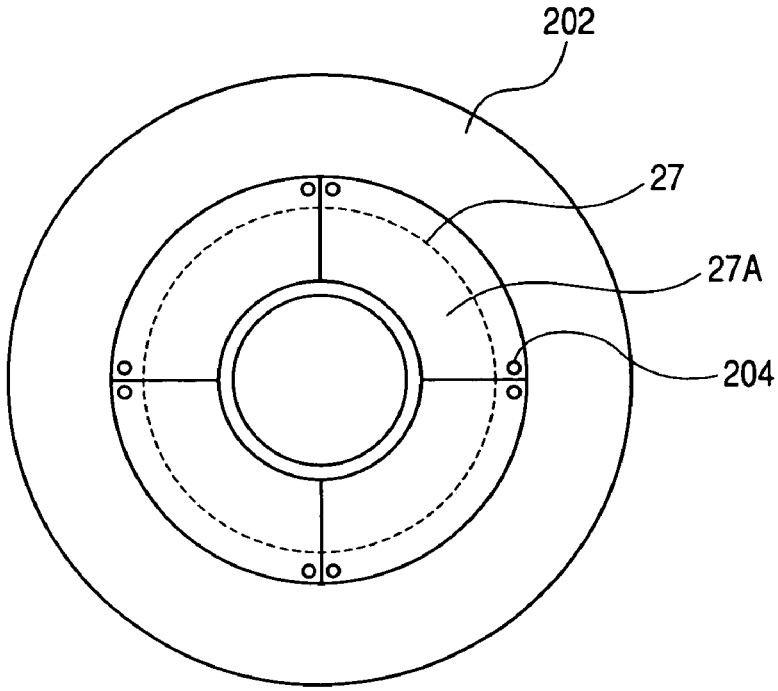
FIG. 11 is a view for showing another preferred embodiment of the blind plate.

FIG. 11 shows another preferred embodiment of the blind plate 27A. Also in this embodiment, the blind plate 27 is divided into a plurality of segments. These divided segments are directly attached to the rear wall 203 of the secondary nozzle 2 through screws 204.

Preferred Embodiment 1-3

Figure 12:
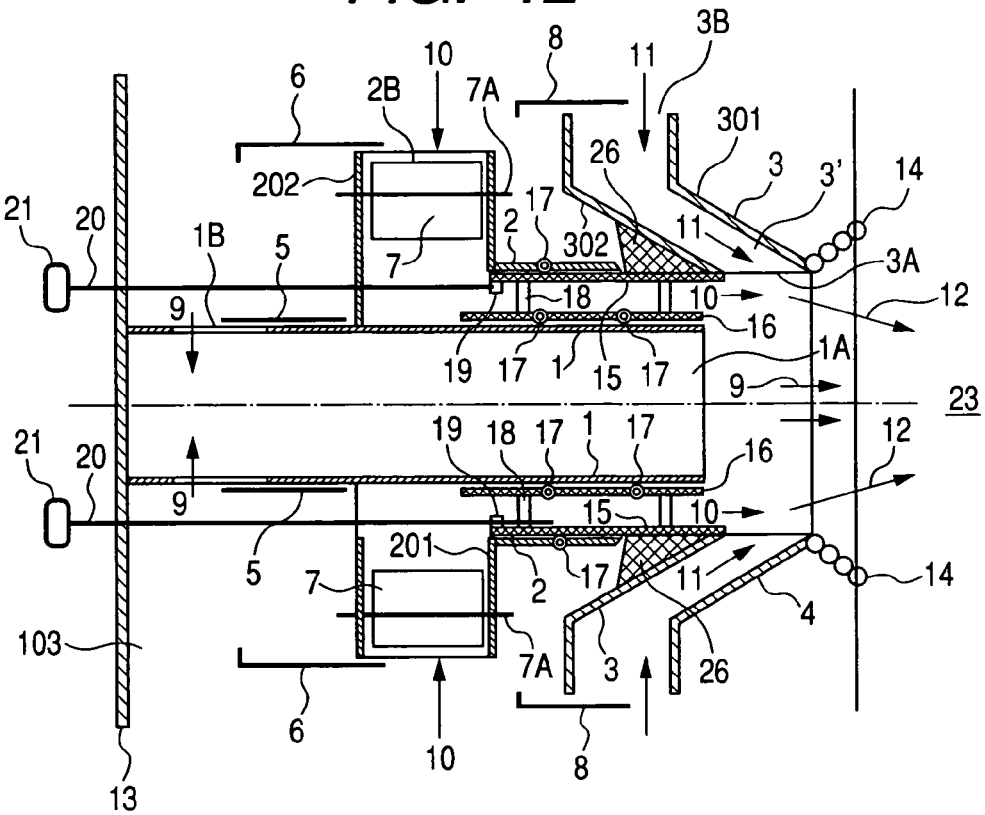
FIG. 12 is a sectional view for showing a preferred embodiment 1-3 of the air port of this invention.

FIG. 12 is a sectional view for showing a preferred embodiment 1-3 of the air port of this invention.

Also in this embodiment, although the movable sleeves (a movable nozzle: a nozzle controlling member) 15, 16 are provided in the air port, this embodiment is different from the embodiment 1-1 in view of the following points. In this embodiment, although a tapered front wall 301 and a tapered rear wall 302 are constitute the tertiary nozzle 3 as with that of the other embodiments, the rear wall is slidable axially. The opening area of the outlet 3A of the tertiary nozzle can be controlled through sliding of the rear wall 302. In this embodiment, the rear wall 302 is integrally connected to the movable sleeve 15 of the secondary nozzle 2. The rear wall 302 can also moved simultaneously through a moving operation of the movable sleeve 15. The front wall 301 is fixed and supported in the window box 13.

Also in this embodiment, when a flow rate of the tertiary air 11 is decreased (including a flow rate of 0) and a flow rate of secondary air is increased, the movable sleeve 15 is moved to a location near the furnace 23. The rear wall 302 is moved with this motion of the sleeve to narrow the outlet 3A of the tertiary nozzle. Due to this arrangement, it is possible to prevent the secondary air (swirling air) from flowing into the third nozzle 3. With such an arrangement, since there is no hindrance item for producing a disturbance of a duct 3' of the tertiary nozzle, a pressure drop can be reduced. In addition, since the tertiary air 11 always flows along the wall surface, it is possible to promote entirely a heat-transfer.

The movable sleeve 15 and the rear wall 302 of the tertiary nozzle are connected through a radial arranged heat-transfer plate 26. If any one of either the secondary air or the tertiary air flows, the movable sleeve 15 and the rear wall 302 of the tertiary nozzle are cooled. The more members 18 for connecting the movable sleeve (secondary nozzle component) 15 with the movable sleeve (primary nozzle component) 16, the heat-transfer between the movable sleeves can be improved and a temperature of the movable sleeve 16 can be also reduced.

Preferred Embodiment 1-4

Figure 13:
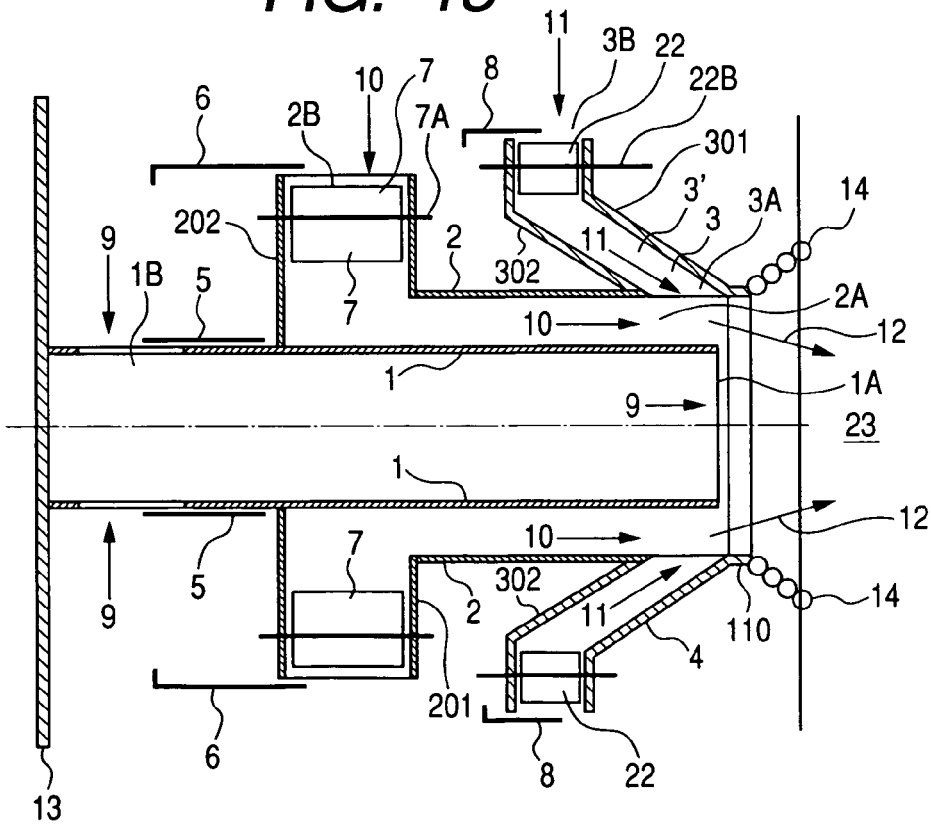
FIG. 13 is a sectional view for showing a preferred embodiment 1-4 of the air port of this invention.

FIG. 13 is a sectional view for showing the preferred embodiment 1-4 of the air port in accordance with this invention.

In this embodiment, in addition to the feature of the embodiment 1-1, the air intake-port 3B of the tertiary nozzle is provided with an air resister 22 for applying a swirling force to the tertiary air. A structure of the air resister 22 is similar to that of the secondary air resister 7 already described above, this is supported through a shaft 22B so that its deflection angle can be changed. A plurality of air resisters 22 are arranged in a circumferential direction of the air intake-port 3B.

Figure 14:
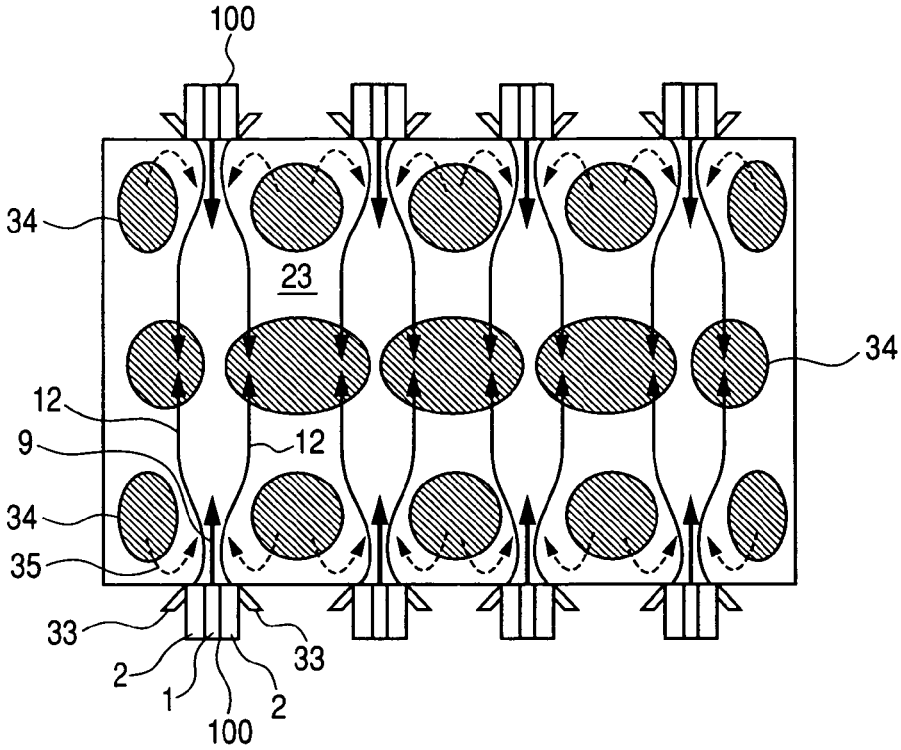
FIG. 14 is a view for showing a relation between an air injection from the air port and the incomplete combustion region in the furnace in the preferred embodiment 1-4.

As the tertiary air 11 has a contraction flow accompanying with the swirling force, the inflammable gas 34 near the air intake port 3B of the tertiary nozzle can be caught into the tertiary air flow, and the contraction flow is expanded with the swirling force. Thereby, the air 12 injected from the air port can be supplied to the inflammable gas 34 present near the central area of the furnace 23 between the air ports. This state is illustrated in FIG. 14.

A straight pipe portion 110 in parallel with an axis of the air port is formed at the outlet of the air ports 100. The straight pipe portion 110 has a function for regulating an air flow near a connected portion for the water pipes 14 at the air port outlets. If the connected portion the tertiary nozzle outer wall 301 and the water pipe 14 has a steep angle, a stress is increased at the connected part. Or another case, the flow has a rapid flow separation. In this case, the aforesaid problems can be avoided by setting this shape.

In this embodiment, angles of inclination (a tapered angle) of the front wall 301 and the rear wall 302 of the tertiary nozzle is different from each other. Thereby, a sectional area of the tertiary air intake port 3B can be larger than that of other portions of the tertiary nozzle 11. With such an arrangement as above, it is possible to reduce a pressure drop at the tertiary air nozzle, the intake port 3B can be reduced to improve a contraction flow effect.

Preferred Embodiment 1-5

Figure 15:
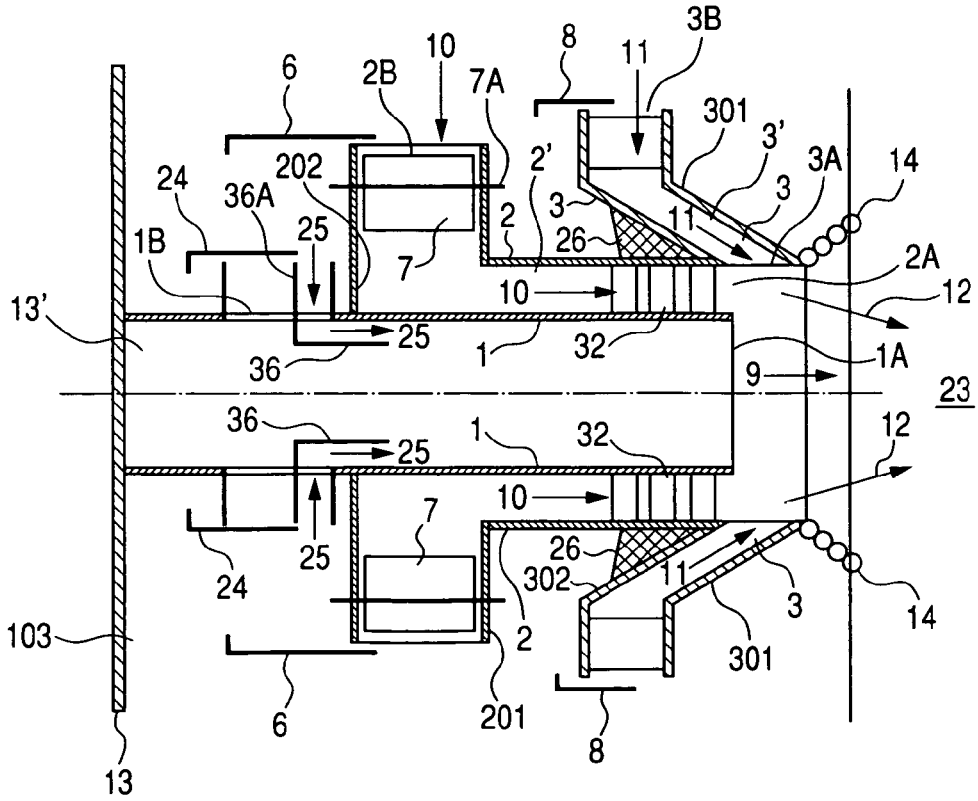
FIG. 15 is a sectional view for showing a preferred embodiment 1-5 of the air port of this invention.

FIG. 15 is a sectional view for showing the preferred embodiment 1-5 of the air port in accordance with this invention.

In this embodiment, a structure for cooling the primary nozzle 1 is added in addition to the mechanism for controlling a flow rate ratio of the primary air, secondary air and tertiary air in the same manner as that of the embodiment already described above so as to cool the primary nozzle 1.

The outer wall surface of the primary nozzle (the primary duct) 1 near the outlet and the inner wall surface of the secondary nozzle (the secondary duct) 2 are connected by a plurality of radial heat-transfer plates 32. Heat at the primary nozzle is transferred to the secondary nozzle through the heat-transfer plate 32. In addition, heat at the secondary nozzle 2 is transferred to the inner wall 301 of the tertiary nozzle 3 through the heat-transferred-plate 26.

In accordance with such a configuration as above, all the nozzles can be cooled if any one of the primary air, secondary air and tertiary air flows.

Further, in order to enable the primary nozzle 1 to be cooled even if a flow rate of the primary air is less in this embodiment, a primary cooling nozzle 36 is installed at a part of the duct of the primary nozzle. For example, the primary cooling nozzle 36 is set so that a cooling air intake port 36A is adjacent to a primary air intake port 1B. It has a duct where the cooling air flows along the inner wall of the duct at the primary nozzle 1. When the primary damper 24 is adjusted to reduce the flow rate of primary air, air flows only at the primary cooling nozzle. A small amount of air is injected at a high speed near the primary nozzle 1 to improve a cooling effect of the primary nozzle.

Preferred Embodiment 1-6

Figure 16:
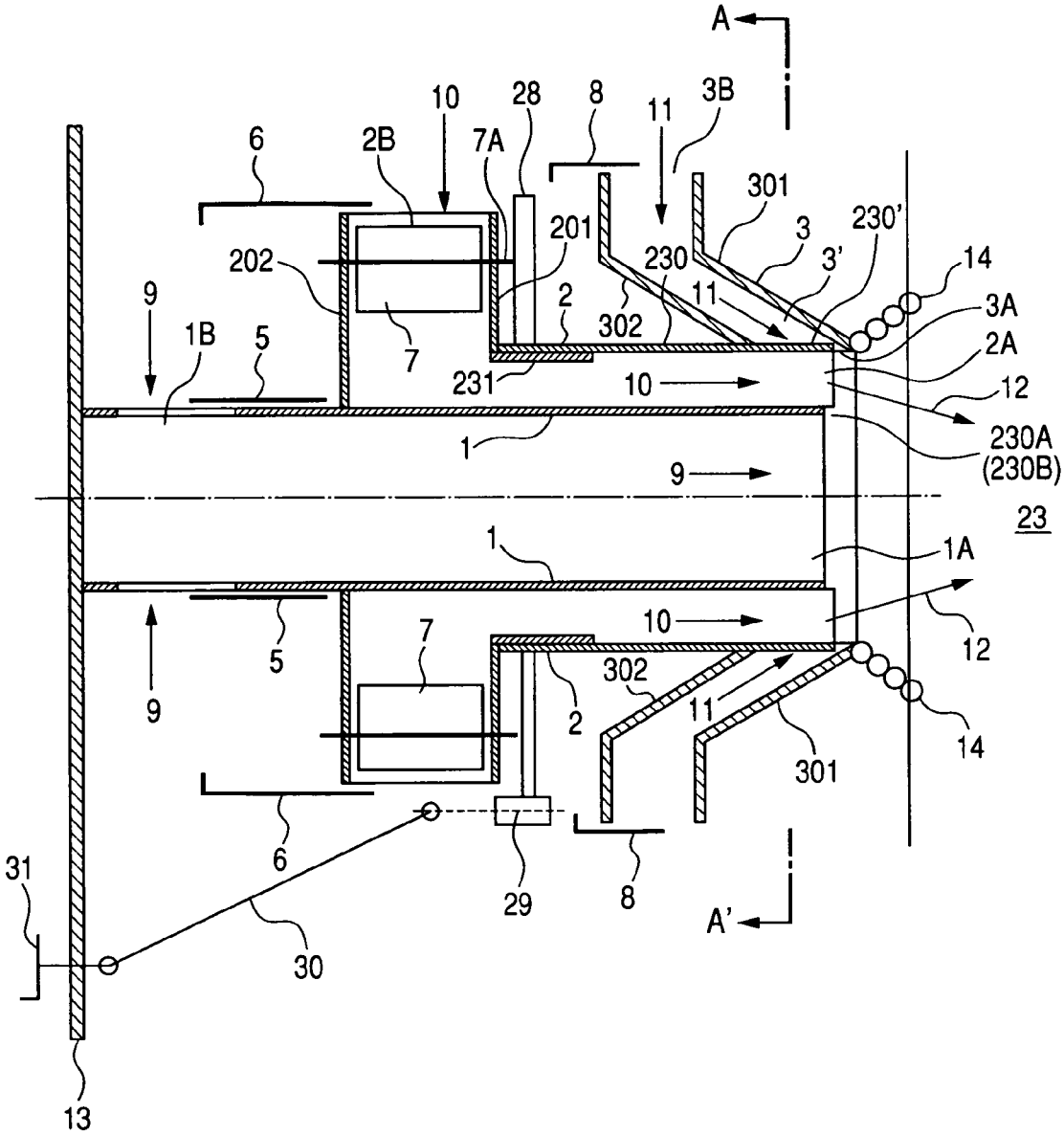
FIG. 16 is a sectional view for showing a preferred embodiment 1-6 of the air port of this invention.
Figure 17:
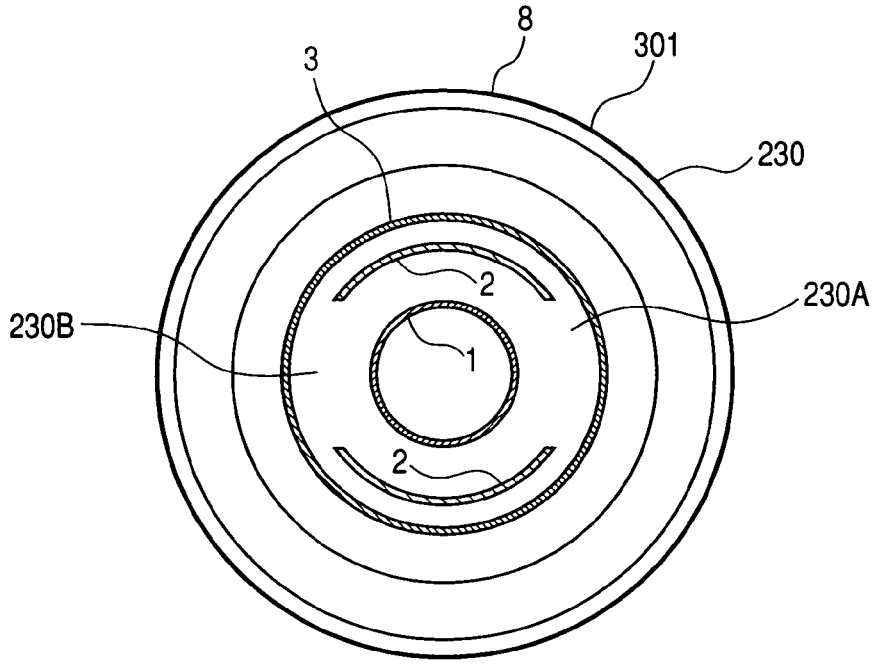
FIG. 17 is a sectional view taken along a line A-A of FIG. 16.

FIGS. 16, 17 are sectional views for showing the preferred embodiment of the air port in accordance with this invention.

In this embodiment, the duct of the secondary nozzle 2 is divided into a duct 230 at a side having the third nozzle 3 and a duct 231 at a side having an air intake port 2B, and the former duct 230 is fitted to the latter duct 231 in rotatable state in a circumferential direction of it.

The outer surface wall of the duct 230 is provided with a gear 28 as a component of the secondary nozzle rotating device, and the gear 28 is engaged with a power transmittance gear 29. When a rotating handle 31 arranged at the outer wall 13 of the window box is operated, the duct 230 is rotated around the axis through a universal joint 30, the power transmitting gear 29, and the gear 28 of the power transmittance components. The duct 230 has plural cut-outs 230A and 230B that are arranged at opposed positions with respect to the axis, at the extremity part 230' (refer to FIG. 17). The outlet 3A of the tertiary nozzle 3 is partially closed by the nozzle wall surfaces other than the cut-outs. The tertiary air 11 is injected through the cut-outs 230A, 230B. Accordingly, it is possible to change the tertiary air injecting position at the tertiary nozzle 3 by rotating the duct 230 of the secondary nozzle. In this embodiment, the duct 230 and the rear wall 302 of the tertiary nozzle are integrally connected by welding and the like. The rear wall 302 is set to be rotated together with the duct 230.

In accordance with this embodiment, it becomes possible to make only the lateral orientation of the tertiary nozzle 3 a contraction flow, and further to catch only the lateral inflammable gas into air with gas entrainment, by setting the duct 320 of the tertiary nozzle to the position shown in FIG. 17. In this case, since the inflammable gas is not caught into the tertiary air flow in a vertical direction of the tertiary nozzle, a catching (gas entrainment) energy of the tertiary air flow can be saved. Incidentally, when it is desired to catch the inflammable gas only in the vertical direction, it is satisfactory for the duct 320 to be rotated from the position shown in FIG. 17 by 90°.

Preferred Embodiment 1-7

Figure 18:
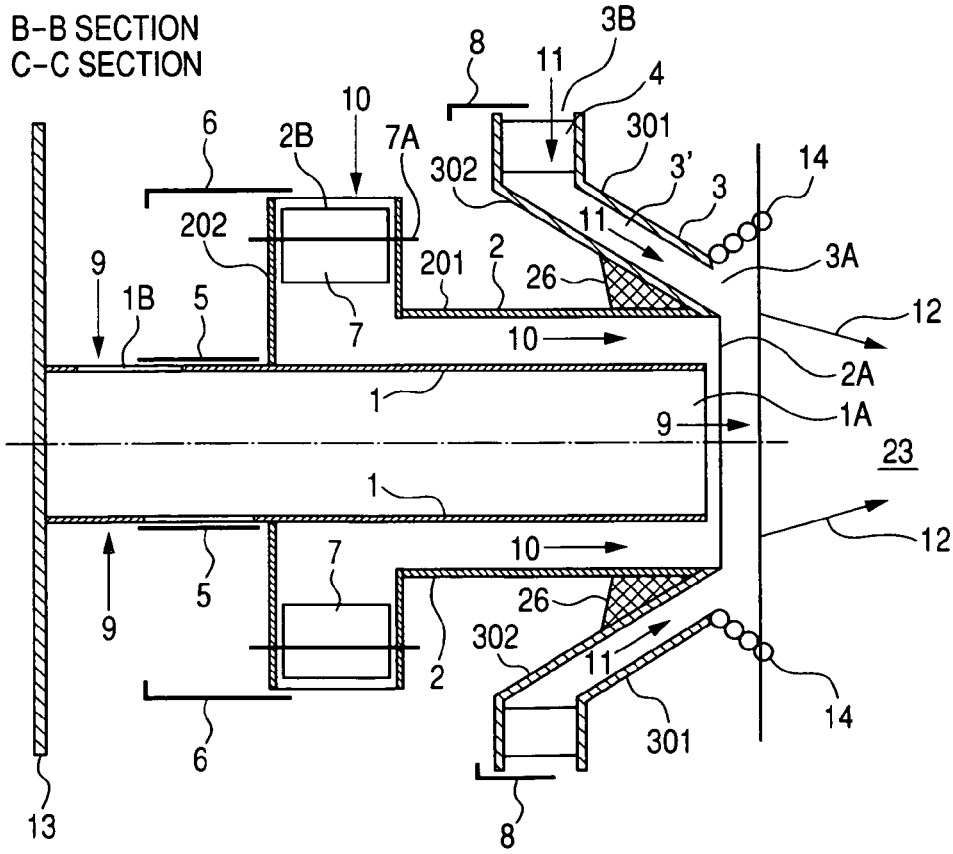
FIG. 18 is a a sectional view for showing a preferred embodiment 1-7 of the air port of this invention.
Figure 19:
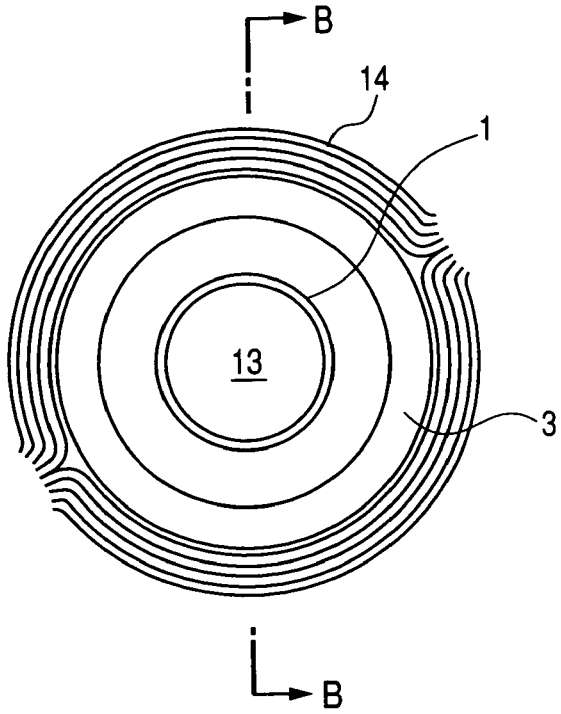
FIG. 19 is a view for showing the air port in FIG. 18 from an inside direction of the furnace.

FIG. 18 is a sectional view for showing the preferred embodiment 1-7 of the air port of this invention, and FIG. 19 is a view for showing it from inside the furnace.

In this embodiment, the different features from the aforementioned other embodiments are as follows. All parts of the tertiary nozzle 3 including its outlet are arranged outside the secondary nozzle 2. Concretely, the outlet 3A of tertiary nozzle 3 and the outlet 2A of the secondary nozzle 2 are faced together in the furnace 23. That is, the air ports of the aforementioned other embodiments have the nozzle structures in which the tertiary air 11 injected from the outlet 3A of the tertiary nozzle outlet 3A has been merged with the air 10 injected from the outlet 2A of the secondary nozzle within the air port 100. On the other hand, the air port of this embodiment has a structure in which the tertiary air 11 and the secondary air 10 are merged in the furnace 12.

Even such a nozzle structure of this embodiment provides the same effect as that of other embodiments. In addition, according to the nozzle structure of this embodiment, it is a less possible that the secondary air enters into the tertiary nozzle even if the swirling flow from the secondary air becomes large.

However, since the inner wall of the tertiary nozzle is seen from the combustion space, the inner wall thereof may be increased by radiation heat of the combustion space. Therefore, it is necessary to flow always the tertiary air flow rate for preventing temperature-rise at the inner wall of the third nozzle. An alterative to that is as follows. A heat transfer plate 26 is arranged between the secondary nozzle 2 and the tertiary nozzle 3, and the secondary nozzle for cooling is always supplied to the secondary nozzle. According to such a structure, it is Possible to prevent temperature-rise at the inner wall of the third nozzle.

Preferred Embodiment 1-8

Figure 20:
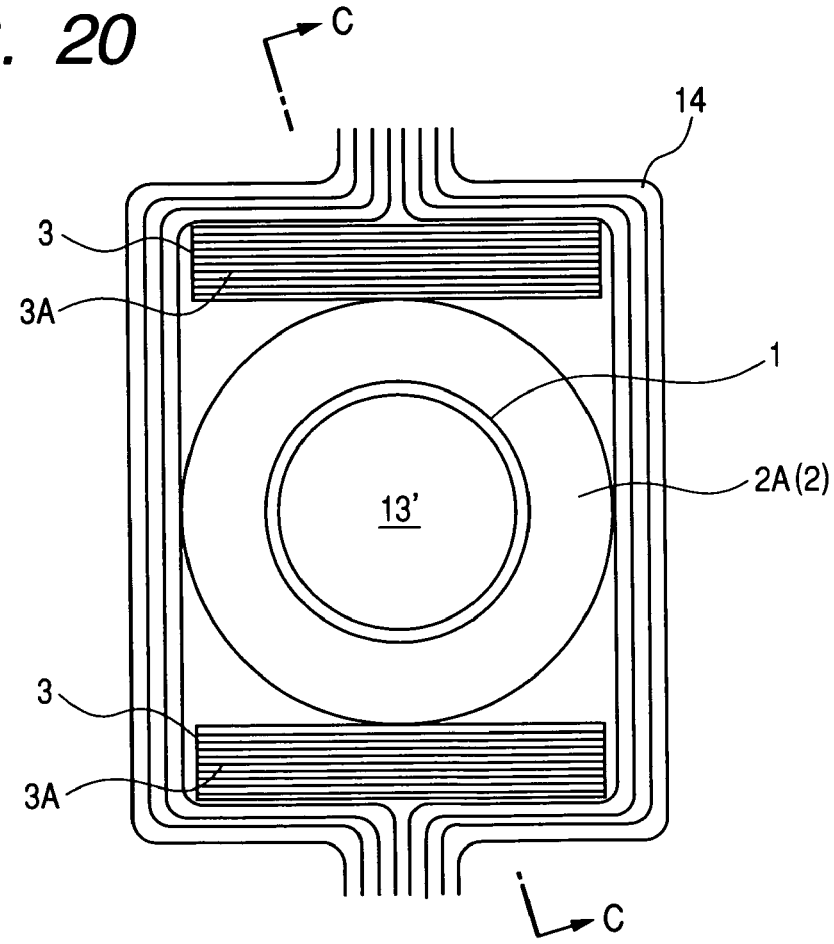
FIG. 20 is a sectional view for showing a preferred embodiment 1-8 of the air port of this invention.

FIG. 20 is a view for showing a preferred embodiment 1-8 of the air port in accordance with this invention. This view is a front view for showing the air port from its outlet side. Its sectional view is the same as FIG. 18. The different features from the aforementioned other embodiments 1-6 are as follows. The tertiary nozzles 3 are not formed into a conical shape, but the tertiary nozzles 3 are arranged above and below the secondary nozzle 2. That is, the tertiary nozzle 3 is composed of separate two nozzles. In this embodiment, the tertiary air is injected from upper and lower locations and then the secondary air and the tertiary air are merged within the furnace. Even with this type of structure, the straight forward flow and the contraction flow are controllable.

Preferred Embodiment 1-9

Figure 21:
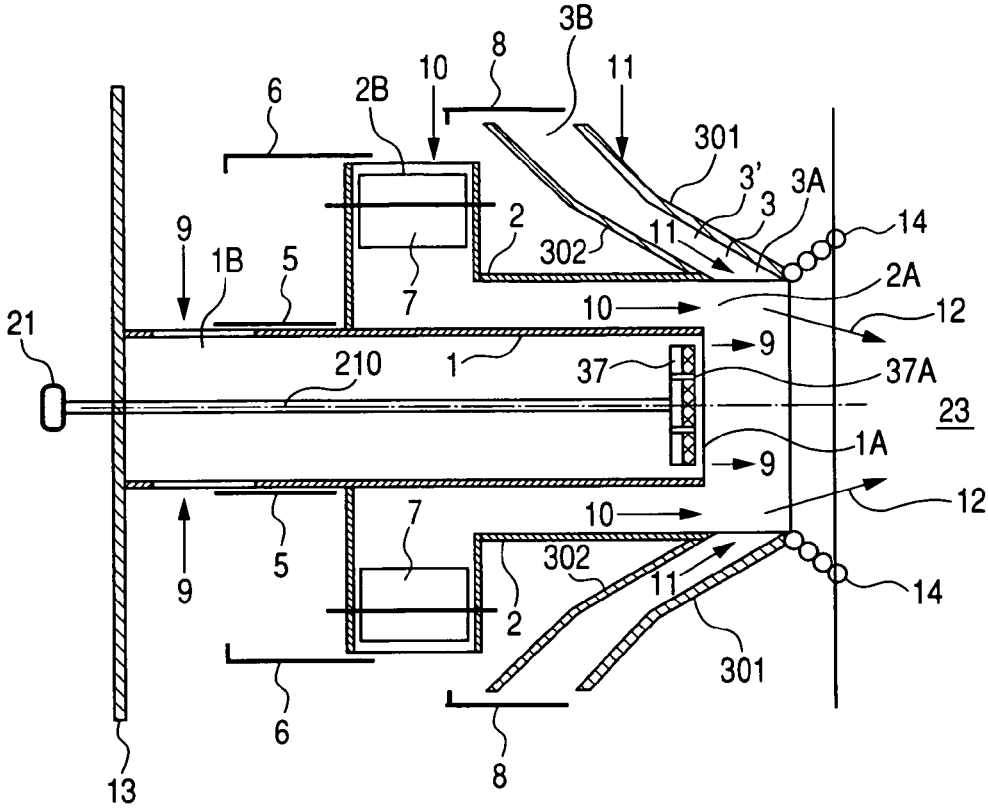
FIG. 21 is a sectional view for showing a preferred embodiment 1-9 of the air port of this invention.

FIG. 21 is a sectional view for showing a preferred embodiment 1-9 of the air port in accordance with the present invention. In this embodiment, in addition to the structure of the embodiment 1, a primary air block plate 37 is installed in the primary nozzle 1. The block plate can be axially moved within the primary nozzle by the handle 21 through a rod 210.

When the primary air block plate 37 is moved back until it is contacted with the outer wall 13 of the window box, the air port 100 has a structure that is substantially similar to that of the embodiment 1.

When the block plate 37 is moved forward up to the outlet 1A of the primary nozzle 1, a small amount of primary air can be injected from between the block plate 37 and the inner wall of the primary air nozzle. Thereby, the primary nozzle can be cooled. There is a possibility that a temperature of the block plate 37 is increased by thermal radiation at the furnace. It is satisfactory to use material endurable against a high temperature such as anti-fire bricks or ceramics and the like. In addition, also as shown in FIG. 21, if the block plate 37 is provided with holes 37A through which the primary air flows, the block plate 37 can be cooled. Further, the block plate 37 may also act as means for preventing either secondary air, third air or combustion gas fed from the furnace 23 from entering into the primary air.

Preferred Embodiment 1-10

Figure 22:
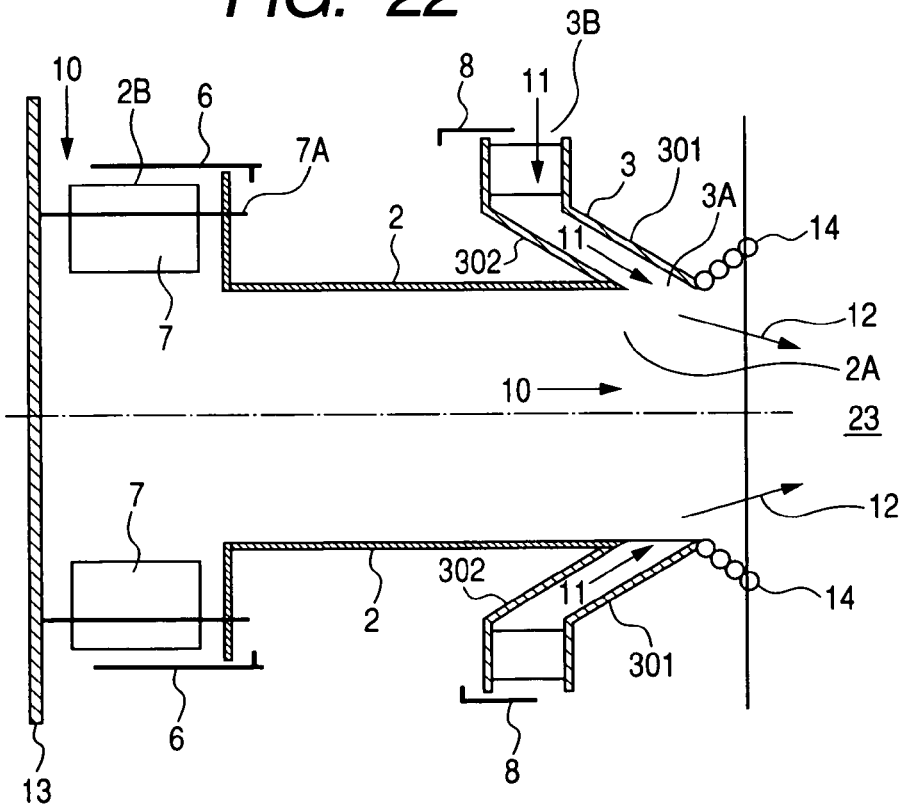
FIG. 22 is a sectional view for showing a preferred embodiment 1-10 of the air port of this invention.

FIG. 22 is a sectional view for showing a preferred embodiment 1-10 of the air port of the present invention.

The different features from the aforementioned other embodiments are as follows. The nozzle structure of this embodiment has no primary nozzle. The secondary nozzle 2 acts as a nozzle in which the primary nozzle and the secondary nozzle of the embodiment 1 are combined to each other. Although the resister 7 is not an essential element, it can be used for making a preferable flowing state at the combustion space through the swirling motion. Although this example shows a case in which the primary nozzle shown in FIG. 2 is not present, it can have a similar structure also in the case that the primary nozzle is eliminated in the air port of FIG. 13.

Preferred Embodiment 1-11

Figure 23:
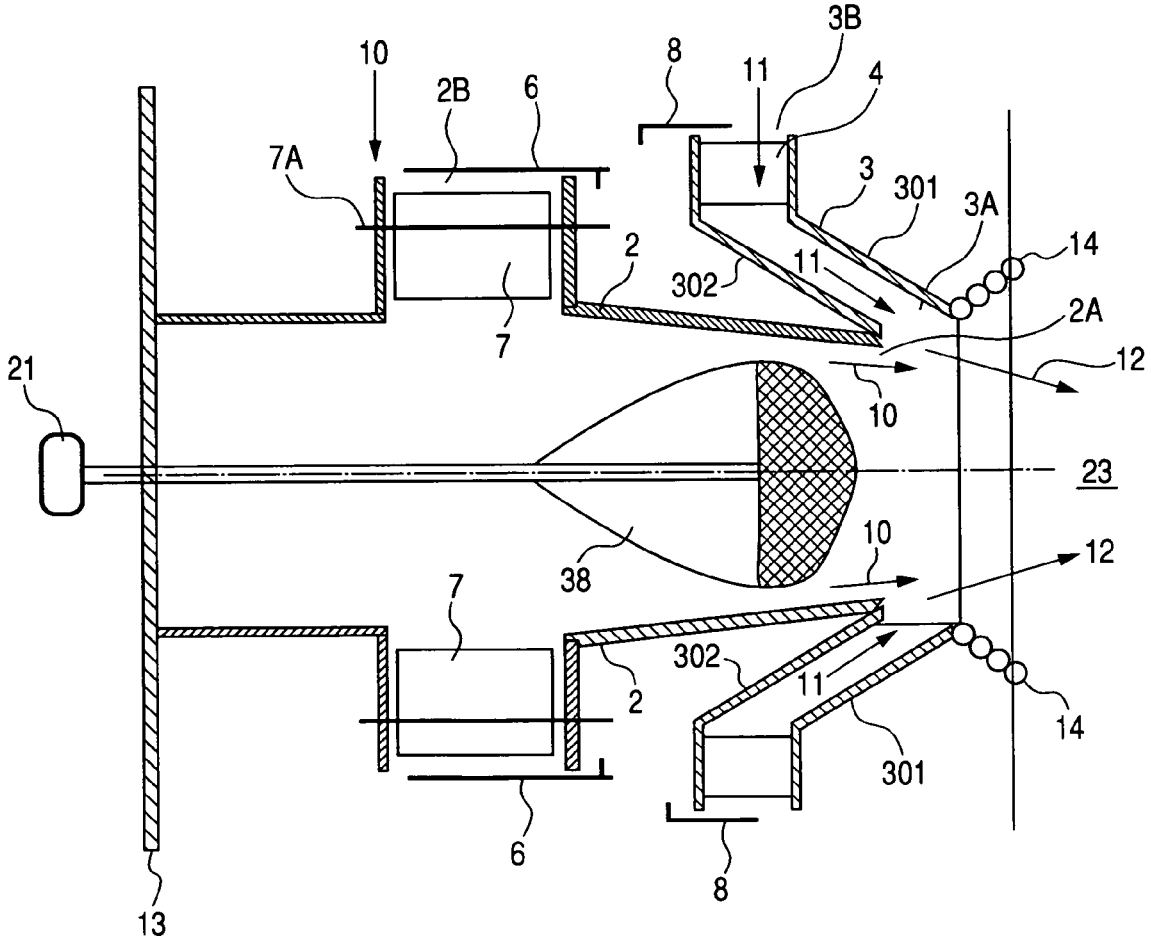
FIG. 23 is a sectional view for showing a preferred embodiment 1-11 of the air port of this invention.

FIG. 23 is a sectional view for showing a preferred embodiment 1-11 of the air port of this invention.

In this embodiment, there is no such a primary nozzle as the other embodiments, and the air port is comprised of the secondary nozzle 2 and the tertiary nozzle 3. More strictly speaking, the air port is comprised of the first nozzle (secondary nozzle) 2 and the second nozzle (third nozzle) 3. The air in the first nozzle 2 becomes the swirling flow, and it is injected in an axial direction of the nozzle. The air in the second nozzle 3 becomes the contraction flow and merged with the swirling flow from the first nozzle 2. In this case, the nozzle 2 is defined as the secondary nozzle, and the nozzle 3 is defined as the tertiary nozzle in the same manner as that of other embodiments. A fusiform movable body 38 is arranged in the secondary nozzle (the first nozzle) 2 and can be moved in an axial direction (forward and rearward) of the nozzle 2. A part of the secondary nozzle 2 which is the nozzle-extremity side part is formed so as to taper down toward its outlet 2A. Accordingly, as the fusiform body 38 is moved toward (moved forward) the furnace as combustion space 23, the passage area of the secondary nozzle 2 becomes narrow and the secondary air hardly flows. As the fusiform body 38 is moved back in an opposite direction, the passage area of the secondary becomes wide and the secondary air easily flows. In this way, since the fusiform body 38 has a function to control a flow rate, a similar effect can be attained even if the secondary damper 6 is not present. Since there is a possibility that a temperature of fusiform body is increased, it is desirable that material endurable against a high temperature is applied.

Preferred Embodiment 2-1

In the two-stage combustion, when the over air is supplied from the overfiring air port, its surrounding gases in the furnace are caught into an over air flow, and a flow of gas entrainment is formed in the furnace. Since the gas in the combustion space near the overfiring air port has a temperature of about 1500 degree Celsius, ash contained in the fuel is melted. The gas entrainment including the melted ash strikes against the outlet of the overfiring air port or the wall surface near the outlet. The melted ash contained in the gas entrainment is solidified on the struck wall and adhered as a clinker. When ash is adhered to the outlet of the overfiring air port, a flow of the over air is changed and a certain influence occurs at the two-stage combustion. Furthermore, a damage of a water pipe may be occurred by a dropping of the clinker, or a closing of a clinker hopper may be occurred.

In the present invention, a seal-fluid supplying apparatus is provided near the outlet of the overfiring air port to prevent gas entrainment from being struck against the outlet of the overfiring air port or a location near thereof. The outlet and a location near the outlet of the overfiring air port is sealed with the seal fluid. At this time, if a temperature of the seal fluid is low and less than a melting temperature of the ash, it is possible to solidify the melted ash in the gas entrainment and reduce an amount of ash adhering to the wall surface. Since a passage spread portion at the outlet of the overfiring air port is placed at a location where the highest temperature gas may easily strikes it, it is desirable that the seal fluid is supplied there. As the seal fluid, for example, air, flue gases, water, steam or their mixtures are suitable.

Referring now to the drawings, the overfiring air port of the present invention will be described. However, the present invention is not limited to the embodiments described below.

Figure 24:
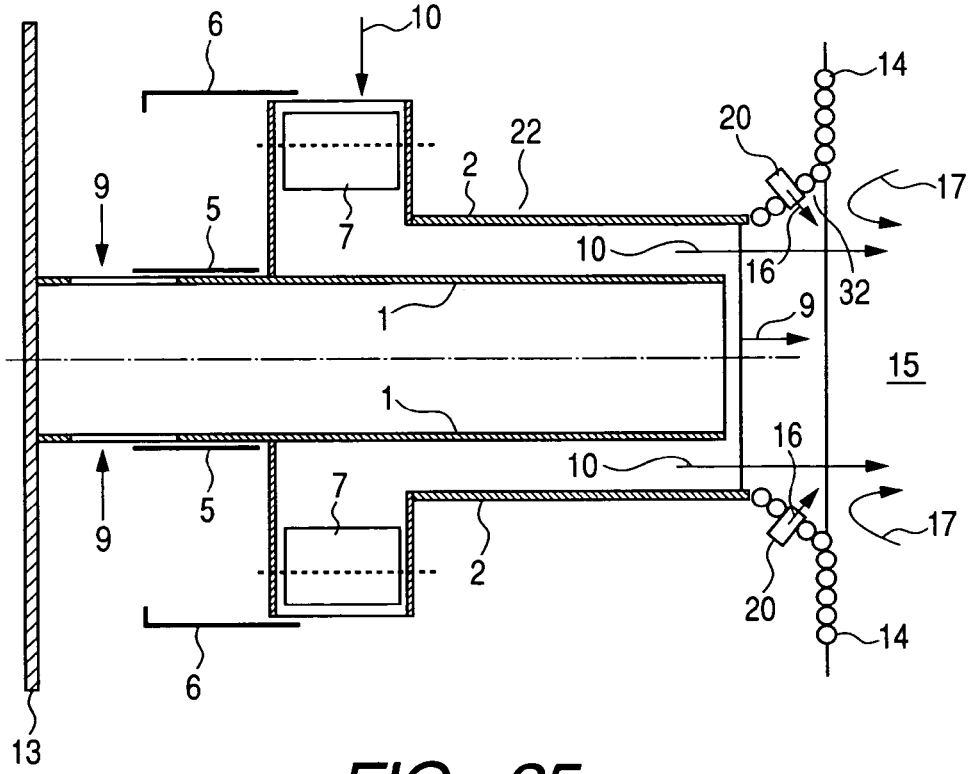
FIG. 24 is a sectional view for showing an overfiring air port of one preferred embodiment of this invention.
Figure 25:
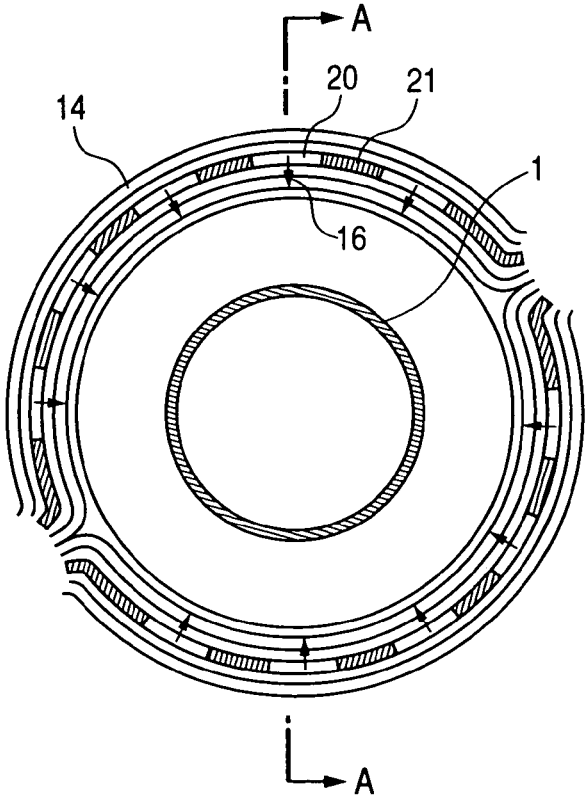
FIG. 25 is a front elevational view for showing an overfiring air port of one preferred embodiment of this invention.

FIG. 24 is a sectional view for showing an embodiment of the overfiring air port of the present invention taken along line A-A of FIG. 25. FIG. 25 is a view for showing the overfiring air port 22 from the combustion space 15. At the overfiring air port shown in FIG. 24, the air is divided and supplied to the primary nozzle 1 and the secondary nozzle 2. The primary air 9 injected from the overfiring air port shown in FIG. 24 is a straight-forward flow. The secondary air 10 injected from the secondary nozzle 2 is a swirling flow jetting forward in a axial direction of the air port, and the swirling force can be controlled with the secondary air resister 7. Flow rates of the primary air and the secondary air are controlled in response to a combustion state at the combustion space 15. A sharing of the flow rates of the primary air and the secondary air is controlled by controlling the primary air damper 5 and the secondary damper 6. The outlet port of the overfiring air port 22 is provided with a divergent air duct portion 32. This divergent duct portion is applied for connecting smoothly the overfiring air port 22 and the water pipe 14, thereby facilitating of the overfiring air port manufacturing is attained. It can also restrict an occurrence of stress at the connection portion.

When the secondary air is injected in the combustion space 15, its jet stream catches surrounding gases into the stream, and the gas entrainment 17 is formed in the furnace. This gas entrainment 17 flows so as to strike against the flow passage of the divergent air duct portion 32. Since the melted ash is contained in the gas entrainment 17, the melted ash may be adhered to the passage of the divergent air duct portion and solidified there. In this embodiment, the seal-fluid supplying apparatus is provided to supply the seal fluid 16 at the passage of the divergent air duct portion. In FIG. 24, the seal-fluid port 20 is shown as the seal-fluid supplying apparatus. In addition, in FIG. 24, although the seal-fluid port 20 is provided at a substantial central part of the wall of the divergent air duct portion 32, it is not necessarily set at the central part. Since the seal-fluid port 20 is mounted at the central part, it prevents the adhesion of the ash on the wall surface, and there is less possibility that the ash becomes a large clinker.

When a part of the air at the overfiring air port 22 is used as the seal fluid 16, it is possible to make a structure of the overfiring air port simple. When flue gases, water or steam is used as the seal fluid, a concentration of oxygen at outside of the secondary air 10 can be reduced, and a specific heat of the gas can be increased. When the concentration of oxygen is low and the specific heat is high, a combustion temperature is decreased and occurrence of thermal NOx can be reduced. As shown in FIG. 25, a plurality of seal-fluid ports 20 are installed and the seal fluid 16 is injected from each of the seal-fluid ports. A welding part 21 for the water pipes is provided between the ports to prevent the water pipes from being deformed. In FIG. 25, although the seal-fluid ports 20 are mounted so that the seal fluids are injected from between the water pipes in the same rows, they may be of different rows. Since the welding part 21 is hardly cooled, it is satisfactory that metal of high thermal conductivity is applied to decrease the temperature. In addition, it is satisfactory that some fins are installed at the plane of the welding part 21 opposing against the combustion space to increase a cooling area.

Preferred Embodiment 2-2

Figure 26:
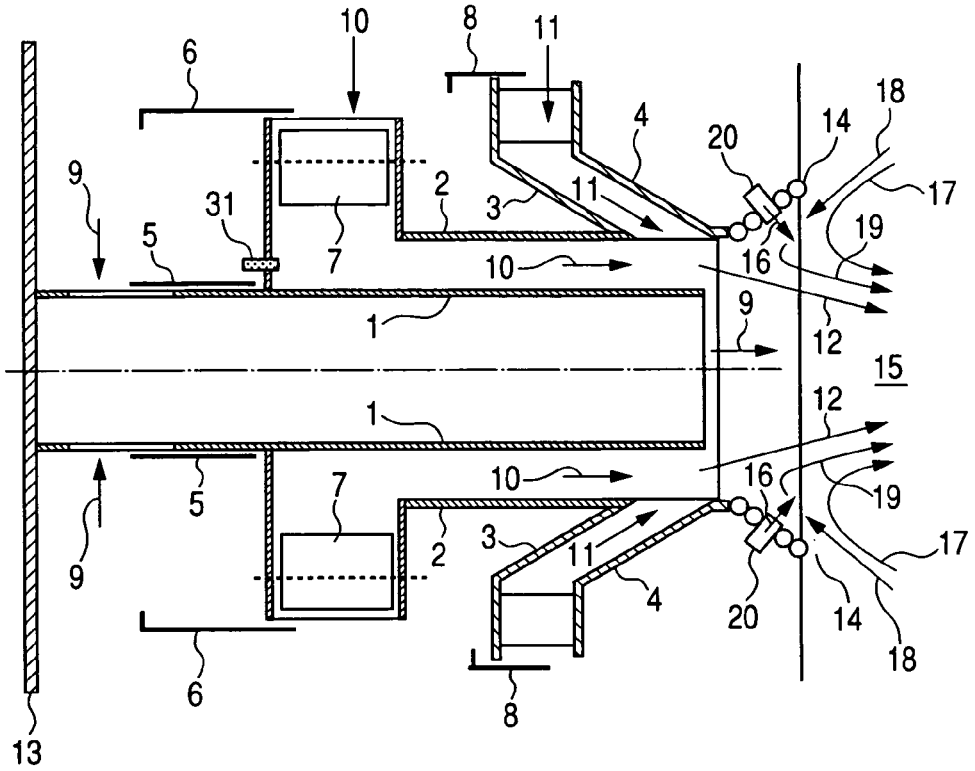
FIG. 26 is a sectional view for showing an overfiring air port of another preferred embodiment of this invention.

FIG. 26 shows another embodiment of the overfiring air port. The overfiring air port shown in FIG. 24 can control both the straight-forward flow and the swirling flow. In the example shown in FIG. 26, since the inner wall 3 of tertiary nozzle as the contraction flow-nozzle and the outer wall 4 of the tertiary nozzle are directed toward the center line of the air port, the tertiary air is injected as the contraction flow at the outlet of the overfiring air port 22. When the contraction flow is applied, the amount of gas entrainments 17, 18 and 19 is increased and the amount of melted ash adhered to the wall is increased. Also in this case, it is possible to reduce adhesion of ash by mounting the seal-fluid ports 20 of this invention and injecting the seal fluid 16.

Further, it is possible to change an application of the overfiring air port in response to an adhered state of the ash. For example, an adhering amount of ash is measured by a sensor 31. In this case, a sensor for measuring an intensity of radiation can be used. When an ash adhering amount is increased, a tertiary air damper 8 is closed so that a flow rate of the contraction flow as tertiary air 11 may be decreased. Since the flow 12 of the secondary air after being merged is directed outward, an amount of gas entrainment is decreased and an ash adhesion can be reduced. In addition, if the secondary register 7 is closed, the swirling flow from the secondary nozzle is increased When the primary air damper 5, secondary air damper 6 and the tertiary air damper 8 are closed, a pressure in the window box 13 is increased and an amount of seal fluid 16 can be increased. When an ash adhering amount is increased, it is satisfactory to perform such an operation as above.

Preferred Embodiment 2-3

Figure 27:
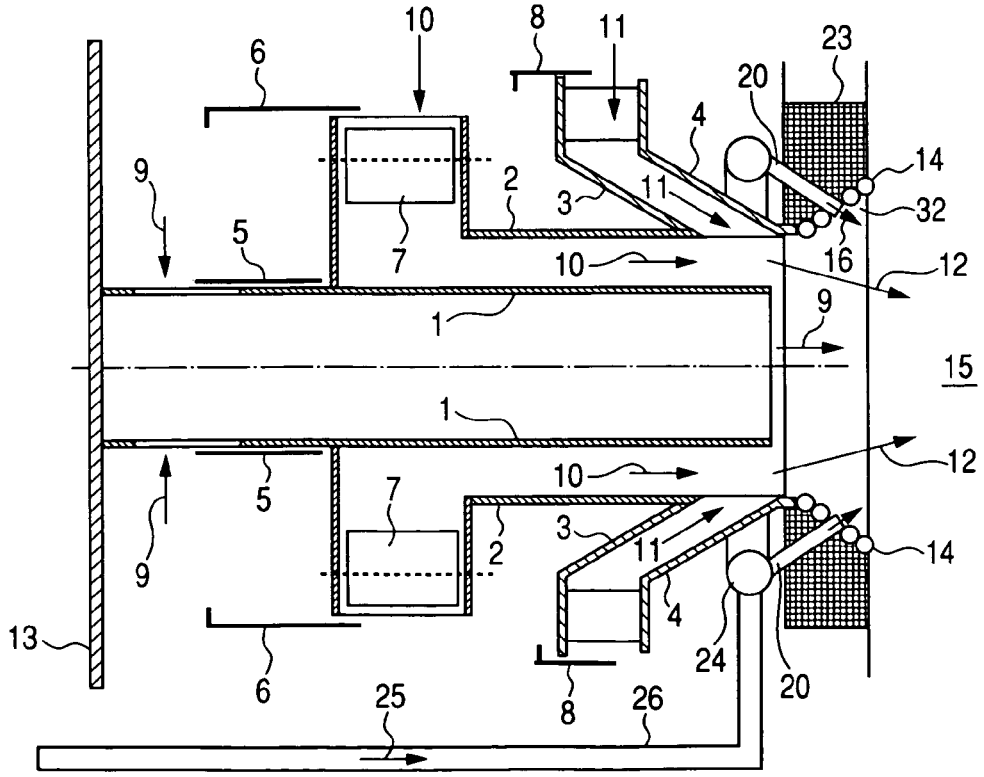
FIG. 27 is a sectional view for showing an overfiring air port of another preferred embodiment of this invention.

FIG. 27 shows a still further embodiment of the overfiring air port. Although its basic structure is the same as that of the embodiment 2-2, a refractory material 23 is mounted at the outlet of the overfiring air port. Presence of the refractory material 23, air cannot be supplied to the divergent air duct portion, so that the seal-fluid ports 20 are extended to a location before the refractory material. With such a structure as above, not only the ash adhesion, but also cooling the refractory material can be carried out.

Preferred Embodiment 2-4

Figure 28:
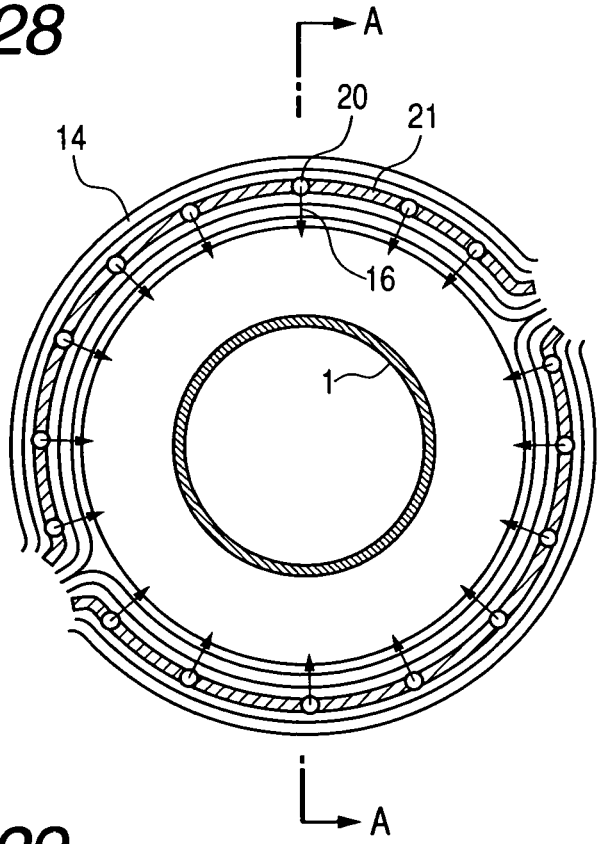
FIG. 28 is a front elevational view for showing an overfiring air port of another preferred embodiment of this invention.

FIG. 27 shows another example of the overfiring air port of this invention to illustrate a sectional view taken along a line A-A of FIG. 28. FIG. 28 illustrates an overfiring air port as seen from the combustion space 15. This embodiment is effective when an ash adhesion is prevented with fluid other than air. In order to supply the seal-fluid other than air, the seal-fluid 25 is supplied from a seal fluid supply pipe 26 to the header 24, and this is supplied from the seal-fluid ports 20 as the seal fluid 16. Application of the header 24 enables the seal fluid 16 supplied from the seal-fluid ports 20 to be uniform. When either water or steam is used as the seal fluid, An injector may be installed at the extremity ends of the seal-fluid ports 20. Changing of the injector also enables a direction of injection and a flow rate to be changed. Further, changing of the specification for every injector enables a direction of injection and flow rate or the like to be changed. Further, if changing the specification for every injector, it is also possible to change a seal fluid flow rate at a location where much amount of ash adhesion is present. In addition, increasing a supply pressure for the seal fluid enables the seal fluid to be supplied under a high flow velocity and enables ash adhesion to be prevented.

Preferred Embodiment 2-5

Figure 29:
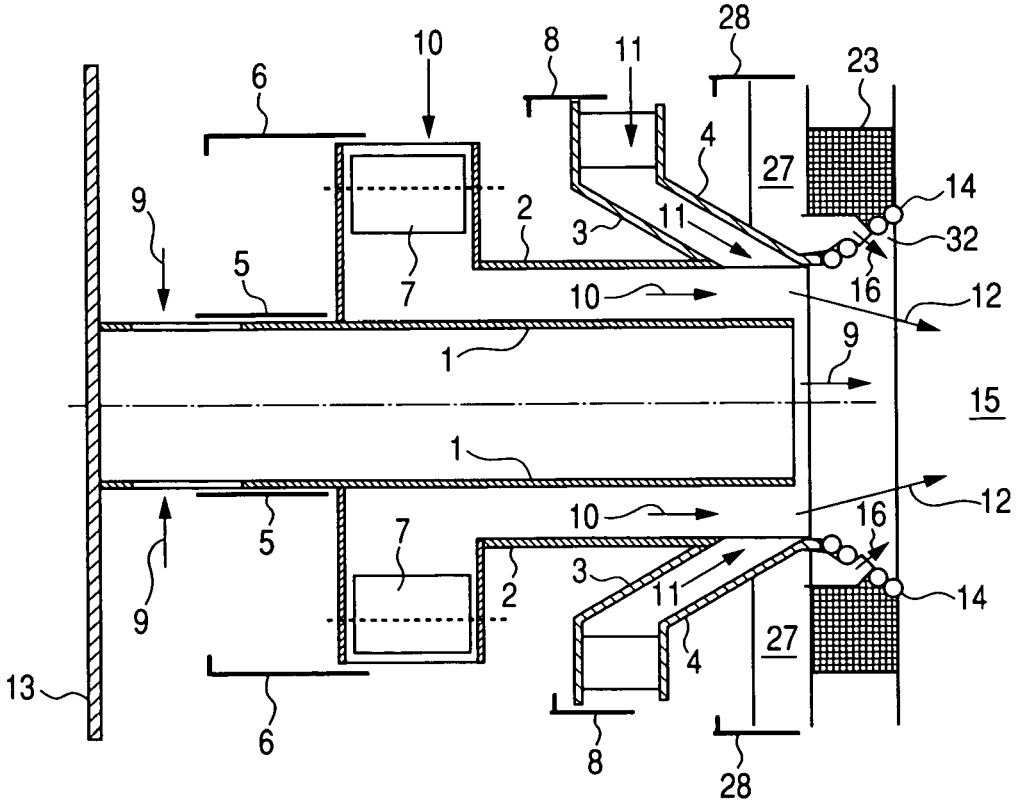
FIG. 29 is a sectional view for showing an overfiring air port of a still another preferred embodiment of this invention.

FIG. 29 is a sectional view for showing the overfiring air port in accordance with a still further embodiment of the present invention. In this embodiment, a window box 27 for seal fluid and a damper 28 for seal fluid are provided as composing elements for the seal-fluid supplying apparatus. The most-suitable flow rate of the seal fluid is controlled in response to its application states such as the type of coal and load or the like. In this case, it can be controlled to the most suitable flow rate through controlling of the damper 28 for the seal fluid. For example, when coal with a low ash melting point is used, the ash adhesion may be increased. In order to meet the problem, the amount of seal fluid may be increased.

Preferred Embodiment 2-6

Figure 30:
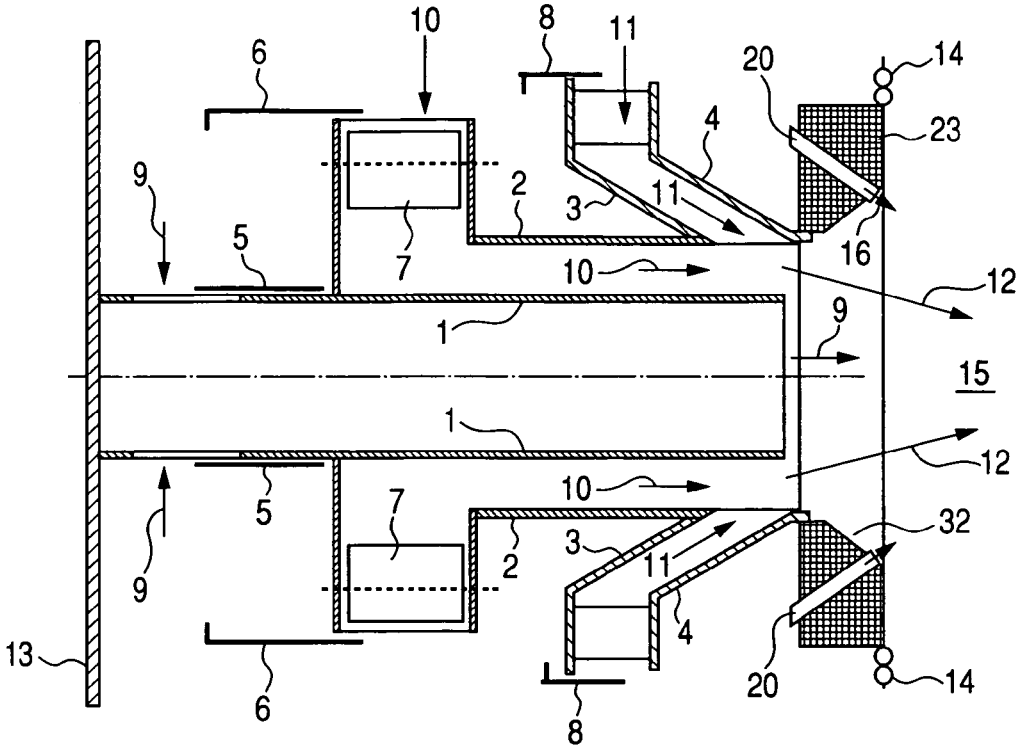
FIG. 30 is a sectional view for showing an overfiring air port of another preferred embodiment of this invention.

FIG. 30 indicates a sectional view for showing the overfiring air port in accordance with a still further embodiment of the present invention. In this embodiment, all the divergent air duct portion 32 of the overfiring air ports is formed by refractory material 23. With such a structure as above, a surface temperature at the divergent air duct portion 32 is increased and the ash may easily be adhered. Supplying of the seal fluid from this part enables the ash adhesion to be reduced with the seal fluid. Further, in this embodiment, outlets of the seal-fluid ports 20 are set to locations near the combustion space. In the embodiments 2-1 to 2-5, although there is a possibility that the ash is adhered to the combustion space rather than the seal-fluid ports at the divergent air duct portions, the possibility of ash adhesion can be reduced in this embodiment.

Preferred Embodiment 2-7

Figure 31:
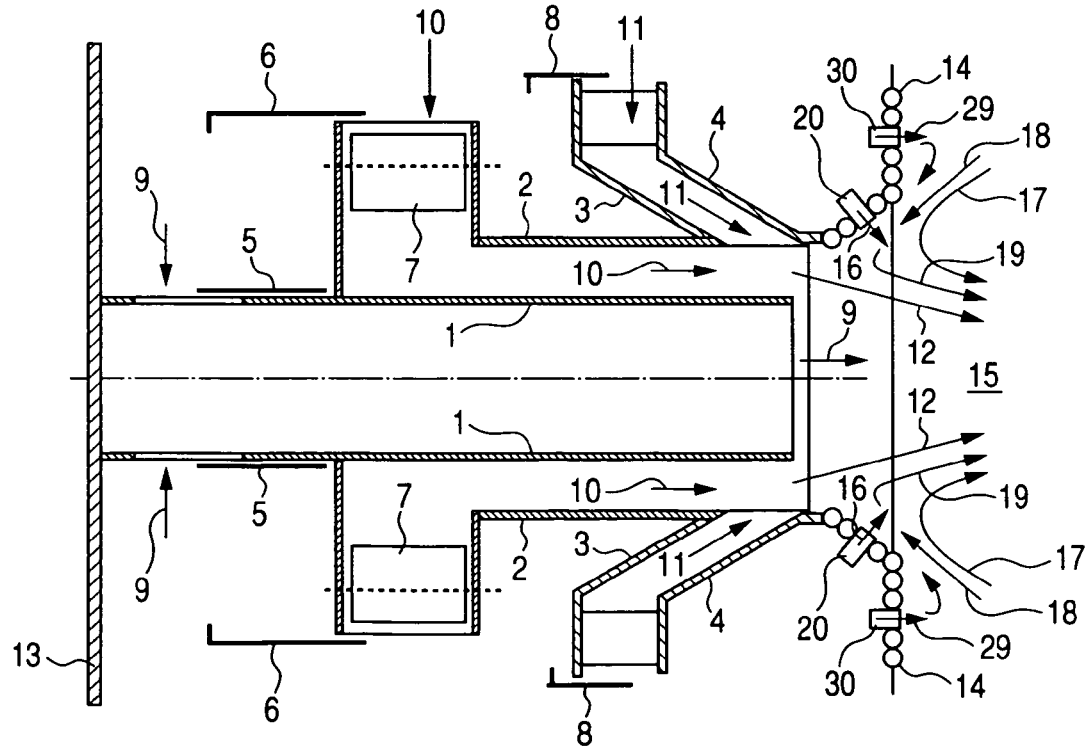
FIG. 31 is a sectional view for showing an overfiring air port of another preferred embodiment of this invention.

FIG. 31 indicates a sectional view for showing the overfiring airport in accordance with a still further embodiment of the present invention. In this embodiment, a seal fluid 29 is also supplied from the seal-fluid ports 30 directed toward the combustion space 15. Since the gas reaches to the divergent air duct portion of the overfiring air port accompanying with the seal fluid 29, an effect for preventing ash adhesion to the divergent air duct portion is increased.

Preferred Embodiment 2-8

Figure 32:
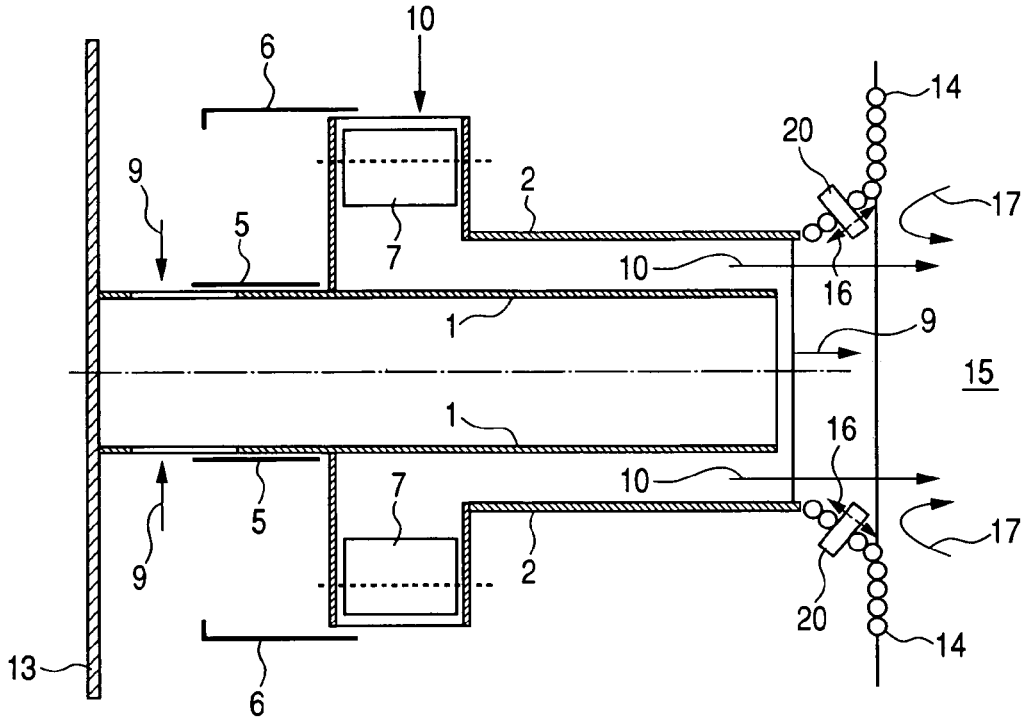
FIG. 32 is a sectional view for showing an overfiring air port of a still another preferred embodiment of this invention.

FIG. 32 indicates a sectional view for showing the overfiring air port in accordance with a still further embodiment of the present invention. In this embodiment, two injection holes are provided at the extremity of each seal-fluid ports 20, and the seal fluid 16 is flowed along the wall surfaces of the divergent air duct portion of the overfiring air ports. Since arrangement of the plural holes at one port can inject the seal-fluid in a plurality of directions, it enables the ash adhering locations to be reduced.

Preferred Embodiment 3-1

In general, although application of the fuel burner under a state of air-shortage enables NOx in the combustion gas to be restricted in its production, it generates CO. The after-air nozzle as the overfiring air port performs an efficient mixing of air and incomplete combustion gas of fuel, and an efficient mixing of air and CO gas produced as inflammable gas. Accordingly, the promotions of their combustion and restricting a production of CO are realized. However, rapid mixing of air from the after-air nozzle and the incomplete combustion gas causes the incomplete combustion gas to be rapidly burned, a combustion gas temperature to be increased and hot NOx to be produced. In order to restrict production of this hot NOx, it is necessary to perform a gradual mixing of air flowing from the after-air nozzle and the incomplete combustion gases.

In order to perform a well-balanced restriction against production of both NOx and CO, and to reduce an increasing of concentrations of both NOx and CO, it is necessary to perform a complete mixing of air and flammable gases while performing a gradual mixing of them, and so the gradual mixing is carried out through supplying of air under its swirling flow, and the contraction flow air is supplied for the complete mixing.

Further, the amount of production of NOx and CO is made different in response to the type of fuel. For example, since much amount of volatile substance is present in pulverized coal such as lignite or sub-bituminous coal, CO is easily produced. However, since its heat generating calorie is small, a combustion gas temperature is low, NOx is hardly produced. On the other hand, since pulverized coal such as bituminous coal or anthracite has a less amount of volatile substance, CO is hardly produced. However, a combustion gas temperature is high because it has a high heat generating calorie and then NOx is easily produced.

Accordingly, a swirling air supplying amount and a contraction air supplying amount from the after-air nozzle are controlled and supplied in well-balanced state so as to cause production of NOx and CO to be restricted under their well-balanced state in response to various kinds of fuel.

The after-air nozzle is applied under a much amount of air supply with a swirling flow when a concentration of NOx is high. On the other hand, it is applied under a much amount of air supply with a contraction flow when a concentration of CO is high. These air supply amounts are controlled automatically by measuring a concentration of NOx and a concentration of CO at the outlet of the combustion furnace, and measuring a concentration of CO at the upstream side of the outlet of the combustion furnace and at the downstream side of the after-air nozzle.

A plurality of after-air nozzles are arranged at opposing wall surfaces of the combustion furnace so that the after-air nozzles on the same wall are arranged side by side in a direction of crossing at a right angle with respect to a jet of the incomplete combustion gases from the gas burner. In this case, areas where the incomplete combustion gas and air from the after-air nozzles are not sufficiently mixed to each other are generated between the adjoining after-air nozzles arranged at the same wall surface and in the spaces adjacent to the both ends of the arrangement of after-air nozzles. So, when a concentration of CO is high through measurement of the concentration of CO at the outlet of the combustion furnace, the concentration of CO is restricted by increasing a supplying amount of contraction flow air in sequence from the both end members of the arranged after-air nozzles toward the central members. Conversely, when a concentration of NOx is high, the concentration of NOx is restricted by increasing a supplying amount of air of swirling flow in sequence from the central members of the arranged after-air nozzles toward the end members. Similarly, a concentration of CO is effectively restricted by measuring a concentration of CO near the end members of the after-air nozzles arranged at the upstream side of the outlet of the combustion furnace to control a contraction flow air supplying amount.

The already-existing boiler facility has a plurality of after-air nozzles including the swirling flow air nozzles for supplying air through swirling flow arranged at the wall surface of the combustion furnace. In such a boiler facility as above, contraction flow-air nozzles capable of supplying the contraction flow air are additionally installed concentrically around the swirling flow-air nozzles positioned in at least end portions of a plurality of arranged after-air nozzles. And, by setting the air supplying amount from the contraction flow air nozzles more than those at the swirling flow air nozzles, the concentration of CO can be reduced under a minimum improvement cost.

In recent years, since an air supplying amount for the swirling flow and for the contraction flow can be determined under a high precision through an analysis of a boiler facility, the supplying amount of air set through an analysis performed at an application plan for the boiler facility. That is, a changing-over of fuel or a thermal load changing plan is applied as a reference condition during its practical operation. And subsequently each of the air supplying amounts is finely adjusted in response to a practical measured value of each of the concentration of NOx and the concentration of CO generated at the time of its practical operation. Thereby, it enables the facility to be speedily adapted for a change in the concentration of NOx and the concentration of CO.

Figure 33:
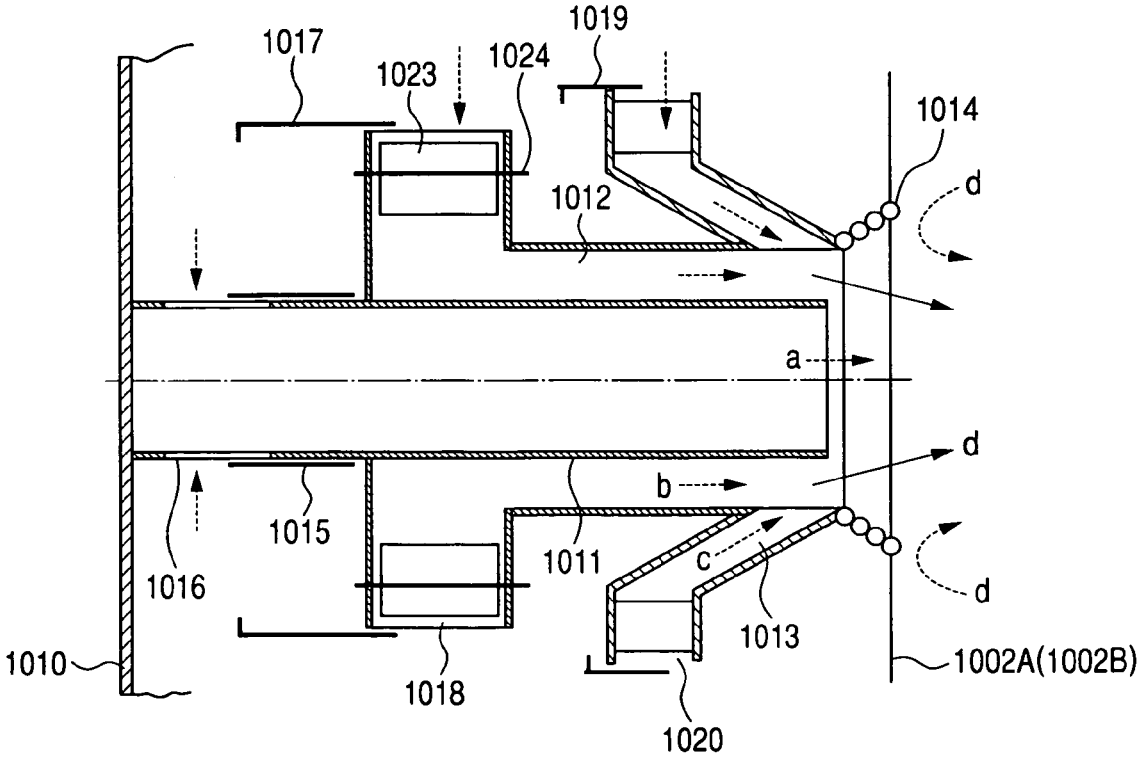
FIG. 33 is a side elevational view in longitudinal section for showing an after-air nozzle in a pulverized firing type boiler facility of one preferred embodiment of the boiler facility of this invention.
Figure 34:
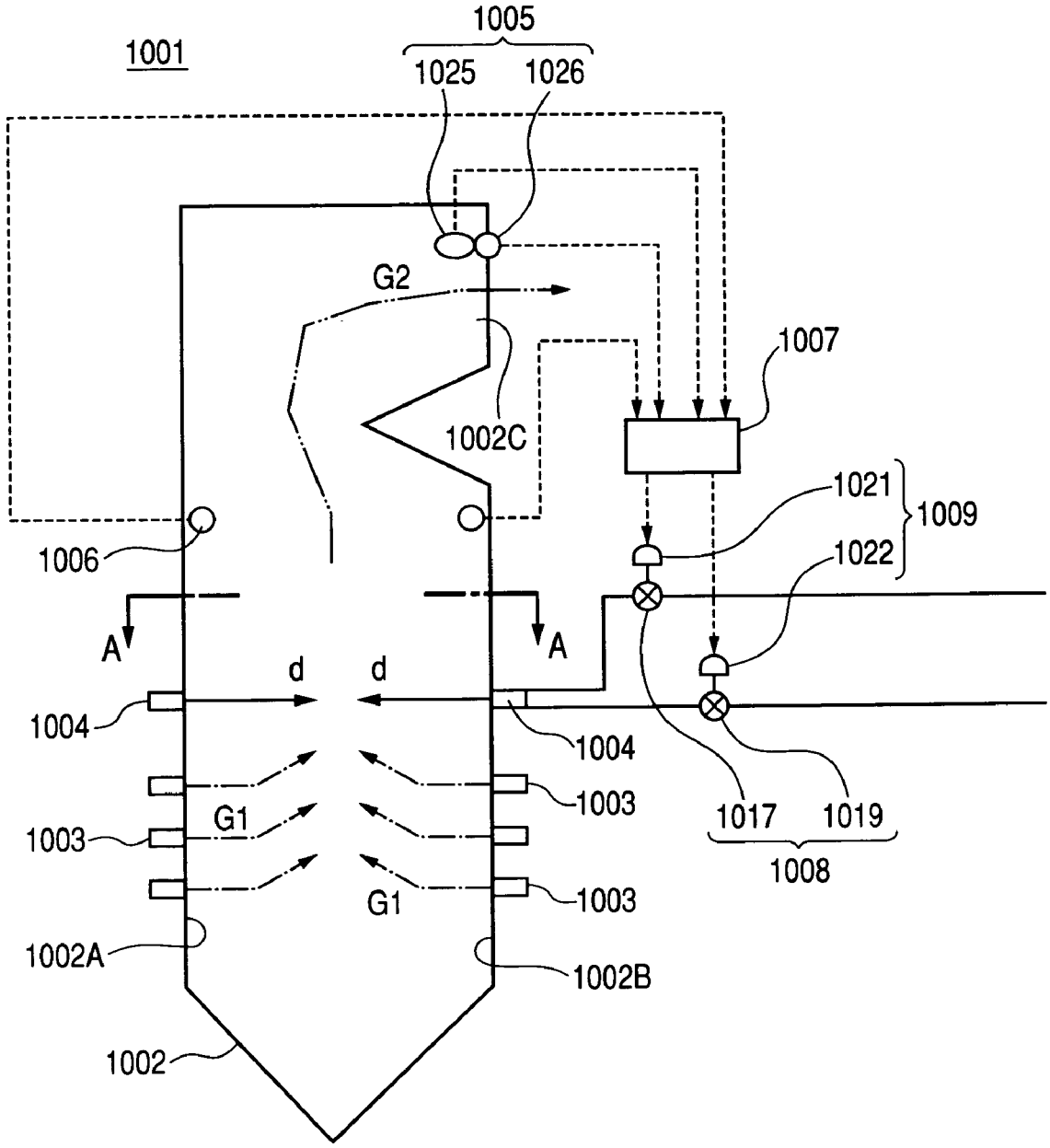
FIG. 34 is a block diagram for showing a pulverized coal firing type boiler facility of one preferred embodiment of the boiler facility of this invention.
Figure 35:
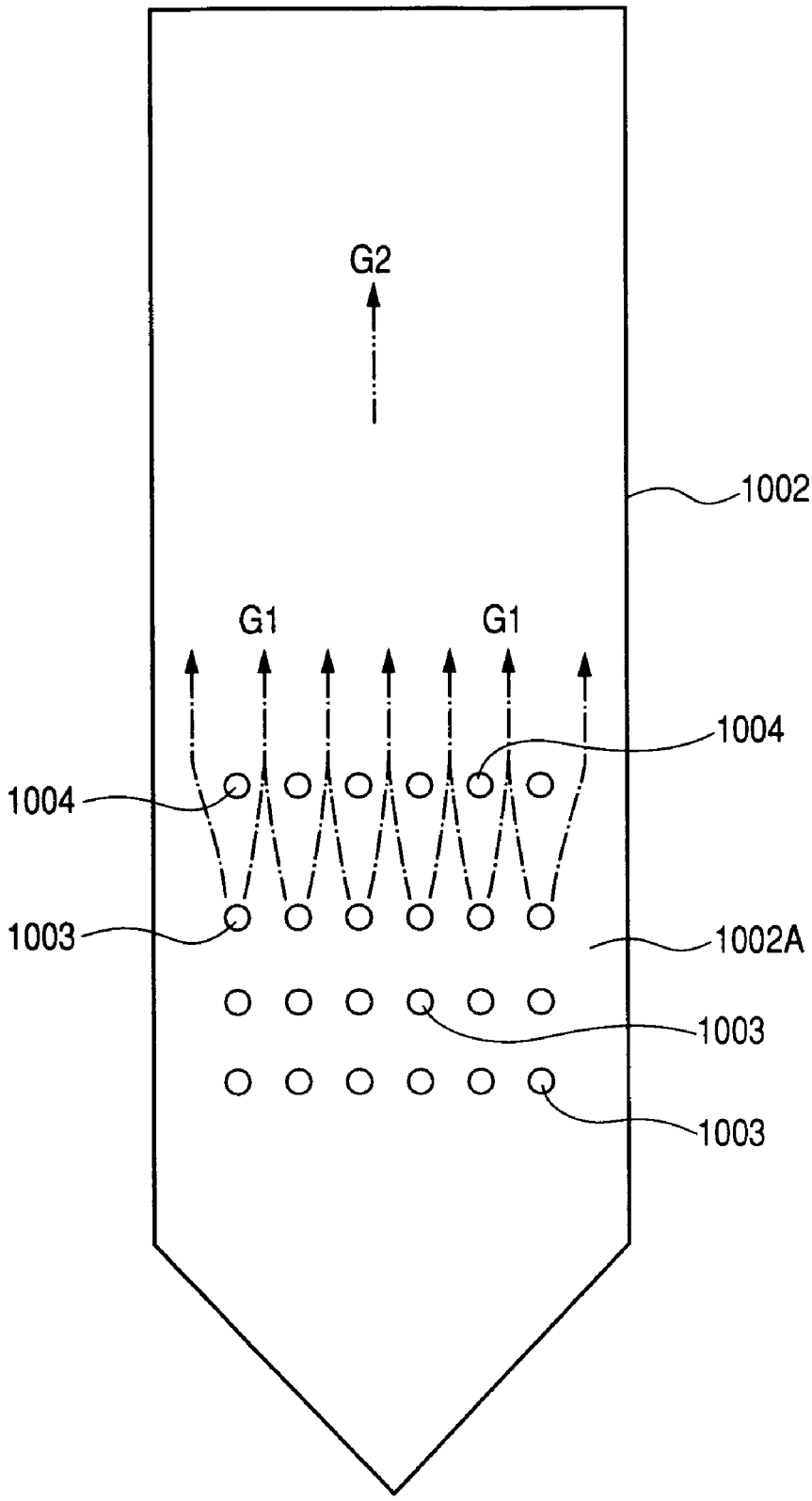
FIG. 35 is a front elevational view in longitudinal section for showing a combustion furnace at a pulverized coal firing type boiler facility of one preferred embodiment of the boiler facility of this invention.

Referring now to FIGS. 33 to 35, a preferred embodiment of the boiler facility in accordance with the present invention will be described in reference to a pulverized coal firing type boiler facility.

The pulverized coal firing type boiler facility 1 comprises a furnace 1002 longitudinally installed and having a rectangular section, a plurality of burners 1003 arranged side by side in a lateral direction crossing at a right angle in a vertical direction in a plurality of stages in a vertical direction at each of the opposing wall surfaces 1002A, 1002B of rectangular section of the furnace 1002, a plurality of after-air nozzles 1004 arranged side by side in a lateral direction crossing at a right angle with a vertical direction (a combustion gas-jet direction) of the opposing wall surfaces 1002A, 10022B at the downstream side of these combustion burners 1003, a first concentration measuring means 1005 acting as a concentration measuring means arranged near the outlet 1002C of the furnace, a second concentration measuring means 1006 arranged at the upstream side of the outlet 1002C of the combustion furnace and at the downstream side of the after-air nozzle 1004, a control means 1007 for calculating the measured values from the first and second concentration measuring means 1005, 1006 and giving an instruction, an air flow rate control(adjusting) mechanism 1008 for controlling(adjusting) the amount of swirling flow-air and contraction flow-air from the after-air nozzles 1004, and an control mechanism driving means 1009 for driving the air flow rate control mechanism 1008 under an instruction from the control means. Then, these control means 1007, air flow rate control mechanism 1008, control mechanism driving means 1009 constitute a flow rate control means of the present invention for controlling air supply amounts of swirling flow and contraction flow from the after-air nozzles 1004 in response to the measurement results of the concentration measuring means.

The furnace 1002 is provided with a steam producing device (not shown) acting as a heat exchanger (not shown) for heat exchanging with combustion gas. The steam produced by this steam producing device is supplied to a steam turbine, for example, not shown. The steam turbine is rotationally driven by the steam.

The fuel burner 1003 is used for injecting some pulverized coal and air to burn them. The fuel burner is enclosed by a common ventilating box 1010 as shown in FIG. 33 together with the after-air nozzles 1004 and positioned at the outer wall of the furnace 1002.

As shown in detail in FIG. 33, the after-air nozzles 1004 are provided with straight-forward air nozzles 1011 at the center of the nozzles. The outlet of each the straight-forward air nozzles 1011 is opened while crossing at a right angle with the opposing wall surfaces 1002A, 1002B of the furnace 1002. Each the nozzle 1011 acts as the first air nozzle (primary nozzle) for injecting the straight-forward air (a). Swirling flow-air nozzles 1012 acting as a second air nozzles (secondary nozzles) are respectively arranged concentrically at the outside of the first nozzles 1011 to inject a swirling flow air (b). Contraction flow-air nozzles 1013 acting as a third nozzles (tertiary nozzles) are arranged concentrically at the second nozzles 1012 and near the outlets of the second nozzles 1012 to inject the contraction flow air (c), and a water pipes 1014 are arranged between respective openings of the third nozzles 1013 and the wall surfaces 1002A, 1002B. The second air nozzles are used for the first means for supplying air with respective swirling flows of the present invention, and the third air nozzles are used for the second means for supplying air with respective contraction flows of the present invention.

Each of the straight-forward air nozzles 1011 as the primary nozzles, the swirling flow-air nozzles 1012 as the secondary nozzles and contraction flow air-nozzles 1013 as the tertiary nozzles is provided with air intake ports 1016, 1018 and 1020 at sides opposing to the nozzle extremity. Their respective air flow rates are controlled (adjusted) by the valves 1015, 1017 and 1019 of the air amount controlling (adjusting) mechanisms. Then, the valves 1017, 1019 are driven to be opened or closed by the control mechanism driving means, for example, the electromagnetic driving mechanisms 1021, 1022. In addition, the air resister 1023 is supported near the air intake port 18 of the swirling flow air nozzle 1012 through the shaft 1024. A swirling force is applied to the air by inclining the air resister 1023 with respect to an air intake direction.

In this case, the air supplied into the ventilating box 1010 is shared into an amount of air used for the combustion burner 1003 and an amount of air used for the after-air nozzles 1004. Furthermore, the air taken into the after-air nozzles 1004 is shared with the valves 1015, 1017 and 1019 into an amount of air for the straight-forward air nozzles 1011, swirling flow-air nozzles 1012 and contraction flow-air nozzle 1013.

The first concentration measuring means 1005 arranged near the outlet port 1002C of the furnace comprises a NOx concentration measuring device 1025 for measuring a NOx concentration and a CO concentration measuring device 1026 for measuring a CO concentration. Each of the measured concentrations is outputted to the control means 1007. In addition, the second concentration measuring means 1006 arranged at the upstream side of the outlet port 1002C and at the downstream side of the after-air nozzles 1004 is a CO concentration measuring device. The CO concentration measured in the same manner is outputted to the control means 1007.

When the pulverized coal firing type boiler facility having the aforementioned configuration is operated, fuel comprising mixture of pulverized coal and air requisite for burning is injected from the burners 1003 to perform combustion. In order to perform an incomplete combustion of pulverized coal, a combustion temperature is reduced, and production of NOx is reduced. The mixing amount of air is set to be less with respect to an amount of air (a stoichiometric air requirement) requisite for performing a complete combustion of the pulverized coal. The operation is carried out under an air ratio of (a supplied amount of air/a stoichiometric air volume) 0.7 to 0.9. The fuel injected from each burner is burned in incomplete combustion, and NOx may be produced in incomplete combustion gas G1. Even if NOx is produced, it can be reduced to N2 with reduction gas such as $NH_3$ or CN even, so that a NOx concentration is restricted. Conversely, CO is easily produced with the incomplete combustion gas G1 from the combustion burners 3.

Air (d) for combustion is supplied for burning inflammable fuel such as CO in the incomplete combustion gas G1 (unburned fuel and burned fuel) to restrict a discharge of CO. At this time, when a temperature within the furnace exceeds 1500 celsius under an excessive amount of air with the air ratio being 1 or more, hot NOx is easily be produced. In particular, when the combustion air (d) and the incomplete combustion gas G1 are rapidly mixed to each other and burned, hot NOx is produced. So that, in this case, the air (a) straight forwarded from the straight-forward air nozzles 1011 and the swirling flow air (b) from the swirling flow air nozzles 1012 are supplied, the combustion air (d) of swirling flow and the incomplete combustion gas G1 is set to be burned gradually. Thereby, production of hot NOx within the combustion gas G2 can be reduced. At this time, the swirling flow air nozzle 1012 is opened with the valves 1017 to increase an amount of air fed from the air intake ports 1018, and the contraction flow air nozzle 1013 is closed with valve 1019 to restrict an amount of fed air from the air intake ports 1020. In these nozzles, a CO concentration in the combustion furnace 1002 is measured by the CO concentration measuring devices 1006, 1026, the measured value of the concentration is outputted to the control means 1007 and a degree of opening of the valves 1017 and 1019 is controlled in response to the measured value. The amount of swirling flow-air is controlled through a control of opening degree of the valves 1017, 1019. A degree of gradual mixing of the combustion air of swirling flow (d) and the incomplete combustion gas G1 is made most suitable one.

In this case, a plurality of combustion burners 1003 and after-air nozzles 1004 are respectively arranged side-by-side in a lateral direction at the opposing wall surfaces 1002A, 1002B of rectangular section, as described above. As shown in FIG. 35, the incomplete combustion gas G1 from the combustion burners 1003 in particular under such an arrangement as above has an ascending flow passing through between the adjoining after-air nozzles 1004 or through outside of the both ends of the arrangement of after-air nozzles 1004, this flow is not sufficiently mixed with the swirling flow combustion air (d) from the after-air nozzles 1004 and then the flow reaches to the outlet port 2C of the furnace. In such a case as above, CO concentration in the combustion gas G2 is measured by the CO concentration measuring unit 1026 at the outlet port 2C of the combustion furnace. If the CO concentration is high, an air supply amount from the swirling flow air nozzles 1012 is controlled by the valve 1017 through the control means 1007 the air supply amount of the contraction flow air nozzles 1013 is increased under an opened state of the valve 1019, the combustion air (d) from the after-air nozzles 1004 is made as contraction flow to promote mixing with the incomplete combustion gas G1, it is approached to the complete combustion to reduce CO concentration.

Figure 36:
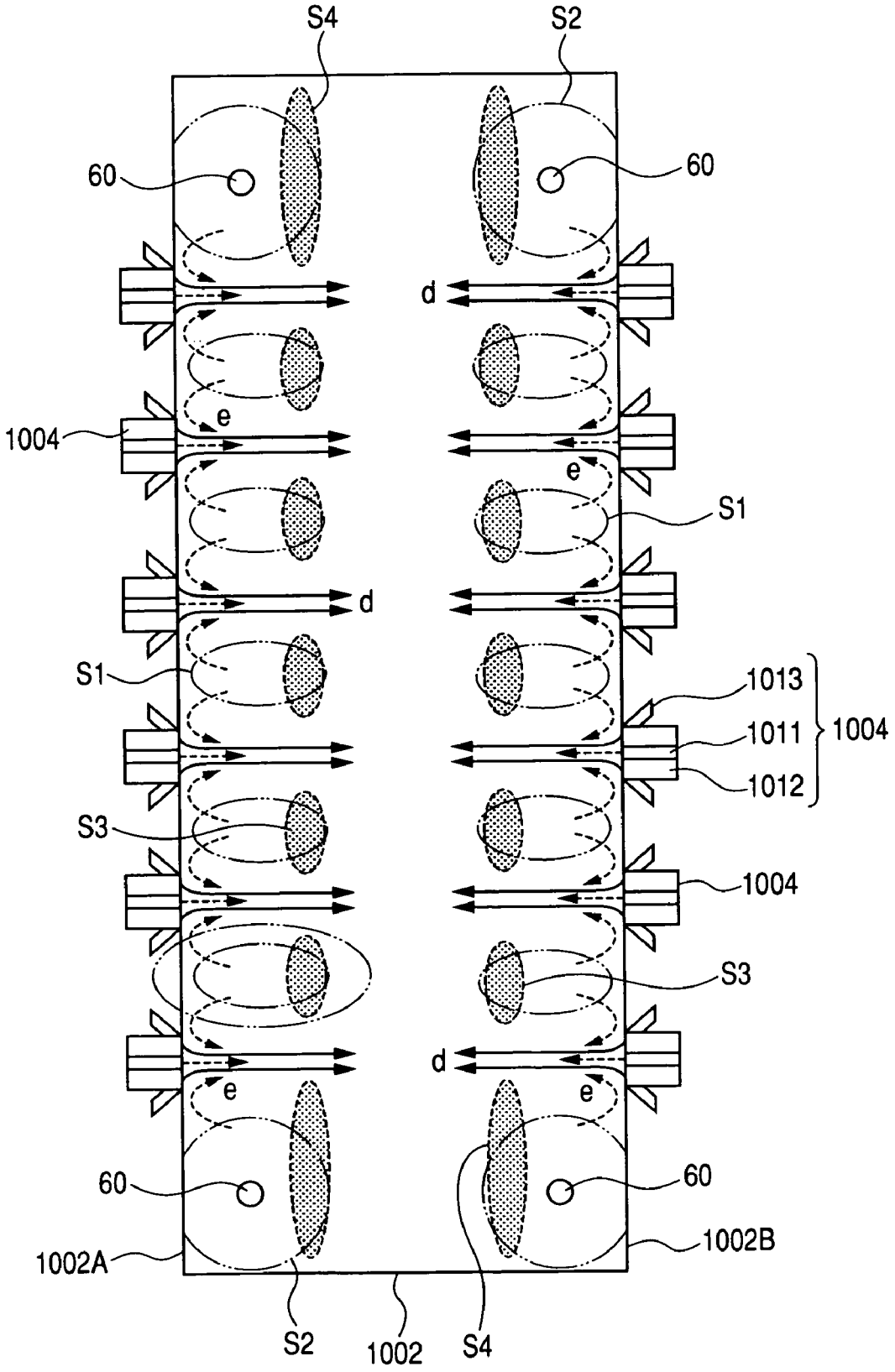
FIG. 36 is a cross sectional view taken along line A-A of FIG. 34.

Referring now to FIG. 36, this embodiment will be described more practically. FIG. 36 shows the arrangement of the after-air nozzles 1004 taken along line A-A of FIG. 34, wherein the incomplete gas from the combustion burners sometimes pass through a region S1 between the adjoining after-air nozzles 1004 or a region S2 at the end parts of the after-air nozzles 1004 arranged as shown by a double-dotted line. Then, the region S2 at the end parts of the after-air nozzles 1004 is larger than the region S1 between the adjoining after-air nozzles 1004.

The CO concentration measuring units 1006 are installed at regions S2 of four corners of the furnace 1002 just at the downstream side of the after-air nozzles 1004. When a high CO concentration is measured by the CO concentration measuring device 1006, the contraction flow air (c) from the contraction flow air nozzles 1013 is supplied and the combustion air (d) from the after-air nozzles 1004 is made as contraction flow. The contraction flow air (d) is injected to cause the sub-flow (e) accompanying with the contraction flow to be generated near the extremity of the after-air nozzles 1004. This air flow catches the incomplete combustion gas G1 passing through the regions S1, S2 into the air flow so as to cause them to be agitated and mixed to each other. So that the incomplete combustion gas G1 can be effectively burned, and production of CO can be restricted. In addition, in FIG. 2, it is desirable that the CO concentration measuring unit 1026 installed at the outlet port 1002C of the furnace and the NOx concentration measuring device 1025 are also arranged at four corners of the outlet port 102C of the furnace.

Figure 37:
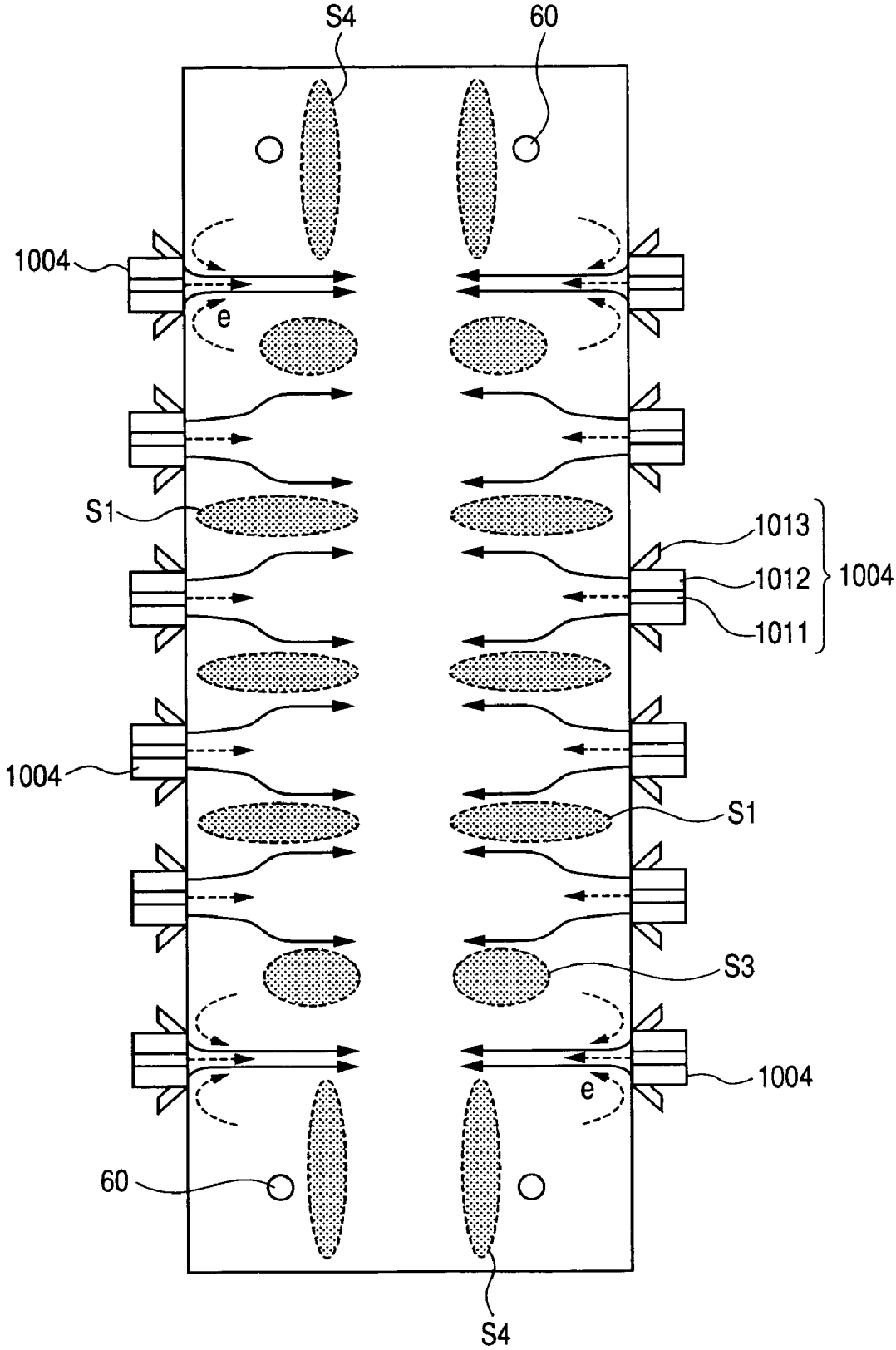
FIG. 37 is a cross sectional view for showing another example of an injected state of air in FIG. 36.

Since a distance between the arranged adjoining after-air nozzles 1004 is originally narrow and the region S1 is also narrow, it may be sufficient that CO produced only in the region S2 is restricted. In such a case as above, as shown in FIG. 37, the contraction flow combustion air (d) is injected only from end members of the arrangement of the after-air nozzles 4, and the swirling flow combustion air (d) is injected from the after-air nozzles other than the former. Thereby, the regions S4 at the four corners in the furnace 1002 can be reduced.

Figure 39:
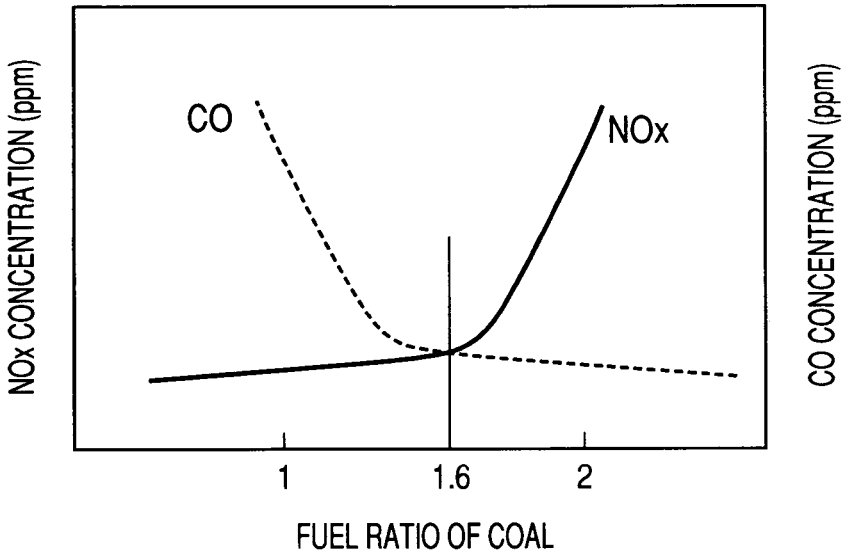
FIG. 39 is a diagram for showing a relation between NOx concentration and CO concentration varied in response to the type (fuel ratio) of pulverized coal.

FIG. 39 shows a relation between the NOx concentration and CO concentration varying in response to the type of pulverized coals. Coal having much amount of volatile substance, for example, lignite or sub-bituminous with a fuel ratio (fixed carbon/volatile substances) of 1.1 or less has a high CO concentration and a low NOx concentration. This is due to the fact that there are present much amount of volatile substances injected into gas at the initial stage of coal combustion and CO is easily produced at the time of combustion at the combustion burners 3. On the other hand, coal containing much amount of fixed carbon, for example, some bituminous or anthracite with a fuel ratio of 2 or more has a low CO concentration and a high NOx concentration. This is due to the fact that hot NOx is produced by increasing of combustion temperature under mixing with the combustion air (d) from the after-air nozzles 4 because a heat calorie is high.

Accordingly, when coal having a high CO concentration is applied as fuel, the contraction flow combustion air (d) is supplied from the after-air nozzles 1004, and when coal having a high hot NOx concentration is applied as fuel, it is necessary that the swirling flow combustion air (d) is supplied to cause each of the concentrations to be decreased. As apparent from FIG. 39, since NOx concentration and CO concentration are made low in reference to a fuel ratio of coal of 1.6, it is desired in the pulverized coal firing type boiler facility 1 that an instruction for changing over the combustion air (d) injected from the after-air nozzles 4 into the swirling flow and the contraction flow is stored in the control means 7 so as to judge it with the fuel ratio of coal of 1.6 being applied as a reference.

As described above, CO concentration and NOx concentration are opposing phenomena to each other, and even if CO concentration is restricted, NOx concentration is apt to increase. When CO concentration is high, at first, the air flow mode is changed over into swirling flow air (d) in sequence from the after-air nozzles 1004 positioned at the ends of the arrangement of the after-air nozzles in the combustion furnace 1002 toward the members at the center of the its arrangement. And it is desired to fix a ratio between the swirling flow and the contraction flow of the combustion air (d) when CO concentration and NOx concentration are decreased together. To the contrary, when NOx concentration is high, the flow mode is changed over from the contraction flow to the swirling flow in sequence from the center members in the arrangement of the after air nozzles toward the end members through its inverse operation. Thus, the CO concentration and NOx concentration can be reduced under a well-balanced state.

In FIGS. 36 and 37, since wide regions S2 for gas flow passing are present near the both ends of the arrangement of the after-air nozzles 1004, in other words, four corners of the combustion furnace 1002, it becomes important to reduce CO concentrations at four corners and it is important to supply preferentially the contraction flow combustion air (d) to these regions S2.

Figure 38:
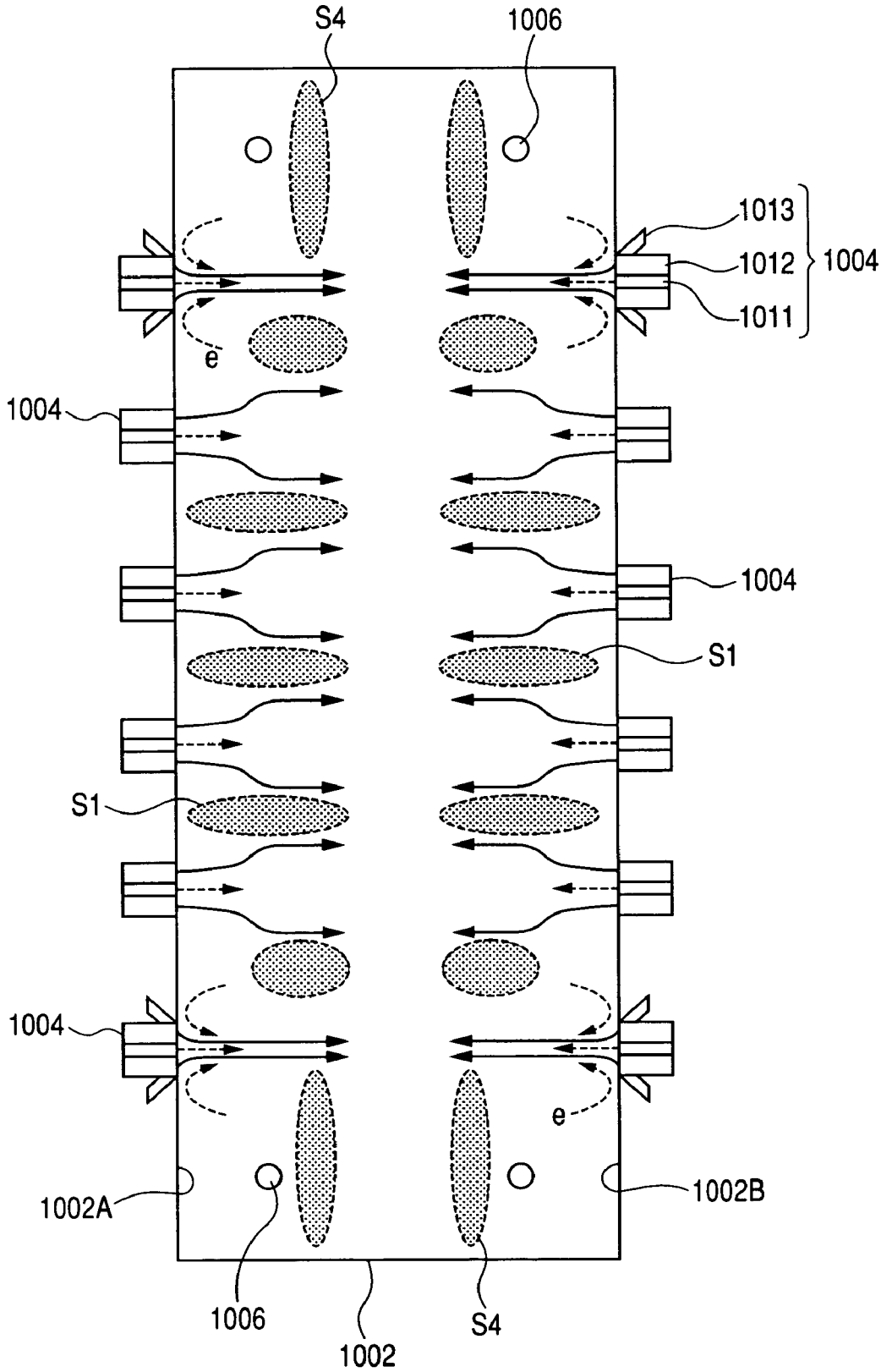
FIG. 38 is a cross sectional view for showing an after-air nozzle in which an existing boiler facility is improved to attain the boiler facility of this invention.

In view of the foregoing, it is possible to reduce CO concentration under the minimum modification work and modification cost by adding the contraction flow air nozzles 1013 only at the after-air nozzles 1004 near the four corners of the combustion furnace 1002 as shown in FIG. 38 in the already-existing boiler facility. The boiler facility also has straightforward air nozzles 1011 and swirling flow air nozzles 1012.

FIG. 39 shows a relation between NOx concentration and CO concentration varying in response to the type of pulverized coals. Coal having much amount of volatile substances, for example, lignite or sub-bituminous having a fuel ratio (fixed carbon/volatile substance) of 1.1 or less has a high CO concentration and a low NOx concentration. This is due to the fact that there are present much amount of volatile substances in the gas at the initial stage of coal combustion and CO is easily generated at the time of combustion at the combustion burners 1003. In turn, coal having much amount of fixed carbon, for example, some bituminous or anthracite with a fuel ratio of 2 or more has a low CO concentration or a high NOx concentration. This is due to the fact that there are present much amount of fixed carbon and hot NOx is generated through increased combustion temperature under mixing with the combustion air (d) from the after-air nozzles 4 due to a high heating calorie.

Accordingly, when coal having a high CO concentration is applied as fuel, the contraction flow-air (d) from the after-air nozzles 1004 is supplied. When coal having a high hot NOx concentration is applied as fuel, it is necessary to reduce each of the concentrations by supplying the swirling flow combustion air (d). As apparent from FIG. 39, both NOx concentration and CO concentration are decreased in reference to a fuel ratio of coal of 1.6. So it is desired in the pulverized coal firing type boiler facility 1001 that an instruction for changing-over the combustion air (d) injected from the after-air nozzles 1004 into the swirling flow and the contraction flow is stored in advance in the control means 1007 for judgment with the fuel ratio of coal of 1.6 being applied as a reference.

In addition, as shown in FIG. 39, NOx concentration and CO concentration are opposite phenomena. Even if CO concentration is restricted, NOx concentration is apt to increase. On this account, when CO concentration is high, it is desired that the swirling flow air (d) is changed over into the contraction flow air (d) in sequence from the end members of the arrangement of a plurality of after-air nozzles 1004 in a lateral direction at the wall surfaces 1002A, 1002B of the furnace 1004 toward the center members the nozzle arrangement. And then, when both CO concentration and NOx concentration are reduced, a ratio of the swirling flow combustion air (d) and the contraction flow combustion air (d) is fixed. On the other hand, when NOx concentration is high, its inverse operation is carried out to change over the contraction flow to the swirling flow in sequence from the center members of the after air nozzle-arrangement toward the end members to enable both NOx concentration and CO concentration to be reduced under a well-balanced state.

Figure 40:
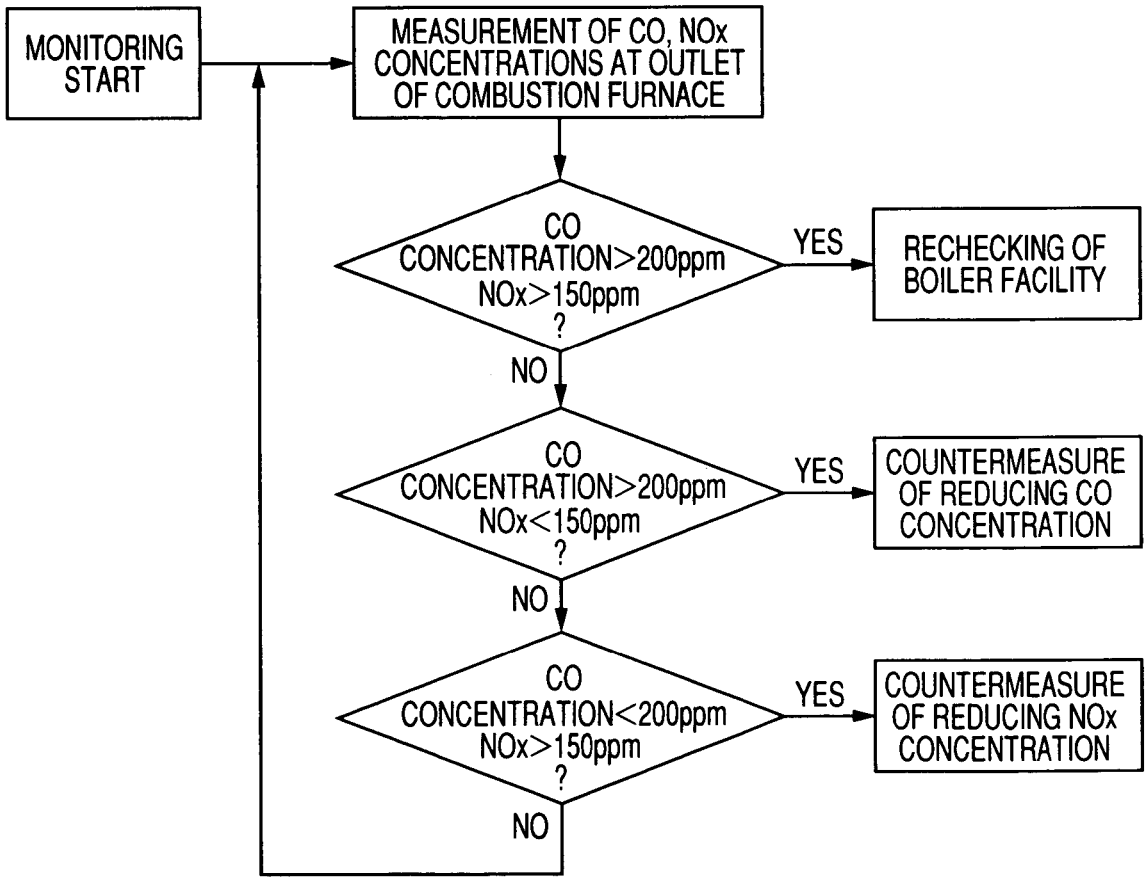
FIG. 40 is a flow chart for indicating a measurement of NOx concentration and CO concentration at the pulverized coal firing type boiler facility of this invention and a procedure for reduction countermeasure.

FIG. 40 shows a step for reducing both CO concentration and NOx concentration in accordance with the preferred embodiments of the present invention. In this flow chart, measurements of CO concentration and NOx concentration are carried out with a CO concentration measuring device 1026 and a NOx concentration measuring device 1025 arranged at the outlet 2C of the furnace. The measurements is performed, for example, under an assumption that an upper limit of CO concentration is 200 ppm and an upper limit of NOx concentration is 150 ppm.

As an operation of the pulverized coal firing type boiler facility 1001 is started, its monitoring is started and then CO concentration and NOx concentration at the outlet 2C of the combustion furnace are measured. As a result of the measurement, although not found in the usual operation, when both CO concentration and NOx concentration exceed the upper limit values, the operation is stopped because mere adjustment of the after-air nozzles 1004 is hard for reduction of both concentrations. And it is necessary to recheck the entire specification of the pulverized coal firing type boiler facility 1001. Then, when CO concentration exceeds the upper limit value and NOx concentration is less than the upper limit value, the operation is advanced to the stage of CO concentration reducing countermeasure. On the other hand, when CO concentration is less than the upper limit value and NOx concentration exceeds the upper limit value, the operation is advanced to the stage of NOx concentration reducing countermeasure. Then, when both CO concentration and NOx concentration are less than the upper limit value, the operation returns back to the starting of monitoring operation and a measurement of both CO concentration and NOx concentration is continued.

Figure 41:
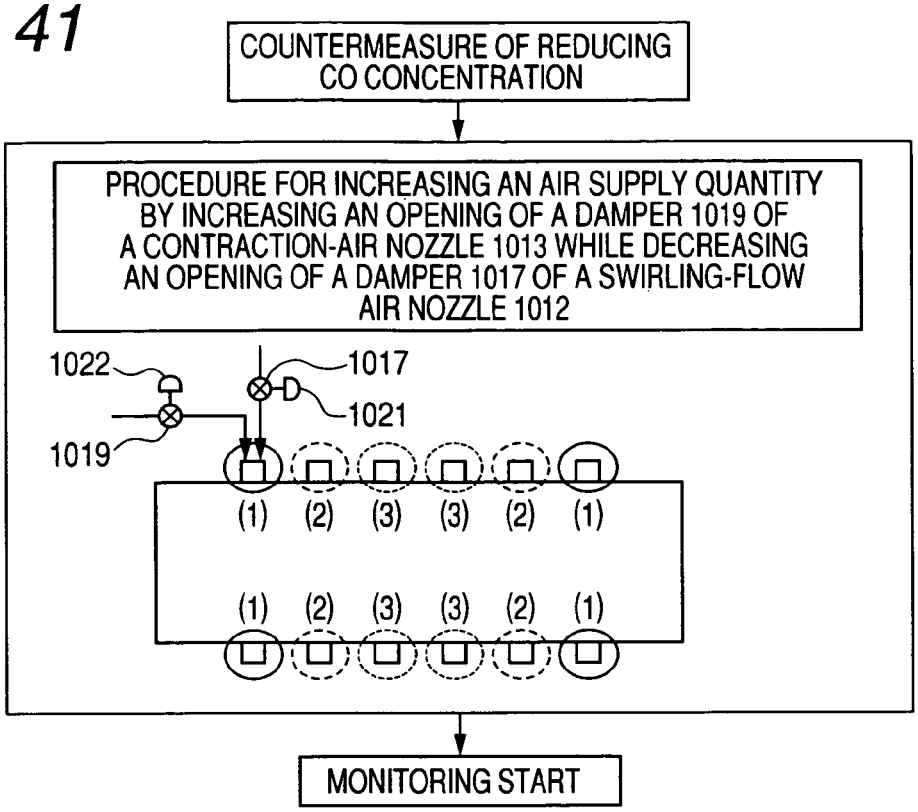
FIG. 41 is an illustrative view for showing a procedure for reducing CO concentration through the flow shown in FIG. 40.

The countermeasure against reduction in CO concentration is carried out, as shown in FIG. 41, such that the valve 1017 for the swirling flow air nozzle 1012 is controlled by the electromagnetic driving deveice 1021 and the valve 1019 for the contraction flow air nozzle 1013 is opened by the electromagnet driving device 1022. Reducing amount of the air supplying amount from the swirling flow air nozzle 1012 becomes an increasing amount of the air supplying amount from the contraction flow air nozzle 1013 and the total air supplying amount from the after-air nozzles 1004 is kept constant.

At the step (1), the contraction flow air supply amount is increased for the both end members in the arrangement of the after-air nozzles 1004, the operation is returned back to the monitoring start shown in FIG. 40 under this state so as to measure CO concentration and NOx concentration. When CO concentration still exceeds the upper limit value and NOx concentration is less than the upper limit value, the operation goes to the step (2), a contraction flow air supplying amount from the after-air nozzle 1004 second from the end in the arrangement, is increased. In this way, the contraction flow air supplying amount is increased in sequence of from the after-air nozzle 1004 of the end members toward the center members is increased. When CO concentration and NOx concentration are less than the upper limit value, the swirling flow air supplying amount and the contraction flow air supplying amount are fixed.

Figure 42:
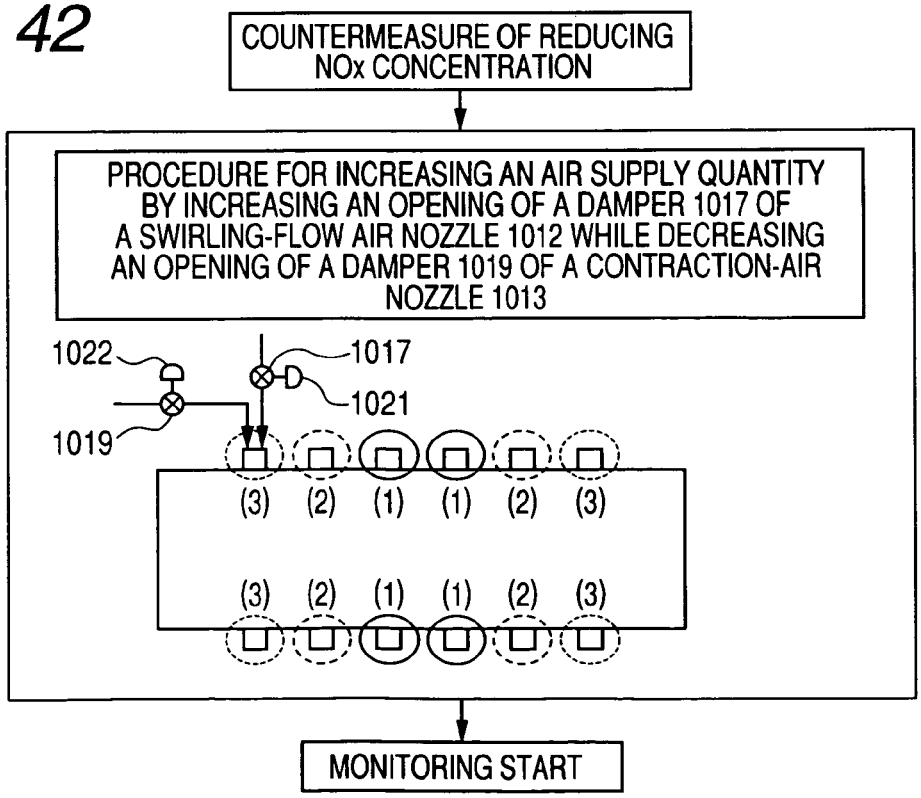
FIG. 42 is an illustrative view for showing a procedure for reduction against NOx concentration through a flow shown in FIG. 40.

As shown in FIG. 42, the countermeasure against reduction in NOx concentration is carried out so that the valve 1017 for the swirling flow air nozzle 1012 is opened by the electromagnetic driving device 1021, and the valve 1019 for the contraction flow air nozzle 1013 is controlled by the electromagnetic driving device 1022. The increased air supplying amount from the swirling flow air nozzle 1012 becomes a reduced value of the air supplying amount from the contraction flow air nozzle 1013, and the total air supplying amount from the after-air nozzles 1004 is kept constant.

At the step (1), the swirling flow air supplying amount is increased for the after-air nozzles 1004 (center members) positioned at the center portion in the arrangement of the after-air nozzles 1004, the operation is returned back to the monitoring start shown in FIG. 40 under this state so as to measure CO concentration and NOx concentration. When NOx concentration still exceeds the upper limit value and CO concentration is less than the upper limit value, the operation goes to the step (2), a swirling flow air supplying amount from the after-air nozzle 1004 second from the center members the arrangement is increased. In this way, the swirling flow air supplying amount is increased in sequence of from the the center members toward the end members in the arrangement of the after-air nozzles. When CO concentration and NOx concentration are less than the upper limit value, the swirling flow air supplying amount and the contraction flow air supplying amount are fixed.

As described above, in accordance with the preferred embodiments of this invention, it is possible to attain the pulverized coal firing type boiler facility capable of reducing NOx concentration and CO concentration under a well-balanced state by measuring CO concentration and NOx concentration and based on the measurement result, controlling the air supplying amount from the swirling flow and contraction flow.

It is of course apparent to say that the boiler facility of this invention is not specified to the pulverized coal firing type boiler facility, but it may be applied to a boiler facility using fuel producing CO and NOX.

Further, in accordance with the preferred embodiments described above, although the section of the combustion furnace 1002 is a rectangular section and each of the opposing wall surfaces 1002A, 1002B is provided with combustion burners 1003 and the after-air nozzles 1004, they can be applied to the combustion furnace whose section is of either a circular shape or an ellipse shape or a corner having the rectangular section is made to be a curved surface. In addition, although the combustion furnace 1002 is installed in a vertical direction, this invention may also be applied to the furnace installed in a lateral direction.

Preferred Embodiment 4-1

Referring now to FIGS. 43 to 45 and FIG. 33, a preferred embodiment of the boiler facility of this invention will be described in reference to the pulverized coal firing type boiler facility.

Figure 43:
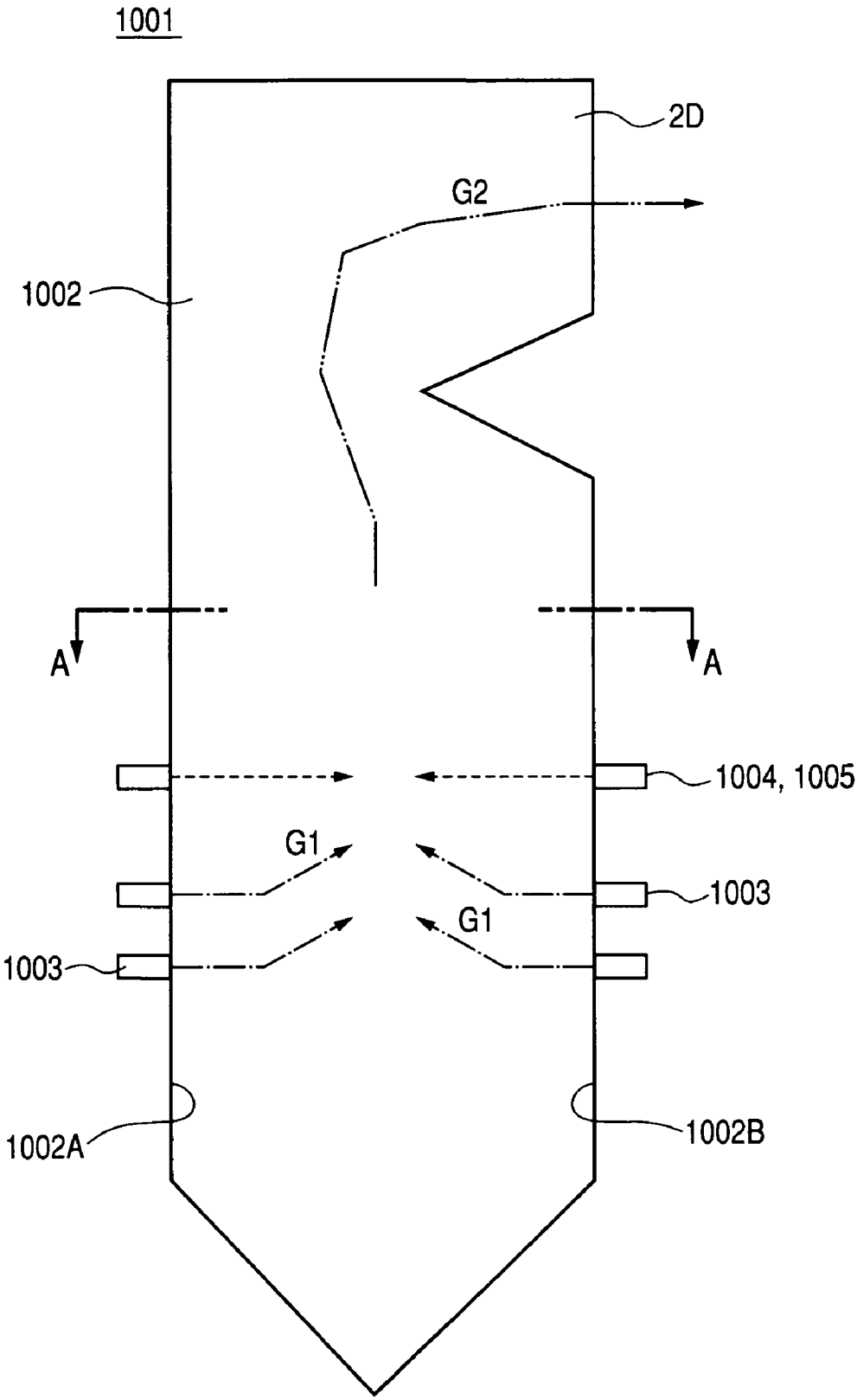
FIG. 43 is a schematic side elevational view for showing a combustion furnace of a pulverized coal firing type boiler facility to illustrate one preferred embodiment of the boiler facility of this invention.

The pulverized coal firing type boiler facility 1001 shown in FIG. 43 comprises a combustion furnace 1002 installed in a vertical direction and having a rectangular section, a plurality of combustion burners 1003 arranged side-by-side in a lateral direction crossing at a right angle with a vertical direction in a plurality of stages in the vertical direction at each of the opposing wall surfaces 1002A, 1002B of rectangular section of the combustion furnace 1002, and a plurality of after-air nozzles 1004, 1005 arranged side-by-side in a lateral direction crossing at a right angle with a vertical direction (a combustion gas flowing-out direction) of the opposing wall surfaces 2A, 2B at the downstream side of the combustion gas from these combustion burners 1003.

The combustion furnace 1002 is provided with a steam producing device (not shown) acting as a heat exchanging means (not shown) for heat exchanging with the combustion gas, the steam produced by the steam generating device is supplied to a steam turbine not shown, for example, to perform a rotational driving operation.

The fuel burner 1003 is used for injecting pulverized coal and air to burn them, enclosed by a common ventilating box 1010 shown in FIG. 33 together with after-air nozzles 1004, 1005 and positioned at the outer wall of the combustion furnace 1002.

Although not shown, the after-air nozzle 1004 has the same structure as one in which the contraction flow air nozzle is eliminated at the after-air nozzle 1005 described later. This after-air nozzle 1004 comprises a straight-forward air nozzle arranged at the center part to inject straight-forward air into the combustion furnace 1002 and a swirling flow air nozzle arranged concentrically around the outer circumference of the straight-forward air nozzle to inject the swirling flow air into the combustion furnace 1002.

The after-air nozzles 1005 are installed adjacent to the ends of a plurality of after-air nozzles 1004 arranged side-by-side and their details are the same as those shown in FIG. 33.

The air supplied into the ventilating box 1010 is distributed into an amount of air consumed at the combustion burner 1003 and an amount of air consumed at the after-air nozzles 1004, 1005. The air taken into the after-air nozzles 1004, 1005 is distributed by the valves 1015, 1017, 1019 to an amount of air consumed at the straight forward air nozzle 1011, the swirling flow air nozzle 1012 and the contraction flow air nozzles 1013. That is, when the valves 1015, 1017 are opened and the valve 1019 is closed, air can be supplied to the straight forwarding air nozzle 1011 and the swirling flow air nozzle 1012 only and the combustion air injected from the after-air nozzles becomes a swirling flow. In addition, when the valves 1015, 1017 are closed and the valve 1019 is opened, air is supplied only to the contraction flow air nozzle 1013, so that the combustion air becomes the contraction flow. The contraction flow air nozzle 1013 is inclined to inject air toward the center with respect to the air injecting direction of the straight-forward air nozzle 1011 and the air is adjusted by the outlet and becomes the contraction flow injected. This contraction flow injected generates the sub-flow (d) for encasing the surrounding combustion gas near the injection port different from either the swirling flow or the straight-forward flow and there by mixing of the combustion air with the combustion gas can be promoted.

As described above, a plurality of combustion burners 1003 and a plurality of after-air nozzles 1004 are arranged side-by-side in a lateral direction at the opposing wall surfaces 1002A, 1002B of rectangular section. Under such an arrangement as above, in particular, the incomplete combustion gas G1 from the combustion burners 1003 ascends through the relative large space between the ends of the after-air nozzles 1004 arranged side-by-side and the sidewall 2C. Due to this fact, the region S1 for the incomplete combustion gas G1 of low combustion temperature is present as indicated by a two-dotted line, the gas is not sufficiently mixed with the swirling flow combustion air from the after-air nozzles 1004 and the gas reaches the outlet port 2D of the combustion furnace while keeping a concentration of the generated CO.

Figure 44:
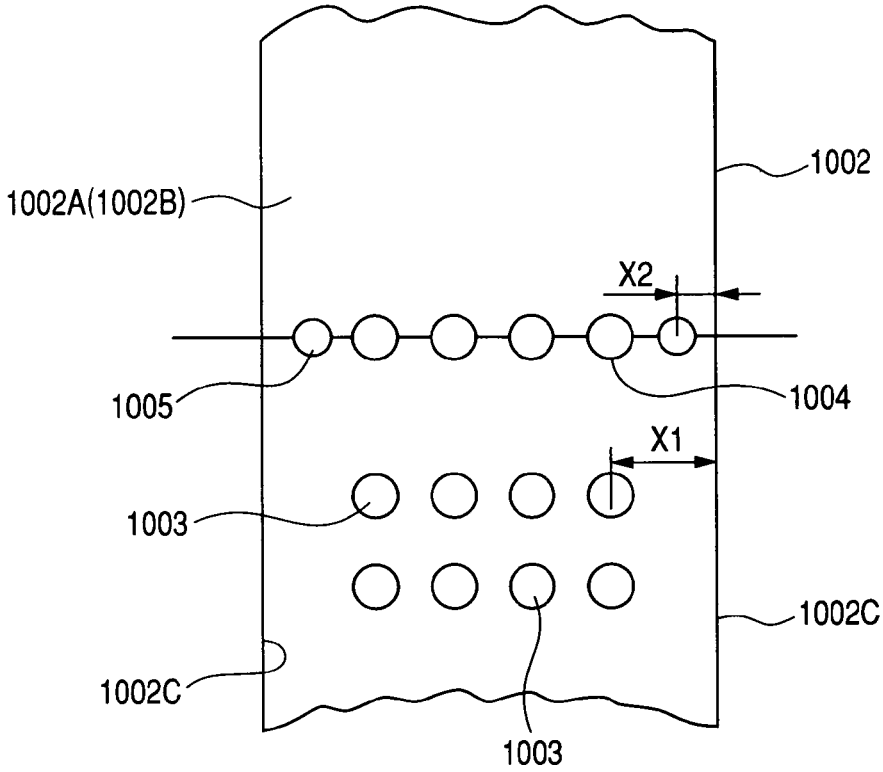
FIG. 44 is an enlarged front elevational view for showing an arrangement of the combustion burners and the after-air nozzles shown in FIG. 43.
Figure 45:
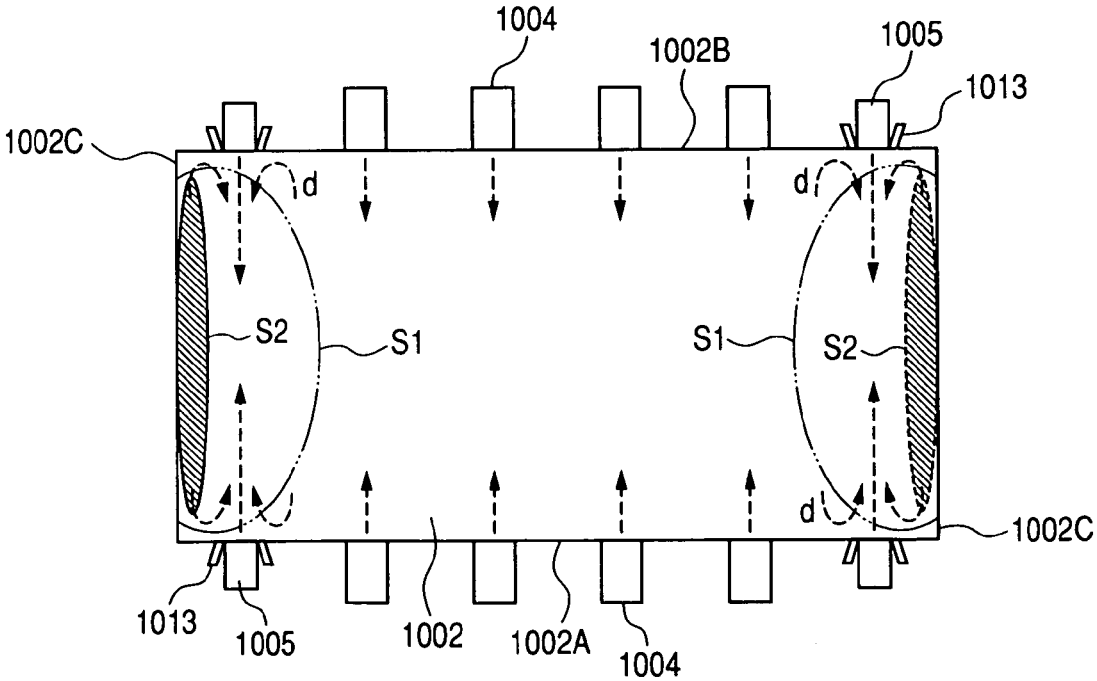
FIG. 45 is an enlarged top plan view in cross section taken along line A-A of FIG. 43.

In order to reduce the flowing region S1 for the incomplete combustion gas G1 passing through it and to restrict production of CO while making a complete combustion of the incomplete combustion gas G1 as much as possible, the after-air nozzles 1005 having the contraction flow air nozzle 1013 are arranged at the end portions in arrangement of the after-air nozzles 1004. In addition, as shown in FIG. 44, a size (distance) ×2 ranging from the center of the after-air nozzle 1005 to the side wall 2C adjacent to opposing wall surfaces 1002A, 1002B is made smaller (shorter) than a size (distance) ×1 ranging from the center of the most adjacent burner 3 in the side wall 2C to the side wall 2C.

The after-air nozzles 1005 are arranged in this way to cause the contraction flow air (c) from the contraction flow air nozzles 1013 to be injected, thereby the sub-flow (d) accompanying with the contraction flow is generated. The incomplete combustion gas G1 passing through the region S1 is caught into this sub-flow (d), agitated and mixed to each other, so that the region of the passing incomplete combustion gas G1 can be reduced as S2. As a result, the incomplete combustion gas G1 can be burned effectively, CO can be generated and unburned fuel can be reduced.

Figure 46:
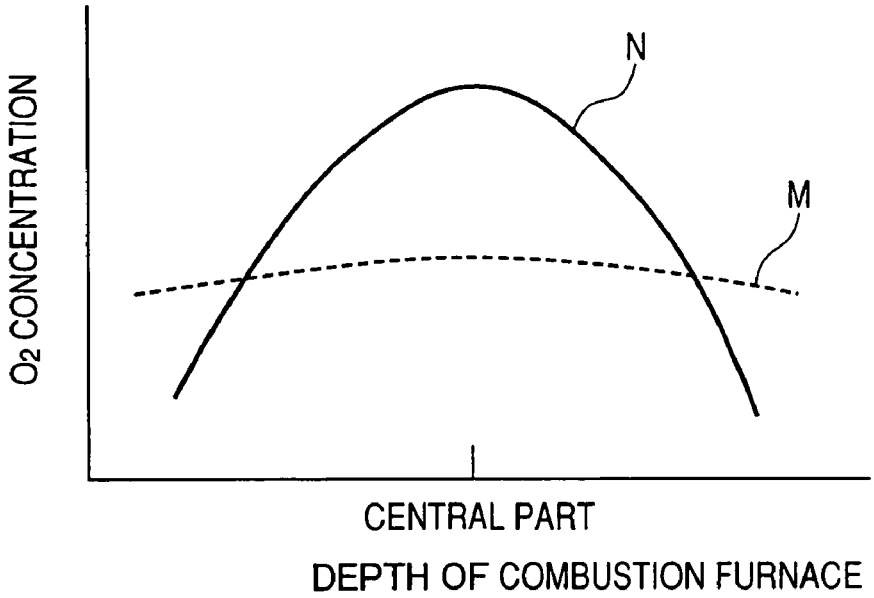
FIG. 46 is a view for showing a distribution of oxygen concentration in the combustion furnace.

FIG. 46 indicates distributions of concentration of oxygen ($O_2$) in the combustion gas when the combustion air is supplied only from the contraction flow air nozzles 1013 and when the combustion air is supplied from the straight-forward air nozzles 1011 and the swirling flow air nozzles 1012. If the concentration of oxygen is flat as indicated by a dotted line, it means that the combustion air fed into the combustion furnace is uniformly distributed and that the air is sufficiently mixed with the incomplete combustion gas to perform a complete combustion and either CO or unburned fuel can be eliminated. A dotted line M in this figure indicates a contraction flow combustion air and a solid line N indicates a distribution of oxygen in the combustion air having a swirling flow as its major one. As apparent from this figure, mixing of the contraction flow combustion air with the incomplete combustion gas is carried out more sufficiently than that with the combustion air mainly having the swirling flow and it is apparent that the incomplete combustion gas can be burned uniformly within the combustion furnace in a short period of time.

Preferred Embodiment 4-2

Figure 47:
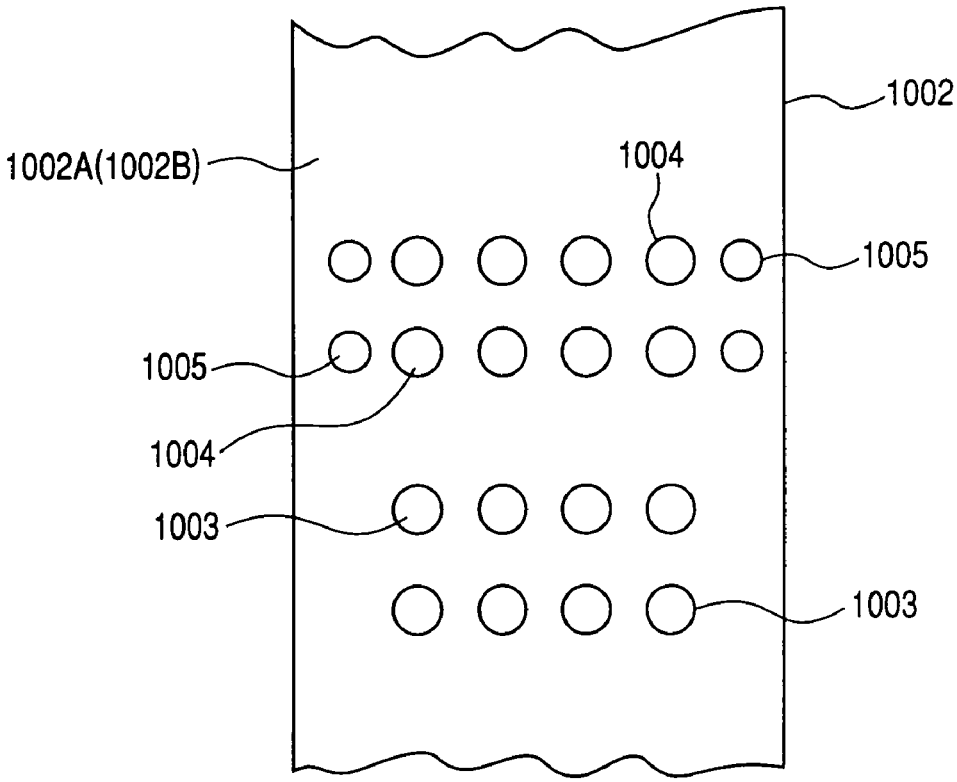
FIG. 47 is a view corresponding to a first modification of FIG. 43.

FIG. 47 shows a preferred embodiment 4-2 of the first modification of the preferred embodiment 4-1 wherein the after-air nozzles 1004, 1005 are arranged in double-stage.

Such an arrangement of double-stage enables the same effects as that of the preferred embodiments described above and concurrently an air supplying amount per one of the after-air nozzles 1004, 1005 is reduced, so that it has some effects that the combustion air can be loosely supplied and production of hot NOx can be reduced. The after-air nozzles 1004, 1005 can be arranged in more than three stages.

Thus, a supplying of the contraction flow combustion air promotes its mixing with the incomplete combustion gas GI. However, when a mixing with the combustion air is promoted and the combustion temperature is increased, increasing of hot NOx can be considered.

Figure 48:
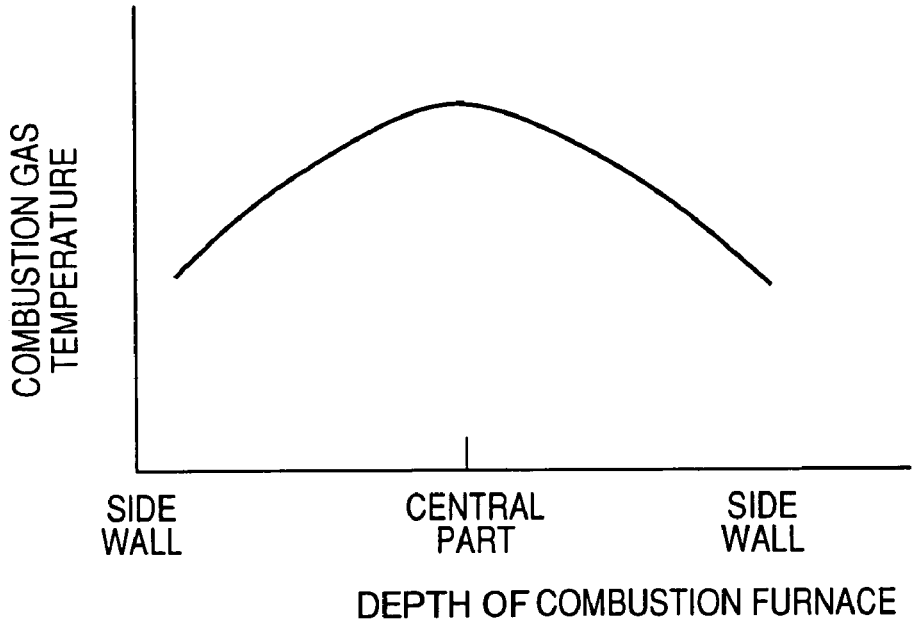
FIG. 48 is a view for showing a distribution of combustion gas temperature in the combustion furnace.

FIG. 48 indicates a distribution of temperature of the combustion gas in the combustion furnace. Since the water pipes are arranged at the wall surfaces or side walls 1002C in the combustion furnace to remove heat of the combustion gas, so that the temperature at the side walls 1002C is low as compared with that of the central part. As shown in FIG. 47, since a rapid mixing with the low temperature combustion gas can be carried out with the contraction flow at the after-air nozzles 1005 arranged at the end portions, occurrence of the hot NOx can also be restricted together with restriction of CO. In turn, at the central part in the combustion passage where a combustion gas temperature is high, occurrence of hot NOx can be restricted through a gradual mixing of the combustion gas with the gradual swirling flow combustion air.

In the preferred embodiment, for the existing boiler facility having the after-air nozzles 1004 with the swirling flow air nozzles, it is possible to attain the requisite pulverized coal firing type boiler facility 1001 in an easy manner by replacing only the after-air nozzles 1004 of the end portions near the side walls 2C with the newly installed after-air nozzles 1005 or by newly installing the contraction flow air nozzles 1013 at the existing after-air nozzles 1004.

Preferred Embodiment 4-3

Figure 49:
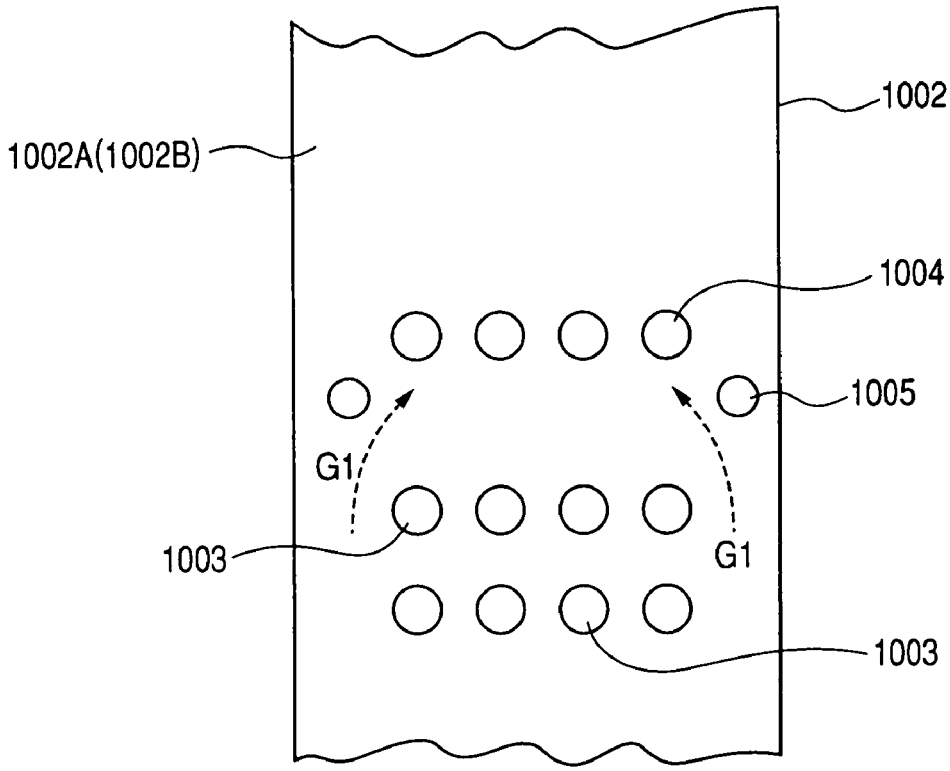
FIG. 49 is a view corresponding to FIG. 44 for showing a second modification of FIG. 43.

FIG. 49 shows the preferred embodiment 4-3 to be the second modified form of the embodiment 4-1, wherein the after-air nozzles 1005 having the contraction flow air nozzles are arranged at the upstream side of the after-air nozzles 1004 having another swirling flow air nozzle and at the downstream side of the combustion burners 1003.

Such an arrangement as above causes a rapid mixing with the incomplete combustion gas G1 from the combustion burner prior to the combustion air from the after-air nozzles 1004 having the swirling flow air nozzles and thereafter a gradual mixing with the combustion air from the after-air nozzles 1004. So a reduction in concentration of NOx as well as a reduction of CO concentration or unburned fuel can be attained. In addition, supplying of the contraction flow combustion air is performed at the upstream side from the after-air nozzles 1005 having the contraction flow air nozzles. It enables the incomplete combustion gas G1 passing through the side walls 1002C of the combustion furnace 1002 to be guided to the central part as indicated by a dotted arrow line. Therefore, it has an advantage that the combustion gas temperature can be unified.

Preferred Embodiment 4-4

Figure 50:
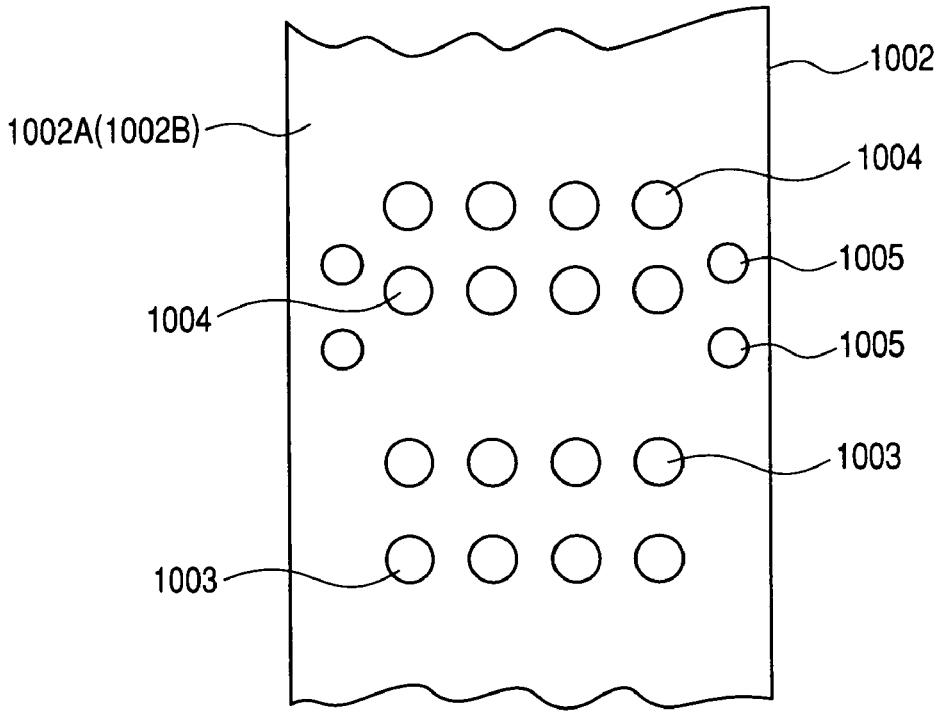
FIG. 50 is a view corresponding to FIG. 49 for showing a third modification of FIG. 43.

FIG. 50 shows a third modification where the after-air nozzles 1004, 1005 are arranged in two-stages and basically this modification is the same as the preferred embodiment 4-3 shown in FIG. 49. Then, arrangement of two-stages causes an air supplying amount per one of the after-air nozzles 1004, 1005 to be reduced in the same manner as that of the preferred embodiment 4-2, so that it has some advantages that the combustion air can be supplied more gradually and production of hot NOx can be reduced more.

Preferred Embodiment 4-5

Figure 51:
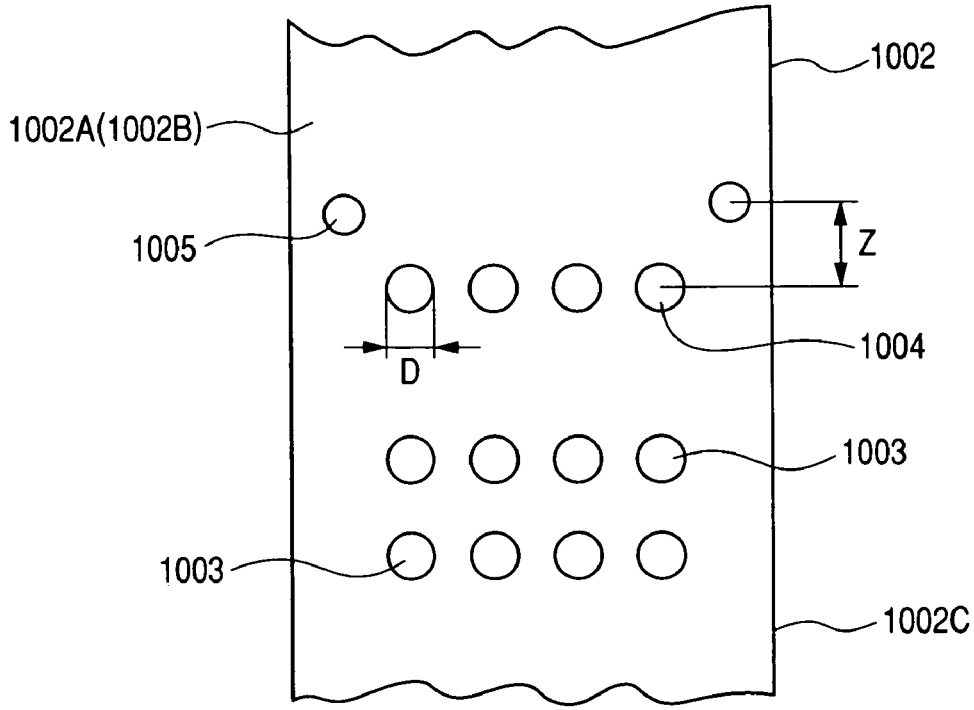
FIG. 51 is a view corresponding to FIG. 49 for showing a fourth modification of FIG. 43.

FIG. 51 shows a preferred embodiment 4-5 of a modification of the fourth preferred embodiment 4-1, wherein the after-air nozzles 1005 having the contraction flow air nozzles are arranged at the downstream side of the after-air nozzles 1004 having another swirling flow air nozzle.

Such an arrangement as above enables the contraction flow combustion air to be supplied in the region near the side walls 2C at the downstream side where the combustion gas temperature is further decreased, so that the production of the hot NOx can be restricted more.

Figure 52:
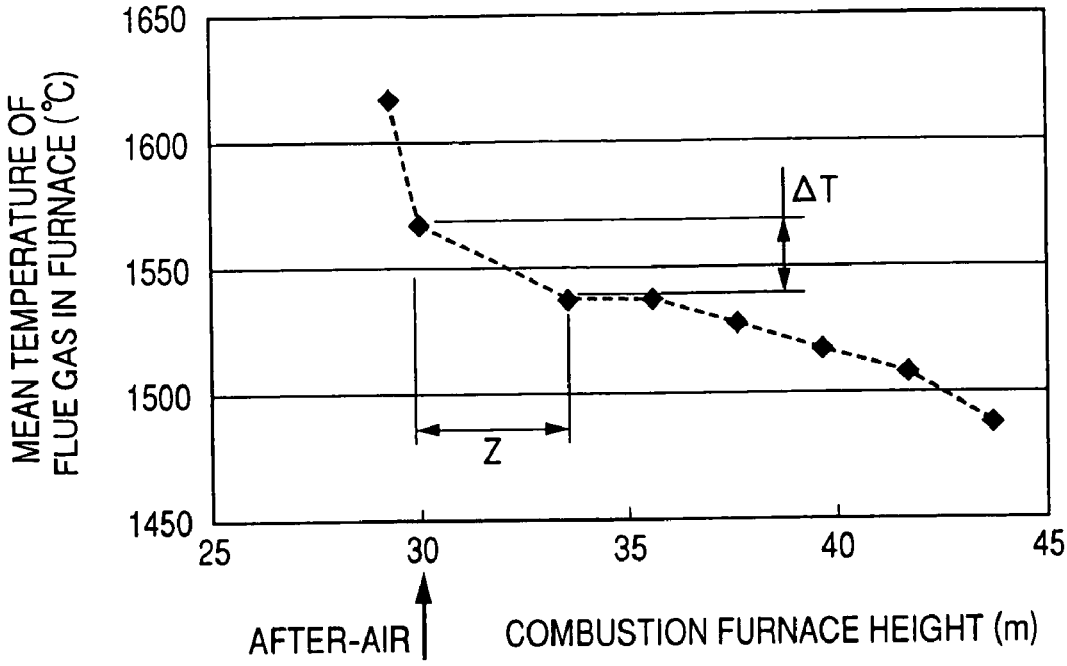
FIG. 52 is a view for showing a distribution of a combustion furnace height and a combustion gas temperature.

In FIG. 52 are indicated the results of measurement of the height of the combustion furnace in the pulverized coal firing type boiler facility and the mean temperature distribution of the combustion gas temperature. The combustion gas temperature more than 1600 is decreased through supplying of combustion air of low temperature (about 150 celsius) from the after-air nozzles placed at a height of 30 m, and after mixing of the combustion air, heat is gradually decreased by the water pipes arranged at the side walls 2C as it goes to the downstream side. In other words, as the height position of the combustion furnace 1002 is set to be high, so that the combustion temperature is gradually decreased. Thus, since the hot NOx is generated under a state in which the combustion temperature is 1500 celsius or more, it is satisfactory for the production of hot NOx to be restricted under a combustion at a temperature of 1500 celsius or less. However, the height of the combustion furnace with a combustion temperature under 1500 celsius becomes 40 m or more and this height is not practical value and so it is necessary to supply the combustion air under a height of the combustion furnace where it becomes a certain low combustion temperature of $\Delta T$, for example, a height of 30 m and to restrict occurrence of hot NOx. When a calculation was performed under a lower combustion temperature by 30 celsius than the combustion temperature at the present after-air nozzles in such a way that it might appear as a meaningful temperature difference for hot NOx, a displacement distance Z where the after-air nozzles 1005 became about 3 m to the downstream side from the after-air nozzles 1004. This calculation in the arrangement shown in FIG. 51 is carried out under a condition in which a radius D of the after-air nozzles 1004 is 1 m and the displacement distance Z corresponds to three times the radius D. Accordingly, it is satisfactory under the condition described above that the after-air nozzles 1005 are mounted at a position spaced apart from the mounting position of the after-air nozzles 1004 to the downstream side by more than three times of the radius D of the after-air nozzles 1004.

Preferred Embodiment 4-6

Figure 53:
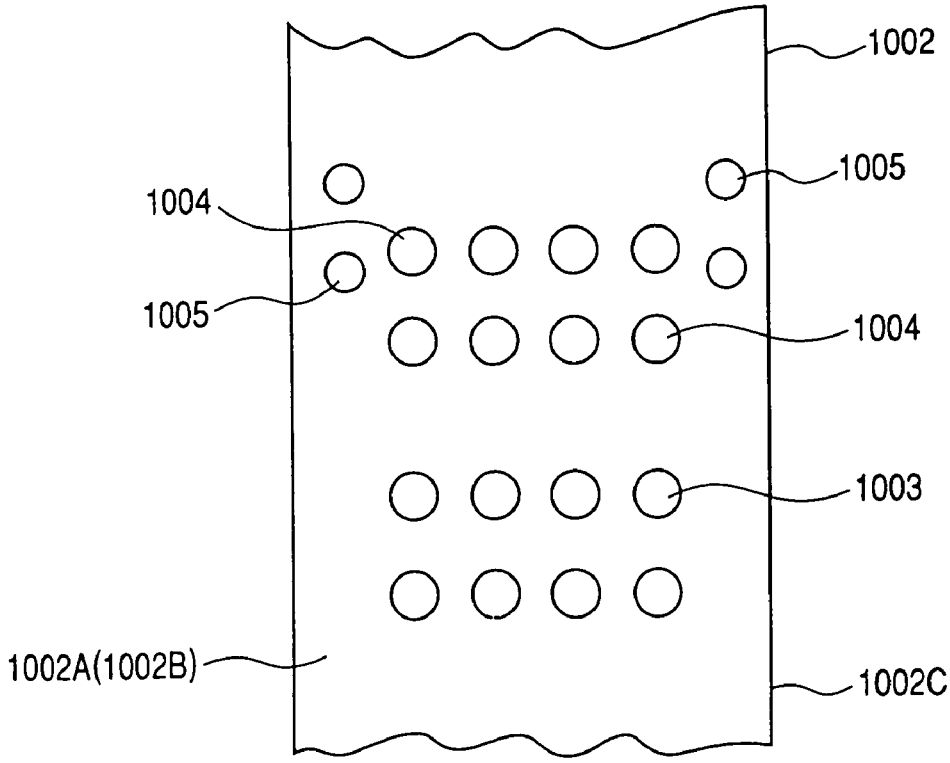
FIG. 53 is a view corresponding to FIG. 51 for showing a fifth modification of FIG. 43.

FIG. 53 shows a preferred embodiment 4-6 of a modification of the fifth preferred embodiment, wherein the arrangement of the after-air nozzles 1004, 1005 shown in FIG. 51 are installed in two-stages.

Such an arrangement as above enables the contraction flow combustion air to be supplied to a region near the side walls 2C at the downstream side where the combustion gas temperature is lowered in the same manner as that of the preferred embodiment 4-5 shown in FIG. 51, so that occurrence of hot NOx can be restricted more. At the same time, an air supplying amount per one of the after-air nozzles 1004, 1005 is reduced in the same manner as that of the preferred embodiment 4-2 shown in FIG. 47, so that it has some effects that the combustion air can be supplied more gradually and production of hot NOx can be reduced more.

As described above, in accordance with the preferred embodiment, it is possible to perform an efficient reduction of production of CO or reduction of unburned fuel through supplying of the contraction flow combustion air where oxygen concentration within the combustion furnace can be rapidly unified into CO region of high concentration. The rapid mixing of incomplete combustion gas with the contraction flow combustion air in a region where the combustion temperature is low also enables the production of hot NOx to be simultaneously restricted. So that it is possible to attain the pulverized coal firing type boiler facility capable of restricting CO concentration and NOx concentration under a well-balanced state.

Thus, although the present invention has been described as one example in reference to the pulverized coal firing type boiler facility using coal (pulverized coal) as fuel, the present invention can also be applied to a boiler facility where another fuel, petroleum, for example, is burned.

Preferred Embodiment 5-1

Figure 54:
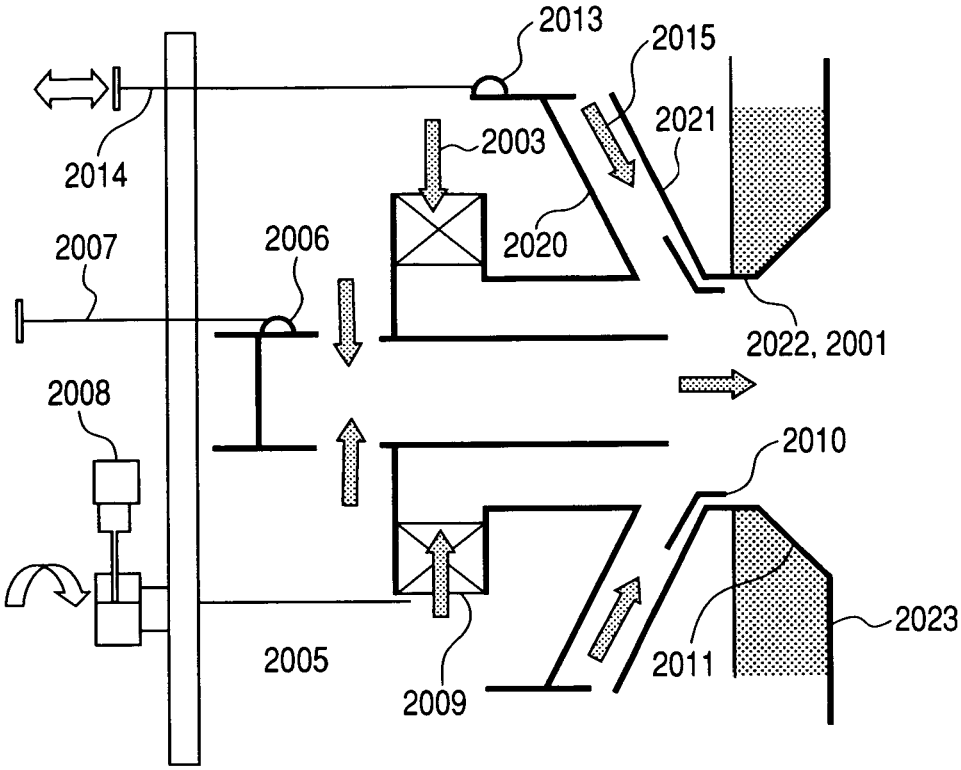
FIG. 54 is a sectional view for showing a structure of the overfiring air port in the preferred embodiment 5-1.

FIG. 54 is a sectional view for showing the overfiring air ports from the section including its center line.

The overfiring air ports (FIG. 54) in this preferred embodiment are substantially the same as the structure in FIG. 26 in the preferred embodiment 2-2. Due to this fact, a description of the same portions will be eliminated.

In FIG. 54, the third nozzle is constituted by a conical front wall 2021 and a conical rear wall 2020. Third air 2015 injected from the third nozzle is merged with the secondary air 2003 near the outlet where the secondary air 2003 is injected into the furnace 2001. In addition, the inner wall 2023 acting as a wall surface facing against inside the furnace 2001 and a throat 2022 are connected by a conical chamfered slant part 2011. Then, the front wall 2021 of the third nozzle and the throat 2022 are also connected. Further, the furnace walls are constituted by the inner wall 2023 and the outer wall 2024 acting as wall surfaces facing against inside the furnace 2001. Accordingly, air merged with the third air 2015 near the outlet for the secondary air 2003 injected into the furnace 2001 passes through the throat 2022 and is injected. In this preferred embodiment, the overfiring air port is characterized in that a louver 2010 is mounted from the outlet (downstream side) of the front wall 2021 of the third nozzle along the throat 2022. That is, a part of the third air 2015 injected from the third nozzle flows at the outlet of the third nozzle and along the wall surface of the front wall 2021 and subsequently it flows along the inner wall surface of the throat 2022. With this structure, it is possible to attain an effect that a part of the third air 2015 seals against the wall surface of the throat 2022 and then adhesion of combustion ash accompanying with the contraction flow can be made minimum.

In this case, a nozzle structure of the overfiring air port and a state of mixing with the combustion air in the furnace will be described. A feature of the overfiring air port of this preferred embodiment consists in an effective mixing of the unburned gas near the overfiring air port, i.e. near the boiler water wall. Although a flow velocity at the overfiring air port is increased and mixing can be performed by accompanying the gas in the furnace, NOx is increased under an increased flow velocity and a power for increasing the flow velocity must be increased. Accordingly, it becomes necessary to attain the mixing effect under the low flow velocity.

Figure 58:
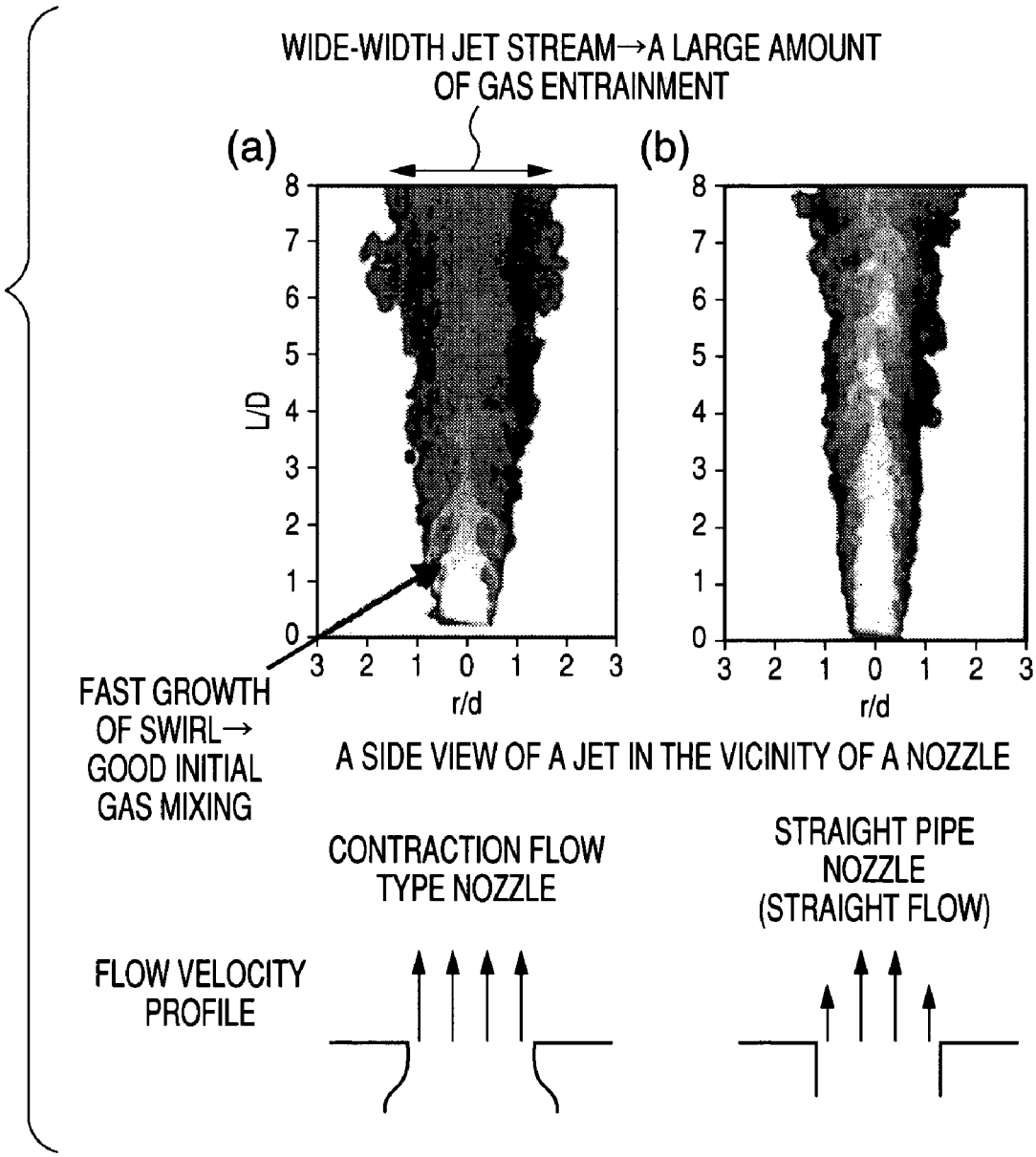
FIG. 58 is a diagram for comparing mixing effect between a straight forward type nozzle and a contraction flow type nozzle.

In FIG. 58 is indicated a mixing effect with the combustion gas in the furnace by the nozzle structure in its comparison. FIG. 58 shows an example of comparison between a contraction flow type nozzle and a straight-pipe type nozzle. It is apparent in the contraction flow type that a flow velocity distribution at the outlet port is flat and a sufficient disturbance flow is not grown. Since the straight-pipe type has a long pipe, its flow velocity distribution becomes a normal distribution under an influence of the wall. For the accompanying of the surrounding gas, the contraction flow type nozzle having a flat flow velocity distribution is superior. In this preferred embodiment, this characteristic is reflected against the overfiring air port structure, a flow passage sectional area at the outlet port is rapidly adjusted against the flow of primary air to attain a flat flow velocity distribution. Provided that since the contraction flow structure shows a substantial disturbance around the injected flow, the surrounding combustion gas may easily be accompanied and the ash contained in the combustion gas is also accompanied. Due to this fact, adhesion of ash at the overfiring air port outlet port part must be restricted.

Figure 59A:
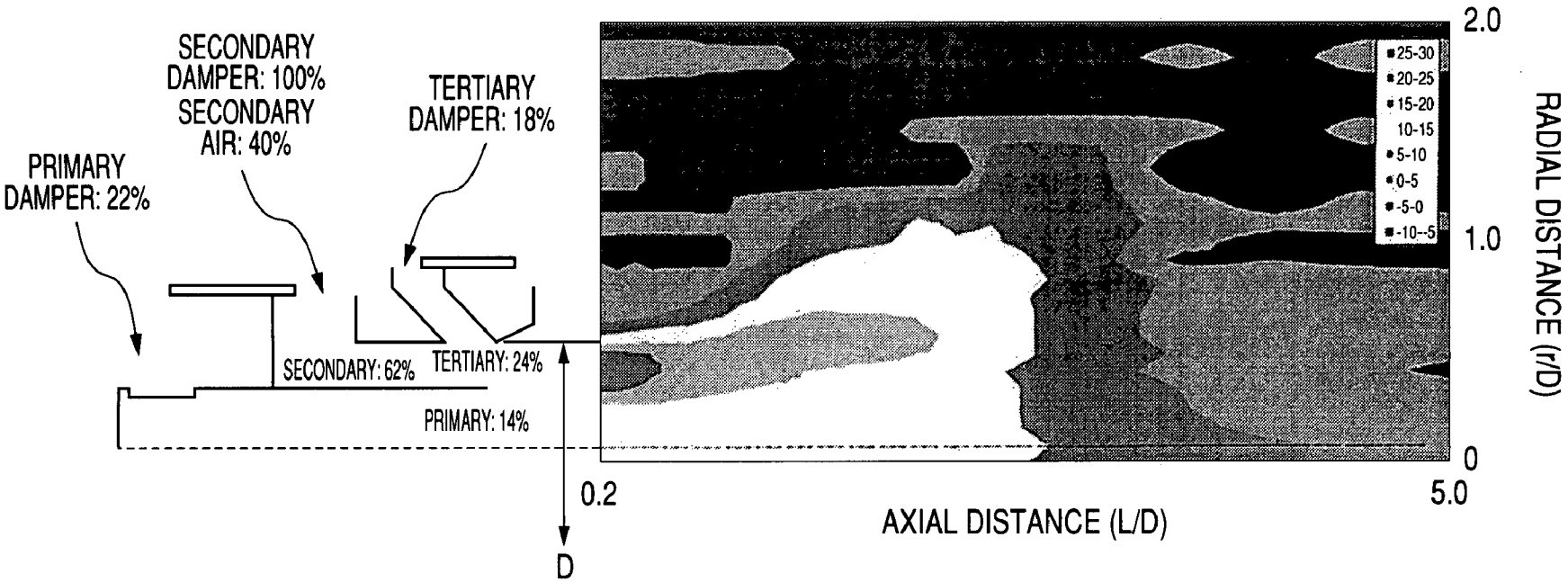
FIG. 59 shows a flow velocity distribution at the nozzle outlet port.
Figure 59B:
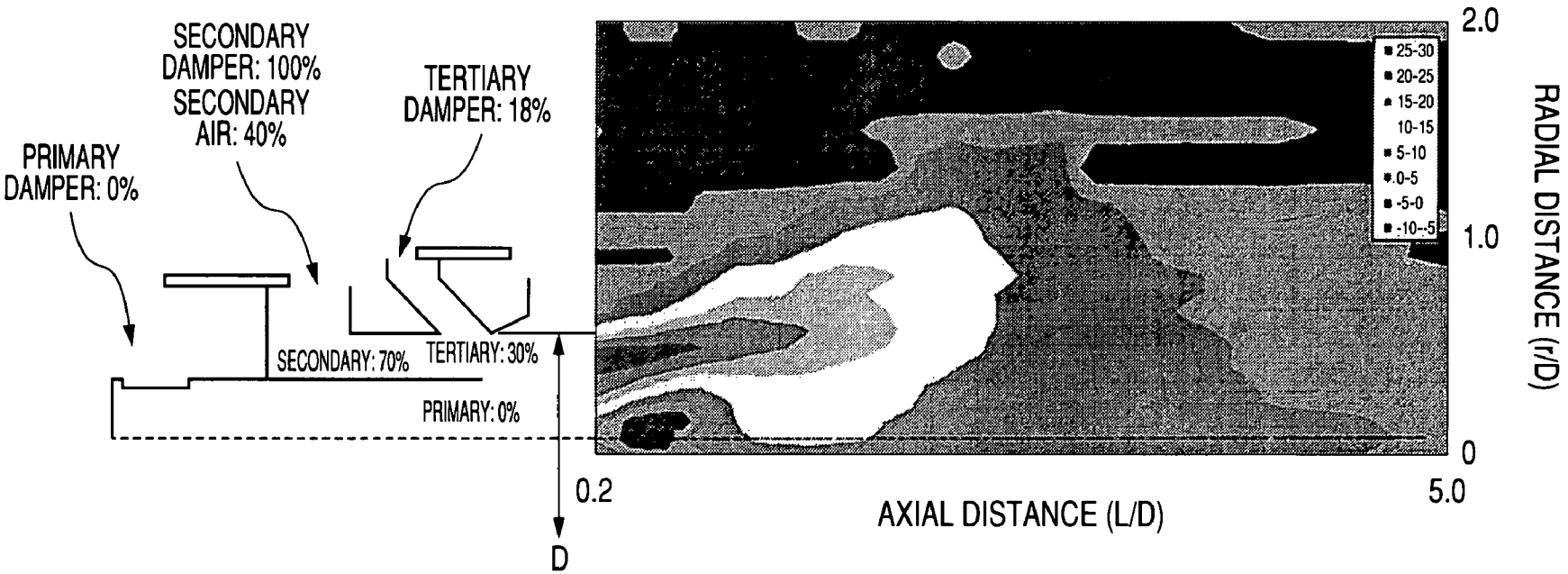
Figure 59C:
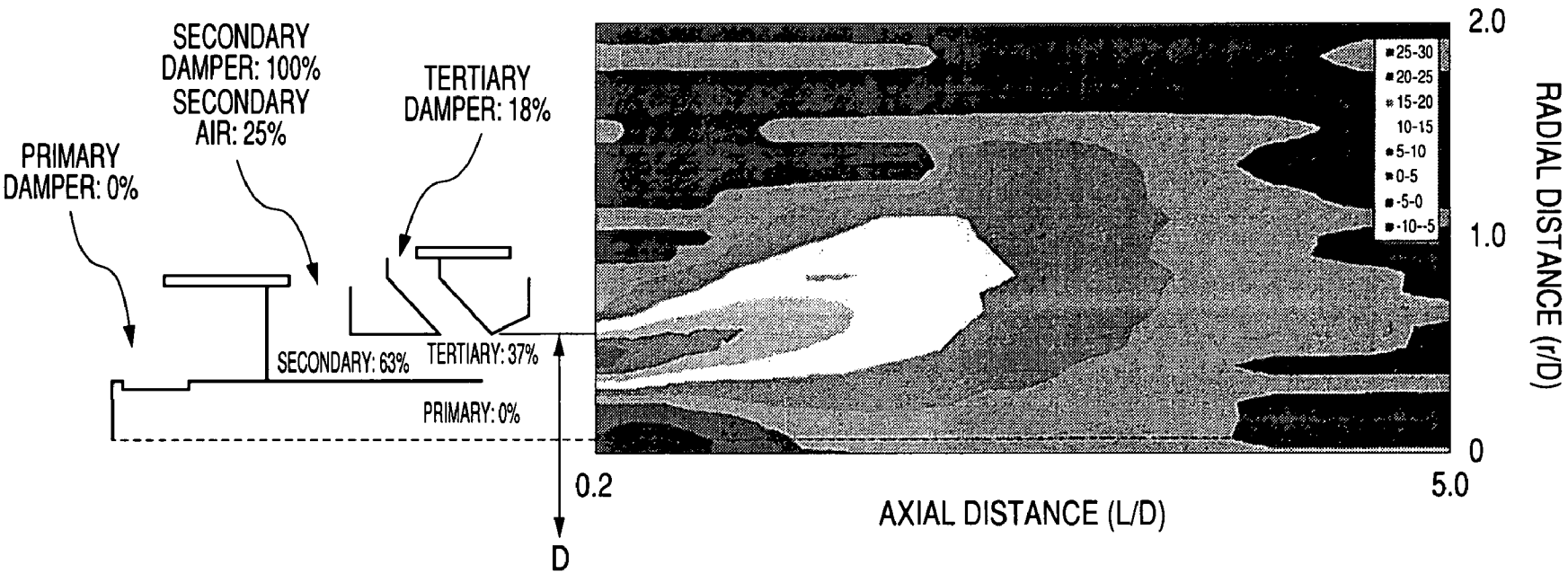

Then, a figure where the flow velocity distribution (a practical measured data) at the outlet port in the overfiring air port having the primary nozzle, the secondary nozzle and third nozzle is indicated like FIG. 54 is FIG. 59. In FIG. 59, the larger the absolute value of the speed, the nearer a black color, and the smaller the absolute value of flow velocity, the nearer a white color. The applied model was an actual size (an overfiring air port of a size applied to 1000 MV boiler) and as to the air flow rate, its test was carried out with a machine corresponding to the actual machine. However, since the air temperature keeps its normal temperature, an absolute value of flow velocity is kept low. The flow measurement was performed under a testing condition in which a flow rate of the contraction flow of the third air is kept constant and a swirling air amount of the secondary air and an amount of primary air are changed. It is apparent that (1) in this figure shows that the primary air having no circulation is flowed and a less amount of inverse flow region is found at the center part of the overfiring air port. (2) in this figure corresponds to the case in which no primary air is present and a circulation of the secondary air is weak. (3) in this figure similarly corresponds to the case in which the primary air is not present and a strong circulation of the secondary air is found.

In any cases, there is no difference in the widening of the injection flow and there is present a difference at the flow velocity distribution in a central part of the overfiring air port. When the widening of the high flow velocity injection is noticed, it is not flowed along the wall surface of the throat and any type of injection flow is influenced by the contraction flow. That is, since the injection flow falls off the wall surface of the throat, an inverse flow is generated at the fine region and has a potential that the ash particles accompanied with this flow are adhered to the wall and grown there.

Figure 56:
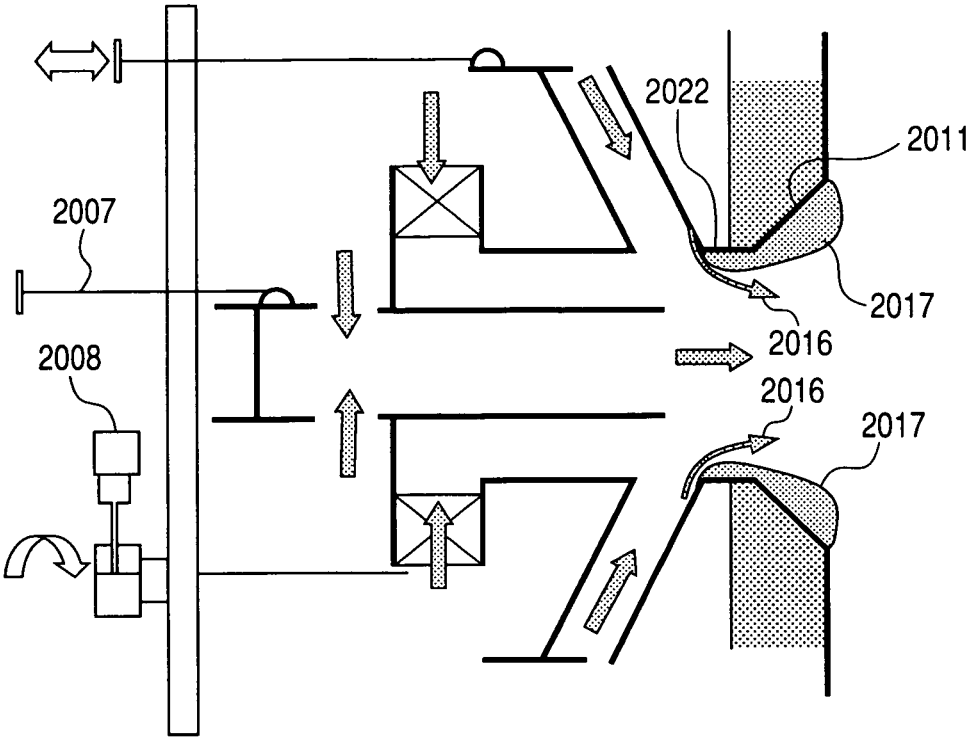
FIG. 56 is a view for showing an adhered state of ash at the overfiring air port having no louver.
Figure 57:
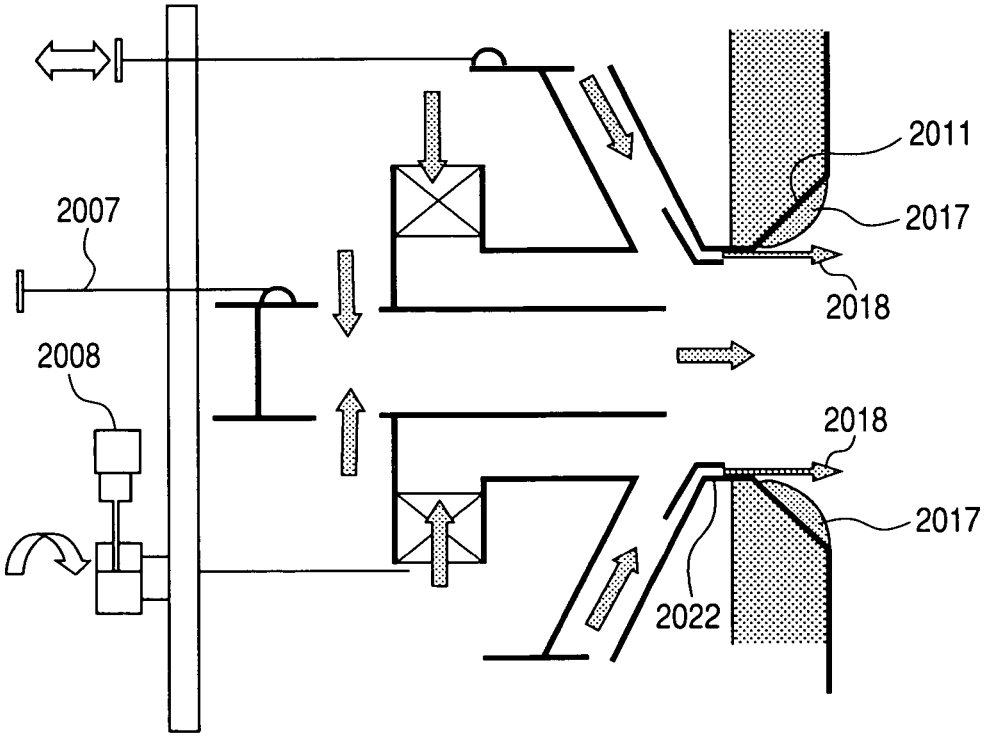
FIG. 57 is a view for showing an ash adhered state in the overfiring air port (preferred embodiment 5-1) having a louver.

FIG. 56 shows a state in which the third air flow falls off the throat 2022 and is changed into the contraction flow. Due to this fact, the ash 2017 adheres to the wall surface of the throat 2022 and the slant part 201. When the ash 2017 adheres to the wall surface of the throat 2022 and the slant part 2011, the ash is peeled off and drops into the overfiring air port when the boiler is stopped in operation and influences against its performance, so that the ahs must be removed. Thus, in this preferred embodiment, a louver 2010 is installed from the outlet port (the downstream side) of the front wall 2021 of the third nozzle as shown in FIG. 54 along the throat 2022 to enable the adhesion of the combustion ash accompanied by the contraction flow to be made minimum. In FIG. 57 is illustrated a state where ash adheres when the preferred embodiment is applied. The ash 2017 shows a state in which the ash adheres to the slant part 2011. If the ash adheres to the slant part 2011, it does not influence against a performance of the overfiring air port and an influence against the boiler performance is low. In addition, if the seal-fluid port 20 described in the preferred embodiment 2-2 and the like is also installed there, the ash adhesion at the slant part 2011 can be restricted.

Preferred Embodiment 5-2

Figure 55:
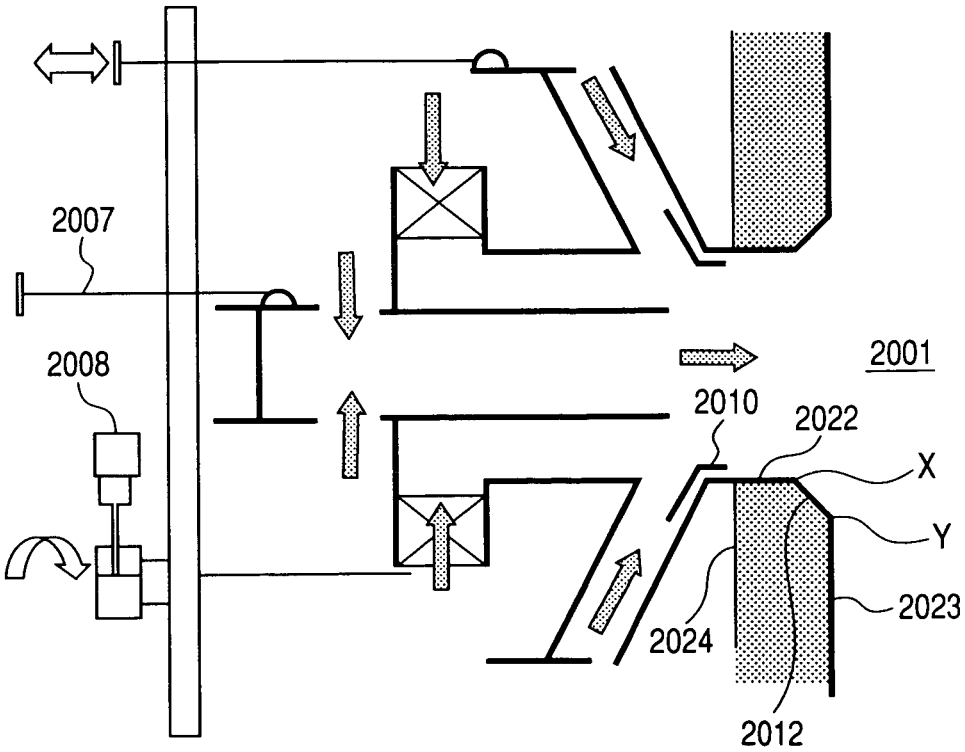
FIG. 55 is a sectional view for showing a structure of the overfiring air port in the preferred embodiment 5-2.

FIG. 55 is a sectional view taken along a sectional plane including a center line of the overfiring air port.

The overfiring air port (FIG. 55) in this preferred embodiment is substantially the same as that of the structure shown in the preferred embodiment 5-1. The same portions are therefore not described.

In this preferred embodiment, a chamfer at the throat 2022 and a chamfer at the inner wall 2023 facing against inside the furnace 2001 are set shallow as compared with that shown in FIG. 54. That is, a length of the throat 2022 is set long as compared with that shown in FIG. 54 and a distance of the slant part 2012 is made short. Further, an inclination of the slant part 2012 with respect to the center of the overfiring air port is substantially the same as that of the slant part 2011 shown in FIG. 54. Due to this fact, a connecting position Y between the inner wall 2023 of the furnace 2001 and the slant part 2012 is positioned at the center of the overfiring airport as compared with that shown in FIG. 54.

As described above, it is possible to adjust an amount of ash adhered to the slant part 2012 by arranging the connecting position X between the throat 2022 and the slant part 2012 more inside the furnace 2001 rather than the outer wall 2024 at the wall surface facing against inside the furnace 2001 in the overfiring air port having the louver 2010 shown in the preferred embodiment 5-1. Accordingly, it is possible to reduce an amount of ash adhered to the slant part 2012 because the length of the slant part 2012 becomes a short length by setting the connecting position X between the throat 2022 and the slant part 2012 inside the furnace 2001, and positioning the connecting position X between the slant part 2012 and the inner wall 2023 of the furnace 2001 at the center of the overfiring air port.

What is claimed is:

1. An overfiring air port for supplying an incomplete combustion region with air making up for combustion-shortage, in a furnace in which said incomplete combustion region less than stoichiometric ratio is formed by a burner, wherein said air port comprises a nozzle mechanism for injecting air including an axial velocity component of an air flow and a radial velocity component directed to a center line of said air port, and a control mechanism for controlling a ratio of these velocity components, wherein said nozzle mechanism comprises a first nozzle for injecting air straightly in an axial direction of said airport, a second nozzle for injecting air with a swirling flow in an axial direction of said air port, and a third nozzle for injecting air directed from outside said first nozzle toward a center line of said air port, wherein said third nozzle has a conical front wall and a conical rear wall oppositely arranged against said conical front wall to form a conical air flow passage of said third nozzle between said conical front wall and said conical rear wall, wherein an outlet of said third nozzle is connected to an extremity end of said second nozzle so that an end of said conical rear wall is positioned behind an end of said conical front wall at the outlet of said third nozzle when viewed from an inside of said furnace and thereby the outlet of said third nozzle borders an air flow passage of said second nozzle and said velocity component-ratio control mechanism is configured by a mechanism for controlling a flow rate ratio of airs injected by said respective nozzles, wherein said first nozzle, second nozzle and third nozzle are arranged coaxially and an outlet of said third nozzle borders on an extremity of said second nozzle so that a jet of air issuing from the third nozzle merges with a jet of air issuing from said second nozzle, and wherein said third nozzle has a conical front wall and a conical rear wall oppositely arranged against said front wall, an air flow passage of said third nozzle is formed between said conical front wall and said conical rear wall, said rear wall is axially movable and a flow passage sectional area of said third nozzle can be varied through the movement of said rear wall.

2. The overfiring air port according to claim 1, wherein said rear wall of said third nozzle is fixed to a front extremity of a movable sleeve guided on said second nozzle and axially moved with said movable sleeve.

3. An overfiring air port for supplying an incomplete combustion region with air making up for combustion-shortage, in a furnace in which said incomplete combustion region less than stoichiometric ratio is formed by a burner, wherein said air port comprises a nozzle mechanism for injecting air including an axial velocity component of an air flow and a radial velocity component directed to a center line of said air port, and a control mechanism for controlling a ratio of these velocity components, wherein said nozzle mechanism comprises a first nozzle for injecting air straightly in an axial direction of said airport, a second nozzle for injecting air with a swirling flow in an axial direction of said air port, and a third nozzle for injecting air directed from outside said first nozzle toward a center line of said air port, wherein said third nozzle has a conical front wall and a conical rear wall oppositely arranged against said conical front wall to form a conical air flow passage of said third nozzle between said conical front wall and said conical rear wall, wherein an outlet of said third nozzle is connected to an extremity end of said second nozzle so that an end of said conical rear wall is positioned behind an end of said conical front wall at the outlet of said third nozzle when viewed from an inside of said furnace and thereby the outlet of said third nozzle borders an air flow passage of said second nozzle and said velocity component-ratio control mechanism is configured by a mechanism for controlling a flow rate ratio of airs injected by said respective nozzles, and wherein a part of said second nozzle is rotatable around an axis of said third nozzle, said rotatable nozzle part is provided with plural cut-outs that are arranged at opposed positions with respect to said axis, an outlet of said third nozzle is partially closed by a wall surface of said rotatable nozzle part other than said cut-outs, and said cut-outs act as an outlet opening of said third nozzle.

4. A boiler in which a wall of a furnace is provided with at least one burner for fuel combustion, a wall portion of said furnace upper than said burner is provided with at least one overfiring air port having a divergent air duct portion close to its outlet, and over air is supplied to said furnace by said overfiring air port to perform a two-stage combustion, wherein a seal-fluid supplying apparatus is provided at said overfiring air port for sealing a part near the outlet of said overfiring air port by a seal fluid such as either gas or liquid, and wherein said overfiring air port includes a nozzle mechanism for injecting air including an axial velocity component of an air flow and a radial velocity component directed to a center line of said air port, and a control mechanism for controlling a ratio of these velocity components, wherein said nozzle mechanism comprises a first nozzle for injecting air straightly in an axial direction of said airport, a second nozzle for injecting air with a swirling flow in an axial direction of said air port, and a third nozzle for injecting air directed from outside said first nozzle toward a center line of said air port, wherein said third nozzle has a conical front wall and a conical rear wall oppositely arranged against said conical front wall to form a conical air flow passage of said third nozzle between said conical front wall and said conical rear wall, wherein an outlet of said third nozzle is connected to an extremity end of said second nozzle so that an end of said conical rear wall is positioned behind an end of said conical front wall at the outlet of said third nozzle when viewed from an inside of said furnace and thereby the outlet of said third nozzle borders an air flow passage of said second nozzle, and said velocity component-ratio control mechanism is configured by a mechanism for controlling a flow rate ratio of airs injected by said respective nozzles, and wherein said seal-fluid supplying apparatus branches a part of said over air and injects it as said seal fluid.

5. An overfiring air port for supplying an incomplete combustion region with air making up for combustion-shortage, in a furnace in which said incomplete combustion region less than stoichiometric ratio is formed by a burner, wherein said air port comprises a nozzle mechanism for injecting air including an axial velocity component of an air flow and a radial velocity component directed to a center line of said air port, and a control mechanism for controlling a ratio of these velocity components, wherein said nozzle mechanism comprises a first nozzle for injecting air straightly in an axial direction of said airport, a second nozzle for injecting air with a swirling flow in an axial direction of said air port, and a third nozzle for injecting air directed from outside said first nozzle toward a center line of said air port, wherein said third nozzle has a conical front wall and a conical rear wall oppositely arranged against said conical front wall to form a conical air flow passage of said third nozzle between said conical front wall and said conical rear wall, wherein an outlet of said third nozzle is connected to an extremity end of said second nozzle so that an end of said conical rear wall is positioned behind an end of said conical front wall at the outlet of said third nozzle when viewed from an inside of said furnace and thereby the outlet of said third nozzle borders an air flow passage of said second nozzle; and said velocity component-ratio control mechanism is configured by a mechanism for controlling a flow rate ratio of airs injected by said respective nozzles, wherein the overfiring air port is for use in supplying over air for two-stage combustion of a boiler, and has a divergent duct portion close to its outlet, wherein there is provided a seal-fluid supplying apparatus for sealing said divergent duct portion with a seal fluid such as either gas or liquid, and wherein a part of said over air is branched and supplied as said seal fluid.

* * * * *